US010729617B2

(12) United States Patent
Phipps

(10) Patent No.: US 10,729,617 B2
(45) Date of Patent: Aug. 4, 2020

(54) SYSTEM, APPARATUS, AND METHOD FOR EXTENDING THE USEFUL LIFE OF MEDICINE

(71) Applicant: Phipps Innovations, LLC, Chicago, IL (US)

(72) Inventor: Matthew Christopher Phipps, Chicago, IL (US)

(73) Assignee: Phipps Innovations, LLC, Chicago, IL (US)

( * ) Notice: Subject to any disclaimer, the term of this patent is extended or adjusted under 35 U.S.C. 154(b) by 527 days.

(21) Appl. No.: 15/460,202

(22) Filed: Mar. 15, 2017

(65) Prior Publication Data

US 2017/0333286 A1 Nov. 23, 2017

Related U.S. Application Data

(60) Provisional application No. 62/314,515, filed on Mar. 29, 2016, provisional application No. 62/350,061, filed on Jun. 14, 2016, provisional application No. 62/375,920, filed on Aug. 17, 2016.

(51) Int. Cl.

| | |
|---|---|
| ***A61J 1/20*** | (2006.01) |
| ***A61J 1/12*** | (2006.01) |
| ***A61J 1/10*** | (2006.01) |
| ***A61J 1/14*** | (2006.01) |

(52) U.S. Cl.

CPC ..... *A61J 1/2048* (2015.05); *A61J 1/10* (2013.01); *A61J 1/12* (2013.01); *A61J 1/1406* (2013.01); *A61J 1/20* (2013.01); *A61J 1/202* (2015.05); *A61J 1/2013* (2015.05); *A61J 1/2072* (2015.05); *A61J 1/2082* (2015.05)

(58) Field of Classification Search

CPC .... A61J 1/10; A61J 1/12; A61J 1/1406; A61J 1/1443; A61J 1/20; A61J 1/2003; A61J 1/2013; A61J 1/202; A61J 1/2048; A61J 1/2072; A61J 1/2082

See application file for complete search history.

(56) References Cited

U.S. PATENT DOCUMENTS

| | | | |
|---|---|---|---|
| 4,564,054 | A | 1/1986 | Gustavsson |
| 6,715,520 | B2 | 4/2004 | Andreasson et al. |
| 9,492,353 | B2 | 11/2016 | Nord et al. |
| 9,510,997 | B2 | 12/2016 | Kriheli et al. |
| 2008/0142388 | A1 | 6/2008 | Whitley et al. |
| 2009/0057258 | A1 | 3/2009 | Tornqvist |

(Continued)

*Primary Examiner* — Benjamin J Klein

(57) ABSTRACT

An apparatus to preserve liquid from a medicine vial may include a vial coupling member forming a vial coupling member cavity and a container forming a cavity. The apparatus may further include a first fluid pathway forming a first lumen that is in fluid communication with the vial coupling member cavity and the cavity and a second fluid pathway forming a second lumen that is in fluid communication with the vial coupling member cavity and the cavity. The vial coupling member cavity, the cavity, the first lumen, and the second lumen may form a sterile environment that is sealed from contaminants in an ambient environment. The apparatus may include a disengaging member configured to permit the container to disengage from the first fluid pathway and the second fluid pathway while permanently sealing at least one of the first lumen or the second lumen.

9 Claims, 20 Drawing Sheets

(56) References Cited

U.S. PATENT DOCUMENTS

| | | | | |
|---|---|---|---|---|
| 2010/0147402 | A1 | 6/2010 | Tornqvist | |
| 2010/0249723 | A1 | 9/2010 | Fangrow, Jr. | |
| 2011/0022031 | A1 | 1/2011 | Fangrow, Jr. | |
| 2011/0108158 | A1 | 5/2011 | Huwiler et al. | |
| 2012/0046636 | A1 | 2/2012 | Kriheli | |
| 2013/0225903 | A1 | 8/2013 | Franci et al. | |
| 2014/0246616 | A1 | 9/2014 | Fangrow | |
| 2014/0276386 | A1* | 9/2014 | Mansour | A61J 1/2096 604/93.01 |
| 2015/0123398 | A1 | 5/2015 | Sanders | |
| 2015/0320641 | A1 | 11/2015 | Fangrow | |
| 2015/0359709 | A1* | 12/2015 | Kriheli | A61J 1/2013 604/405 |
| 2016/0038373 | A1 | 2/2016 | Ohlin | |
| 2016/0136051 | A1 | 5/2016 | Lavi | |
| 2016/0262981 | A1 | 9/2016 | Carrez et al. | |
| 2016/0287475 | A1 | 10/2016 | Yevmenenko et al. | |

* cited by examiner

SYSTEM, APPARATUS, AND METHOD FOR EXTENDING THE USEFUL LIFE OF MEDICINE

RELATED APPLICATIONS

This present disclosure claims the benefit under 35 U.S.C. § 119(e), of the filing of U.S. Provisional Patent Application Ser. No. 62/314,515, filed on Mar. 29, 2016, entitled "SYSTEM AND METHOD TO EXTRACT LIQUID FROM A MEDICINE VIAL", U.S. Provisional Patent Application Ser. No. 62/350,061, filed on Jun. 14, 2016, entitled "SYSTEM AND METHOD FOR THE STERILE EXTRACTION OF LIQUID FROM A MEDICINE VIAL", and U.S. Provisional Patent Application Ser. No. 62/375,920, filed on Aug. 17, 2016, entitled "SYSTEM AND METHOD FOR THE STERILE EXTRACTION OF MATERIAL FROM A MEDICINAL VIAL", which are incorporated herein by reference for all purposes.

TECHNICAL FIELD

This disclosure relates generally to maintaining sterility of medicine. More specifically, this disclosure relates to a system, apparatus and method to maintain sterility of a remaining portion of medicine from a vial after a portion of medicine from the vial is extracted for use in a patient. In some cases, the vial may be a single-use vial.

BACKGROUND

In the United States alone, over $1 billion is spent every year on prescribed medications that are never administered to patients due to waste. (See, B M J 2016; 352:i788 doi: 10.1136/bmj.i788 (Published 1 Mar. 2016.) As biological protein drugs (biologics) that require intravenous (IV) infusion become more prominent and replace orally-administered small molecule drugs, the amount of money wasted will continue to increase. For example, in 2015, 11 of the 45 new drugs approved by the Food and Drug Administration (FDA) were biologics, while only 6 of the 29 new drugs approved by the FDA in 2011 were biologics. In 2016, 7 of the 19 new drug approvals were biologics.

Biologics (as well as many other IV infused drugs) may ordinarily be dosed based on a patient's weight or based on a patient's estimated skin surface area to achieve a therapeutically effective concentration of drug while attempting to minimize the rate of severe adverse events for the patient and on the target tissue. Many of the biological protein drugs may be provided in single-use vials with only one or two volume sizes. Accordingly, a full patient-specific dose of a biological protein drug from single-use vials may often lead to an excess quantity of the drug remaining in the last vial after the full dose is administered. This excess drug quantity is currently discarded because sterility of the excess drug cannot be ensured for a reasonable period of time or upon re-penetrating the membrane or septum of the vial for use of the remaining drug in another patient.

For example, the drug, Avastin (generic name bevacizumab) is frequently used to treat many types of cancer. Avastin is currently sold in 100 mg and 400 mg single-use vials, yet the FDA has approved dose ranges from 5-15 mg/kg based on the tumor type. The FDA approved dose for lung cancer patients is 15 mg/kg dose of Avastin. A patient with lung cancer weighing 70 kg would require 1050 mg of Avastin for a full dose. Therefore, after the patient receives the full dose of Avastin, a minimum of 50 mg of excess Avastin will be remaining in the last vial. Recently published wholesale acquisition costs for Avastin indicate that 50 mg of Avastin costs approximately $360. Thus, discarding 50 mg of Avastin costs a patient, a hospital, or an insurance company, for example, approximately $360. Assuming the patient receives the 1050 mg dose of Avastin every two weeks for a year, approximately $9,360 of Avastin is wasted in treating that patient per year.

Accordingly, systems, apparatuses, and methods to maintain a sterile environment for a remaining portion of medicine from a vial after a portion of the medicine from the vial is extracted for use on a patient is provided. The systems, apparatuses, and methods provide a safe and reliable means to reduce drug waste and extend the beyond use date of medicine. It should be understood that the beyond use date may be the amount of time that a drug may be safely used before attaining an unsafe amount of contamination after the drug is reconstituted for use in a patient. It should also be understood that contamination may include at least one of microbial contamination, bacterial contamination, viral contamination, chemical contamination, or any other type of contamination known by those having ordinary skill in the art. In addition, the systems, apparatuses, and methods discussed herein may be used to reduce healthcare worker (such as a nurse or pharmacist) exposure to hazardous drugs, prevent leakage, and surface contamination from spills. In some cases, the systems, apparatuses, and methods may be used without the need for a biosafety cabinet providing the required amount of air changes during drug extraction. Such features may have a significant impact on public health services.

SUMMARY

This disclosure provides an apparatus and method to extend the life of medicine from a medicine vial beyond the beyond-use-date (B.U.D.).

In a first example embodiment, an apparatus to preserve a first fluid from a medicine vial is provided. The apparatus may include a vial coupling member. The vial coupling member may include a vial coupling member cavity formed by a housing and a flexible membrane. The apparatus may also include a cavity formed by a container. In some embodiments, the container may be a variable volume container. The apparatus may also include a first fluid pathway forming a lumen that is in fluid communication with the cavity and the vial coupling member cavity. The apparatus may further include a second fluid pathway forming a second lumen that is also in fluid communication with the cavity and the vial coupling member cavity. When the medicine vial is coupled to the vial coupling member, the cavity may be configured to receive the first fluid from the medicine vial through the first lumen and simultaneously distribute a second fluid into the second lumen for the medicine vial.

In a second example embodiment, an apparatus for disengaging a vial coupling member from a container forming a cavity is provided. The apparatus may include an upper member fixedly coupled to a first fluid pathway and forming an upper member lumen that is in fluid communication with a first lumen formed by the first fluid pathway. The apparatus may also include a lower member fixedly coupled to a second fluid pathway and in contact with the upper member, the lower member forming a lower member lumen that is in fluid communication with a second lumen formed by the second fluid pathway. The apparatus may further include a closing member forming a closing member lumen that is in fluid communication with the first lumen and the second lumen when the closing member is in an open position. The closing member may be configured to transition from the open position to a closed position when either the upper member or the lower member moves out of contact with the other. In some embodiments, when the closing member transitions from the open position to the closed position, at least one of the first lumen or the second lumen may seal before being exposed to an ambient environment. When the closing member is in the closed position, at least one of the first lumen or the second lumen may be sealed. In addition, the apparatus may include a securing member configured to hold the closing member in the closed position when either the upper member or the lower member moves into contact with the other after the either the upper member or the lower member moves out of contact with the other. In some embodiments, the securing member may include at least one of a locking mechanism, an adhesive, a component of the closing member that biases the closing member toward the closed position, or any other securing mechanism known by those having ordinary skill in the art.

In a third example embodiment, an apparatus to preserve liquid from a medicine vial is provided. The apparatus may include a vial coupling member forming a vial coupling member cavity. The apparatus may also include a container forming a cavity. The apparatus may further include a first fluid pathway coupled to the container and forming a first lumen that is in fluid communication with the vial coupling member cavity and the cavity. In addition, the apparatus may include a second fluid pathway coupled to the container and forming a second lumen that is in fluid communication with the vial coupling member cavity and the cavity. In some embodiments, the vial coupling member cavity, the cavity, the first lumen, and the second lumen may form a sterile environment that is sealed from contaminants in an ambient environment. The apparatus may further include a disengaging member configured to permit the container to disengage from the first fluid pathway and the second fluid pathway while permanently sealing the first lumen and the second lumen to prevent fluidly coupling at least one of the cavity and the ambient environment or the vial coupling member cavity and the ambient environment.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

FIGS. 1 through 21, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system including the various devices, systems, and apparatuses described herein. While a number of different embodiments are described herein, one or more aspects or elements of each embodiment are not specific to only that embodiment and may be used in other embodiments discussed herein.

Generally, in order to protect patients being treated with sterilely prepared drugs, the U.S. Pharmacopeia Chapter 797 mandates that single use (such as single dose) vials must be discarded within one hour after initial puncture of the single use vial unless maintained inside an International Organization for Standardization (ISO) 5 air condition, in which case the timeline is increased to six hours after initial puncture. Currently, typical hospital and pharmacy procedures include discarding the vial and the remaining medicine in the vial after initial puncture of the single use vial and a portion of the medicine is extracted. However, the U.S. Pharmacopeia Chapter 797 mandate does allow for potential extension of the beyond-use date for drugs if studies conducted demonstrate the validity of the extension. At present, numerous drugs have been shown to maintain a significant level of stability at refrigerated temperatures over a period of at least a week. Thus systems, apparatus, and method, as discussed herein, maintain sterility and prevent environmental contamination of remaining drugs from a single use vial after an initial puncture of the single use vial and an extraction of a portion of the drug from the single use vial for use by a patient take place. For example, the systems, apparatuses, and methods discussed herein enable at least one subsequent and safe extraction of a remaining amount of a drug (such as liquid drug) from a vial for subsequent and safe use by a patient (such as another patient) after initial extraction of a fraction of a total amount of drug from the vial is made for initial use by a patient.

Figure 1:
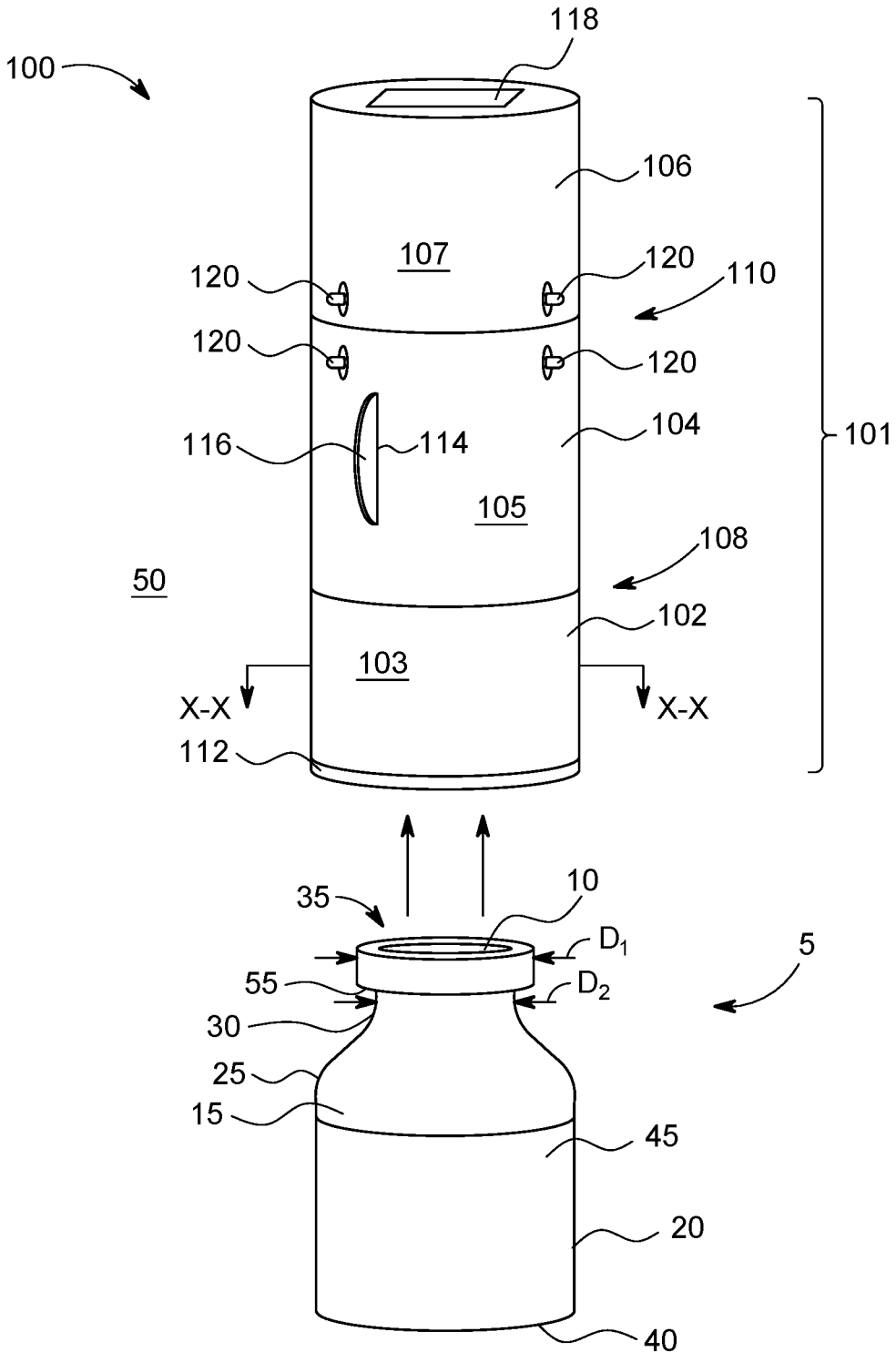
FIG. 1 illustrates an example perspective view of a system according to this disclosure.

FIG. 1 illustrates an example perspective view of a system 100 according to this disclosure. One or more of the components described herein with respect to FIG. 1 may be used with any other embodiments described herein including the embodiments described with respect to FIGS. 2-21 provided herein. The system 100 may include various components to extend the useful life or beyond use date of remaining medicine in a vial after the same vial is punctured and a portion of medicine is extracted from the same vial. For instance, the system 100 may include a vial coupling member 102, a fluid transfer member 104, and a fluid retaining member 106. The system 100 may also include a housing 101. The housing 101 may form an outer shell of the system 100. The housing 101 may include a vial coupling member housing 103, a fluid transfer member housing 105, and a fluid retaining member housing 107. The vial coupling member 102 may include the vial coupling member housing 103. The vial coupling member housing 103 may form an outer shell of the vial coupling member 102. The fluid transfer member 104 may include the fluid transfer member housing 105. The fluid transfer member housing 105 may form an outer shell of the fluid transfer member 104. The fluid retaining member 106 may include the fluid retaining member housing 107. The fluid retaining member housing 107 may form an outer shell of the fluid retaining member 106.

The vial coupling member 102 may be configured to receive at least a portion of a vial 5 (such as a medicine vial) and form a sealed space around at least the received portion of the vial 5. For example, the vial coupling member 102 may include or form a cavity (discussed herein) that is exposed to an ambient environment 50 and configured to receive at least the portion of the vial 5. When the vial coupling member 102 receives the vial 5, a vial coupling member lip 112 may engage an outer surface of the vial 5 and form a sealed space between the vial coupling member 102 and the vial 5. The sealed space may contain a vial septum 10 and seal the vial septum 10 from the ambient environment 50. The vial coupling member lip 112 may include a flexible or malleable material that conforms to curvatures and angles of an object (such as a vial 5) in order to sealingly engage with a surface of the object. The vial coupling member lip 112 may include at least one of an impermeable elastomeric material that has pores with a diameter of less than 20 microns. "Elastomeric" means having the properties of an elastomer. Elastomeric materials or elastomers general refer to a polymeric material that has rubber-like properties. More specifically, most elastomers haven elongation rates greater than 100% and a significant amount of resilience. The resilience of a material refers to the material's ability to recover from an elastic deformation. Examples of elastomers may include natural rubbers, polyisoprene, styrene butadiene rubber, chloroprene rubber, polybutadiene, nitrile rubber, butyl rubber, ethylene propylene rubber, ethylene propylene dienemonomer, chlorosulfonated polyethelene, polysulfide rubber, polyurethane, EVA film, co-polyester, and silicones. It should be understood that an outer surface of the vial 5 may include at least one of an outer surface on the body 20 of the vial 5, a shoulder 25 of the vial 5, a neck 30 of the vial 5, or a top 35 of the vial 5. In some embodiment, the vial coupling member lip 112 may be configured to engage an outer surface on the bottom 40 of the vial 5. The relative heights and cross-sectional distances of the vial 5 and the cavity of the vial coupling member 102 may determine the location that the vial coupling member lip 112 sealingly engages an outer surface of the vial 5.

The vial coupling member 102 may be configured to securely fasten to the vial 5 after forming the sealed space in order to maintain the sealed space around at least the received portion of the vial 5. Thus, the vial coupling member 102 may be configured to prevent ingress of contaminants into the sealed space and to prevent the egress of fluid 45 from the vial 5 into the ambient environment 50. For example, once the vial coupling member 102 is securely fastened to the vial 5, the system 100 coupled or fastened to the vial 5 may be turned, handled, manipulated, or flipped up-side-down while preventing ingress of contaminants into the sealed space and egress of fluid 45 from the vial 5 into the ambient environment 50.

The vial coupling member 102 may include one or more vial membrane penetrators or vial penetrators (discussed herein) configured to penetrate a vial septum 10 and open fluid communication between an interior space 15 of the vial 5 and one or more fluid passageways or fluid pathways (discussed herein) providing fluid communication through the fluid transfer member 104 and into one or more chambers or cavities (discussed herein) within the fluid retaining member 106. The vial penetrators may be positioned and configured to penetrate a vial septum 10 after the sealed space is formed so that sterility is maintained around at least the portion of the vial 5 received by the vial coupling member 102.

In some embodiments, the vial coupling member 102 may be configured to disengage from the fluid transfer member 104 at the first disengaging section 108. For example, after the vial coupling member 102 receives at least the portion of the vial 5 and at least some fluid 45 from the vial 5 is communicated through the fluid pathways into a cavity within the fluid retaining member 106, the vial coupling member 102 may disengage from the fluid transfer member 104 at the first disengaging section 108 while the vial coupling member 102 is still maintaining the sealed space sealing the vial septum 10 from the ambient environment 50. This feature may be useful to reduce the height of the system 100 when coupled to the vial 5 for storage and subsequent use of the remaining fluid 45 within the vial 5. As will be discussed herein, the one or more fluid pathways may seal before complete disengagement at the first disengaging section 108 to prevent exposing the fluid 45 in the fluid pathways to the ambient environment 50. This feature may be useful to protect a user of the system 100 from hazards that may occur as a result of exposure to the fluid 45. In some embodiments, the first disengaging section 108 may be configured so that after the vial coupling member 102 disengages from the fluid transfer member 104, the vial coupling member 102 cannot reengage with the fluid transfer member 104 and the fluid pathways cannot reinitiate fluid communication across the first disengaging section 108 from the vial coupling member 102 to the fluid transfer member 104. This feature may be useful to prevent a user from using the system 100 an unsafe number of times after an initial fluid extraction from the vial 5.

The fluid transfer member 104 may be configured to communicate fluid between the vial coupling member 102 and the fluid retaining member 108 through the one or more fluid pathways. In some embodiments, fluid 45 may be communicated through the fluid transfer member 104 using gravity. For example, when the fluid 45 is a liquid, the system 100 coupled to the vial 5 may be turned up-side-down so that liquid flows from the vial 5 through at least one fluid pathway into the fluid retaining member 106. In at least this embodiment, another fluid pathway may communicate a sterile gas from the fluid retaining member 106 to the interior space 15 of the vial 5 to maintain pressurization in the interior space 15 of the vial 5. In some embodiments, a cavity formed by a container within the fluid retaining member 106 may be configured to receive the fluid 45 from the vial 5 while also providing the sterile gas to pressurize the vial 5. For example, the cavity formed by the container of the fluid retaining member 106 may receive the fluid 45 from the vial 5 while simultaneously providing the sterile gas to pressurize the vial 5. Thus, as fluid 45 is received by the cavity of the fluid retaining member 106, the fluid 45 received by the cavity may be permitted to come into direct contact with sterile gas for vial pressurization that is remaining within the cavity.

It should be understood that the terms "cavity" and "chamber" may mean, for the purposes of this disclosure, an at least partially enclosed volume that permits fluid communication throughout the volume. For example, a volume formed by an enclosure that permits fluid to move throughout the entire volume may be a cavity for the purposes of this disclosure. It should also be understood that a volume formed by an enclosure (such as a syringe) and having a piston that sealingly slides through the volume may be two separate cavities separated by the piston and is thus not a single cavity for the purposes of this disclosure. The volume formed by the enclosure may be two separate cavities and not a single cavity due to a sealing engagement between the piston within the volume and an inner surface of the enclosure that prevents direct fluid communication within the volume across the piston. Further, it should be understood that when a tube with a lumen passes through a volume formed by an enclosure, the lumen and the volume may be considered to be two separate cavities and thus not a single cavity for the purposes of this disclosure. The lumen and the volume may be two separate cavities and not a single cavity because no direct fluid communication exists between the lumen and the volume. Direct fluid communication between the lumen and the volume may exist when, for example, an aperture is positioned through the tube between the lumen and the volume or at an end of the tube that is exposed to the volume in order to permit fluid communication between the lumen and the volume.

The fluid transfer member 104 may include a pump (discussed herein). The pump may be configured to mechanically facilitate fluid communication through the fluid pathways into and out of the one or more cavities of the fluid retaining member 106. For example, the pump may be configured to communicate fluid 45 from the vial 5 through a fluid pathway and into a cavity of the fluid retaining member 106. The pump may be configured to communicate fluid (such as a sterile gas) from a cavity of the fluid retaining member 106 through a fluid pathway and into the interior space 15 of the vial 5. The fluid transfer member 104 may include a pump access aperture 114 configure to provide access from the ambient environment 50 to a pump activation member 116. The pump activation member 116 may be configured to activate the pump. The pump may include at least one of an electric pump or a manual pump. In some embodiments, the pump is a peristaltic pump.

The fluid retaining member 106 may be configured to receive fluid 45 from a fluid pathway and retain the fluid 45 in cavities form by one or more containers of the fluid retaining member 106. The fluid retaining member 106 may be configured to prevent ingress of contaminants from the ambient environment 50 into the cavities and egress of fluid from the cavities into the ambient environment 50. In at least some embodiments, a cavity of the fluid retaining member 106 may be configured to contain and provide fluid (such as a sterile gas for vial pressurization or fluid for drug reconstitution) that is to be received through a fluid pathway and by the interior space 15 of the vial 5.

The fluid retaining member 106 may include one or more fluid access members 118. The fluid access members 118 may be configured to provide access to fluid stored in cavities formed by containers of the fluid retaining member 106 using a fluid extraction device. For example, the fluid access members 118 may include a needle permeable material or needle penetrable material. The fluid access members 118 may include one or more materials that are the same as or similar to materials of the vial septum 10. The fluid access members 118 may include any materials used for vial septums known by those having ordinary skill in the art. In at least this embodiment, the fluid access members 118 may be configured to permit a needle to penetrate therethrough and into a cavity formed by a container to extract fluid 45 from the cavity of the container. It should be understood that while the fluid access member 118 may include a needle penetrable material, the fluid access member 118 may be configured to receive a closed system transfer device (CSTD). Example CSTDs include PHASEAL® provided by Becton Dickinson, CHEMOCLAVE® provided by ICU Medical, Inc, and EQUASHIELD® provided by Equashield, LLC.

In some embodiments, the fluid retaining member 106 may be configured to disengage from the fluid transfer member 104 at a second disengaging section 110. For example, after at least one cavity formed by a container of the fluid retaining member 106 receives at least some fluid 45 from the vial 5 communicated through a fluid pathway, the fluid retaining member 106 may disengage from the fluid transfer member 104 at the second disengaging section 110. After the fluid retaining member 106 disengages from the fluid transfer member 104, a fluid extraction device (such as a needle or CSTD) may be used to penetrate into the cavity and extract the fluid 45 from the cavity within the fluid retaining member 106. This feature may be useful to remove or reduce the potential for exposure of the ambient environment 50 or contaminants from the ambient environment 59 into the sealed space formed by the vial coupling member 102 and the interior space 15 of the vial 5 when the fluid extraction device is introduced into the cavity of the fluid retaining member 106.

In some embodiments, when the fluid retaining member 106 includes two or more containers forming separate cavities, each of the cavities may separately receive some of the fluid 45 from the vial 5. Subsequently, the containers may be individually separated or disengaged from each other and the fluid transfer member 104 at the second disengaging section 110 so that fluid 45 from the vial 5 in each of the cavities may be individually stored in the sterile environment of each of the cavities. Further, after the containers disengage from the fluid transfer member 104, a fluid extraction device (such as a needle or CSTD) may be used to penetrate the cavity of one of the containers and extract the fluid 45 from that cavity while potentially exposing that cavity to contaminants from the ambient environment 50. However, because another container forming a separate cavity retaining some fluid 45 from the same vial 5 is not penetrated by a fluid extraction device, that cavity of the other container remains sterile and unexposed to contaminants from the ambient environment 50. This container may be stored for fluid extraction at a later time.

As will be discussed herein and similar to the first disengaging section 108, the fluid pathways may seal before complete disengagement at the second disengaging section 110 to prevent exposing the fluid 45 in the fluid pathways to the ambient environment 50 or contaminants in the ambient environment 50. In some embodiments, the second disengaging section 110 may be configured so that after the fluid retaining member 106 disengages from the fluid transfer member 104, the fluid retaining member 106 cannot reengage with the fluid transfer member 104 and the one or more fluid pathways cannot reinitiate fluid communication across the second disengaging section 110 from the fluid retaining member 106 to the fluid transfer member 104. This feature may be useful to prevent a user from using the system 100 an unsafe number of times after an initial fluid extraction from the vial 5.

The systems, apparatuses, and methods as described herein, such as the system 100, may be configured to permit a user, pharmacist, nurse, or hospital staff to sterilely extract a remaining amount of liquid drug from an interior space 15 of a vial 5 after an initial amount of liquid drug is extracted from the interior space 15 of the same vial 5. Thus, the systems, apparatuses, and methods described herein may allow a liquid drug in a single use vial to be safely and sterilely accessed a first time and a second time. The systems, apparatuses, and methods described herein may maintain sterility of the interior space 15 of the vial 5 as well as the sealed space including the vial septum 10 for a period of time after an initial extraction of a portion or a fraction of the fluid 45 from the interior space 15 of the vial 5 for a first user so that a subsequent extraction of remaining fluid 45 from the interior space 15 of the vial 5 can be safely and sterilely extracted and safely administered to a second user. The systems, apparatuses, and methods described herein may maintain sterility of two separate cavities formed by two separate containers of a fluid retaining member 106 for a period of time after an extraction of the fluid 45 from the vial 5 and a portion of the fluid 45 is stored in a first cavity formed by a first container of the two separate containers while a remaining portion of the fluid 45 is stored in a second cavity formed by a second container of the two separate containers. The fluid 45 may be safely and sterilely extracted and safely administered to a first user from the first cavity and after the period of time to a second user from the second cavity. The period of time may include about six hours, about twelve hours, about eighteen hours, about twenty-four hours, about thirty hours, about thirty-six hours, about forty-two hours, about forty-eight hours, about fifty-four hours, about sixty hours, about sixty-six hours, about seventy-two hours, about seventy-eight hours, about eighty-four hours, about ninety hours, about ninety-six hours, about one hundred two hours, about one hundred eight hours, about one hundred fourteen hours, about one hundred twenty hours, about one hundred twenty-six hours, about one hundred thirty-two hours, about one hundred thirty-eight hours, about one hundred forty-four hours, about one hundred fifty hours, about one hundred fifty-six hours, about one hundred sixty-two hours, about one hundred sixty-eight hours, about one hundred seventy-four hours, about one hundred eighty hours, about one hundred eight-six hours, about one hundred ninety-two hours, about one hundred ninety-eight hours, about two hundred four hours, about two hundred ten hours, about two hundred sixteen hours, about two hundred twenty-two hours, about two hundred twenty-eight hours, about two hundred thirty-four hours, about two hundred forty hours, about two hundred forty-six hours, about two hundred fifty-two hours, about two hundred fifty-eight hours, about two hundred sixty-four hours, about two hundred seventy hours, about two hundred seventy-six hours, about two hundred eighty-four hours, about two hundred ninety hours, about two hundred ninety-six hours, about three hundred two hours, about three hundred eight hours, about three hundred fourteen hours, about three hundred twenty hours, about three hundred twenty-six hours, about three hundred thirty-two hours, or about three hundred thirty-eight hours.

In operation, the system 100 may be used in conjunction with a vial 5 containing a fluid 45. The system 100 may receive the vial 5 through an opening to a cavity of the vial coupling member 102. The opening may be located at a distal end of the system 100. As the cavity of the vial coupling member 102 receives the vial 5, a sealed space may form between the system 100 and the vial 5. The sealed space may include the vial septum 10 such that the vial septum 10 is directly exposed to the sealed space. The system 100 including the vial coupling member 102 may prevent an ingress of fluid and contaminants from the ambient environment 50 into the sealed space and into the interior space 15 of the vial 5. The system 100 including the vial coupling member 102 may prevent an egress of fluid 45 from the vial 5 and the sealed space and into the ambient environment 50. Once the vial coupling member 102 receives the vial 10 and the sealed space is formed, the vial coupling member 102 may be fixedly secured over at least a portion of the vial 5. Further, once the vial coupling member 102 receives the vial 10 and the sealed space is formed, the vial coupling member 102 may provide fluid communication between the interior space 15 of the vial 5 and one or more fluid pathways, for example, through the vial septum 10.

Once the vial coupling member 102 provides fluid communication between the interior space 15 of the vial 5 and the fluid pathways, the fluid 45 may be communicated from the interior space 15 of the vial 5 and into the fluid pathways. For example, the vial 5 coupled to the system 100 may be turned up-side-down so that gravity may force or pull the fluid 45 into the fluid pathways. As another example, a fluid transfer member 104 may include a pump configured to mechanically move the fluid 45 through the fluid pathways. In at least some embodiments, the pump is a peristaltic pump. Once the fluid 45 is communicated from the interior space 15 of the vial 5 and into the fluid pathways, the fluid 45 communicates through the fluid pathways extending through the fluid transfer member 104 and to the fluid retaining member 106.

As the fluid 45 communicates through the fluid pathways, the fluid 45 is also prevented from communicating back through the one or more fluid pathways in the direction of the vial coupling member 102. For example, at least one fluid pathway of the fluid retaining member 106 may include one or more one-way valves configured to prevent the fluid 45 from communicating through the fluid pathways towards to the vial 5 or vial coupling member 102 while permitting the fluid 45 from communicating through the fluid pathways towards one or more cavities of the fluid retaining member 106. In another example, when the system 100 includes at least a peristaltic pump, the peristaltic pump may also prevent the fluid 45 from communicating through the fluid pathways towards to the vial 5 or the vial coupling member 102 while permitting the fluid 45 from communicating through the fluid pathways towards the cavities of the fluid retaining member 106. The peristaltic pump may compress at least one fluid pathway of the fluid pathways as the peristaltic pump facilitates fluid communication through the at least one fluid pathway of the fluid pathways from the vial coupling member 102 to the fluid retaining member 106 preventing back-flow through the one fluid pathways from the fluid retaining member 106 to the vial coupling member 102.

Once the fluid retaining member 106 receives the fluid 45 from the fluid pathways, at least one cavity of one or more cavities each formed by individual containers of the fluid training member 106 may store the fluid 45. In at least some embodiments, at least one cavity may be a constant volume cavity. The constant volume cavity may be a variable pressure cavity. Constant volume cavities may be formed by containers including at least one of a hard-shell or a semi-rigid shell, for example. In at least some embodiments, at least one cavity may be a variable volume cavity. The variable volume cavity may be constant pressure cavity. Variable volume cavities may be formed by a collapsible fluid impermeable bag, a bellows, or a container having a solid ceiling and floor and having collapsible walls, for example. Each of the one or more cavities may be formed by a container having a material configured to be penetrated by a needle or a spike.

In some embodiments, a cavity of the fluid retaining member 106 may contain a gas, such as a sterile gas. The cavity of the fluid retaining member 106 may contain the gas before the system 100 is coupled to the vial 5 so that when the fluid 45 enters the cavity of the fluid retaining member 106 the gas within the cavity of the fluid retaining member 106 is in direct contact with the fluid 45. The fluid pathways of the system 100 may include a first fluid pathway and a second fluid pathway. The second fluid pathway may include one or more air-liquid separators configured to permit gas to flow through the second fluid pathway while simultaneously preventing liquid from flowing through the second fluid pathway. As the fluid 45 is communicated from the vial 5 and into the cavity of the fluid retaining member 106 through the first fluid pathway, the gas in the cavity of the fluid retaining member 106 may be communicated through the second fluid pathway from the cavity of the fluid retaining member 106 and into the vial 5. The gas from the cavity of the fluid retaining member 106 that is received by the vial 5 allows the vial 5 to maintain pressurization as the fluid 45 is extracted from the vial 5 and received by the cavity of the fluid retaining member 106.

In some embodiments, when the system 100 includes a peristaltic pump, the peristaltic pumps may facilitate fluid communication of the gas from the cavity of the fluid retaining member 106 into the interior space 15 of the vial 5 while also facilitating fluid communication of the fluid 45 from the interior space 15 of the vial 5 into the cavity of the fluid retaining member 106. In some embodiments, the peristaltic pump, when in a state of non-operation, may be configured to compress or block at least one of the first fluid pathway or the second fluid pathway so that the gas in the cavity of the fluid retaining member 106 is prevented from reaching the vial coupling member 102. In some embodiments, one or more collets 120 accessible to a user through the housing 101 (such as the fluid retaining member housing 107) may each be configured to compress or block at least one of the first fluid pathway or the second fluid pathway so that the gas in the cavity of the fluid retaining member 106 is prevented from leaving the cavity or so that the gas in the cavity of the fluid retaining member 106 is prevented from reaching the vial coupling member 102.

It should be understood that the system 100 coupled to the vial 5 forms a closed system to extract a fraction of the total amount of fluid 45 from the interior space 15 of the vial 5 and to store the fraction of the total amount of fluid 45 from the interior space 15 of the vial 5 in one or more cavities of the fluid retaining member 106 of the system 100. In some embodiments, the fraction of the total amount of fluid 45 stored in the cavity of the fluid retaining member 106 may be stored for later use. In at least some embodiments, after the fraction of the total amount of fluid 45 is stored in the cavity of the fluid retaining member 106 for later use, the system 100 may be decoupled from the vial 5 and the remaining amount of fluid 45 in the interior space 15 of the vial 5 may be extracted using a needle and syringe or a CSTD. Subsequently, after a period of time, the fraction of the total amount of fluid 45 stored in the cavity of the fluid retaining member 106 may extracted from the cavity of the fluid retaining member through a fluid access member 118 using a needle and syringe or a CSTD. In at least some embodiments, after the fraction of the total amount of fluid 45 is stored in the cavity of the fluid retaining member 106 for later use, the system 100 may transfer the remaining amount of fluid 45 from the interior space 15 of the vial 5 to another cavity of the fluid retaining member 106. Subsequently, after a period of time, the fraction of the total amount of fluid 45 stored in the cavity of the fluid retaining member 106 and the remaining amount of fluid 45 stored in the other cavity of the fluid retaining member 106 may be extracted through fluid access members 118 using a needle and syringe or a CSTD.

In some embodiments, the fluid retaining member 106 may be configured to disengage or detach from the system 100, for example, at the second disengaging section 110. For example, after at least the fraction of the total amount of fluid 45 is extracted from the interior space 15 of the vial 5 and stored in the cavity of the fluid retaining member 106, the fluid retaining member 106 may be configured to disengage or detach from the system 100 such as from the fluid transfer member 104 at the second disengaging section 110. The second disengaging section 110 may include one or more disconnecting devices. For example, each of the fluid pathways may include at least one disconnecting device.

When the fluid retaining member 106 is attached to the system 100, the second disengaging section 110 may couple the fluid retaining member 106 to the fluid transfer member 104 so that fluid communication is permitted between each of the one or more fluid pathways of the fluid transfer member 104 and each of the one or more fluid pathways of the fluid retaining member 140 through each of the disconnecting devices at the second disengaging section 110. As the fluid retaining member 106 disengages or detaches from the system 100, such as from the fluid transfer member 104, at the second disengaging section 110, each of the disconnecting devices may separate into two disconnecting device components, such as a first disconnecting device component and a second disconnecting device component. Each of the first disconnecting device component and the second disconnecting device component may be configured to prevent exposure of the fluid 45 in the fluid pathway to the ambient environment 50 after the first disconnecting device component begins to disengage or detach from the second disconnecting device component as well as prevent exposure of fluids and contaminants in the ambient environment 50 to the fluid 45 in the fluid pathway after the first disconnecting device component begins to disengage or detach from the second disconnecting device component.

For example, the first disconnecting device component may remain coupled to a fluid pathway of the fluid transfer member 104 and the second disconnecting device component may remain coupled to a fluid pathway of the fluid retaining member 106. The first disconnecting device component may be configured to prevent fluid communication between the fluid pathway of the fluid transfer member 104 and the ambient environment 50 as well as between the fluid pathway of the fluid transfer member 104 and the fluid pathway of the fluid retaining member 106. As the fluid retaining member 106 begins to disengage or detach from the system 100, such as from the fluid transfer member 104, at the second disengaging section 110, the first disconnecting device component may seal the fluid pathway of the fluid transfer member 104 from the ambient environment 50 and from the fluid pathway of the fluid retaining member 106. The first disconnecting device component may seal the fluid pathway of the fluid transfer member 104 from the ambient environment 50 and the fluid pathway of the fluid retaining member 106 before the first disconnecting device component completely separates from the second disconnecting device component.

Similarly, the second disconnecting device component may be configured to prevent fluid communication between the fluid pathway of the fluid retaining member 106 and the ambient environment 50 as well as between the fluid pathway of the fluid retaining member 106 and the fluid pathway of the fluid transfer member 104. As the fluid retaining member 106 begins to disengage or detach from the system 100, such as from the fluid transfer member 104, at the second disengaging section 110, the second disconnecting device component may seal the fluid pathway of the fluid retaining member 106 from the ambient environment 50 and from the fluid pathway of the fluid transfer member 104. The second disconnecting device component may seal the fluid pathway of the fluid retaining member 106 from the ambient environment 50 and the fluid pathway of the fluid transfer member 104 before the second disconnecting device component completely separates from the first disconnecting device component. In some embodiments, as discussed herein, each of the first disconnecting device component and the second disconnecting device component may be configured to pull fluid 45 away from a separation plane of the second disengaging section 110 and seal the fluid 45 within the fluid pathway after the first disconnecting device component begins to separate from the second disconnecting device component and before the first disconnecting device component completely separates from the second disconnecting device component to prevent exposure of the fluid 45 to the ambient environment 50.

The fluid retaining member 106 disengaged or separated from the system 100 may allow a needle and syringe or a CSTD to extract uncontaminated fluid 45 retained or stored within the chamber of the fluid retaining member 106 through the at least one fluid access member 118 without introducing contaminates or microbes into the fluid pathways of the fluid transfer member 104, the fluid pathways of the vial coupling member 102, or the interior space 15 of the vial 5. The remaining system 100 (such as the system 100 excluding the fluid retaining member 106) may remain coupled to the vial 5 forming a closed environment (such as sealed from the ambient environment 50) so that the vial 5 coupled to the remaining system 100 may be stored for the period of time for subsequent fluid extraction of the remaining fluid 45 from the interior space 15 of the vial 5. It should be understood, that when the fluid retaining member 106 is used to store a fraction of the total amount of fluid 45 from the interior space 15 of the vial 5 for the period of the time before the fraction of the total amount of fluid 45 is extracted from the chamber of the fluid retaining member 106, the fluid retaining member 106 may include a size and shape for convenient for storage in a pharmacy. The size may include a size similar to a vial or packaging using to store a vial. The shape may include a shape similar to a vial or packaging used to store a vial. The shape may be cylindrical or cuboid.

As discussed herein, after the fluid retaining member 106 is disengaged or separated from the system 100, the system 100 at the vial coupling member 102 may be configured to be decoupled from the vial 5 after the period of time so that the remaining fluid 45 in the interior space 15 of the vial 5 may be extracted through the vial septum 10 using a needle and syringe or a CSTD. In some embodiments, after the fluid retaining member 106 disengages or separates from the system 100, the fluid 45 retained or stored for the period of time in the chamber of the fluid retaining member 106 may be subsequently extracted. Thus, the vial coupling member 102 may be decoupled from the vial 5 after the fluid retaining member 106 disengages or separates from the system 100 and before the period of time expires to extract the remaining fluid 45 from the interior space 15 of the vial 5 while the fluid retaining member 106 is stored for the period of time before extraction of the fraction of the total amount of fluid 45 from within the chamber of the fluid retaining member 106. Accordingly, at least one of the fluid retaining member 106 or the remaining system 100 coupled to the vial 5 may be stored for the period of time before the fluid 45 is extracted from at least one of the fluid retaining member 106 or the vial 5. Also, the fluid 45 may be extracted before the period of time from at least one of the cavity of the fluid retaining member 106 or the interior space 15 of the vial 5.

In some embodiments, the second disengaging section 110 may be configured to prevent re-engagement of the fluid retaining member 106 with the system 100, such as with the fluid transfer member 104, after the fluid retaining member 106 disengages or detaches from the system 100, such as from the fluid transfer member 104. For example, as discussed herein, at least one of the first disconnecting device component or the second disconnecting device component may be configured to prevent re-engagement or reconnection with the other. Thus, after the first disconnecting device component disengages or separates from the second disconnecting device component, fluid communication between the fluid pathways of the fluid transfer member 104 may be unable to be reestablished with the fluid pathways of the fluid retaining member 106. This feature prevents the system 100 from being used more than once mitigating the risk of contaminating the fluid 45 with multiple uses using the same system 100.

In some embodiments, the vial coupling member 102 may be configured to disengage or detach from the system 100, for example, at the first disengaging section 108. The first disengaging section 108 may include the same or similar features as the second disengaging section 110 and may be configured to operate in a same or similar manner as the second disengaging section 110. The vial coupling member 102 may disengage or detach from the system 100, for example, when the vial coupling member 102 is coupled to the vial 5 so that the vial 5 may be stored for the period of time before the fluid 45 is extracted from the interior space 15 of the vial 5. The feature allows for the vial coupling member 102 coupled to the vial 5 to occupy less storage space in a pharmacy, for example, than a vial coupling member 102 coupled to both a vial 5 and the vial transfer member 104.

Figure 2:
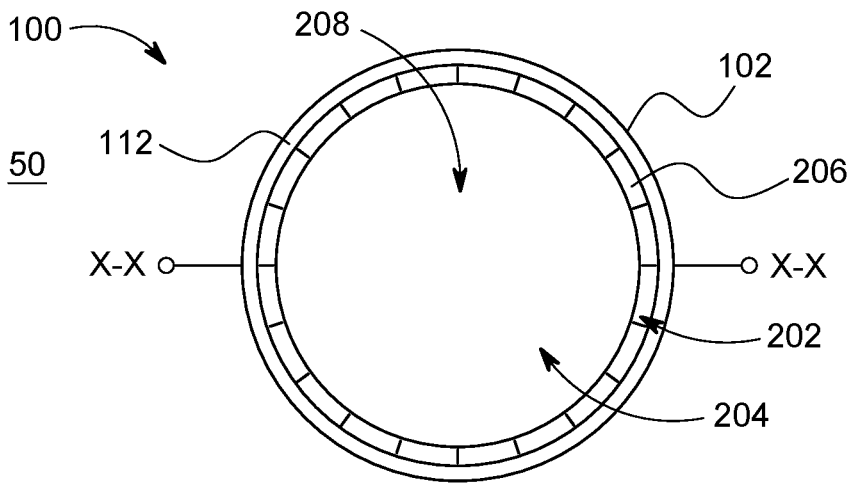
FIG. 2 illustrates an example system from the prospective across the X-X marks illustrated in FIG. 1 according to this disclosure.

FIG. 2 illustrates an example system 100 from the prospective across the X-X marks illustrated in FIG. 1 according to this disclosure. One or more of the components described herein with respect to FIG. 2 may be used with any other embodiments described herein including the embodiments described with respect to FIGS. 1 and 3-21 provided herein. As shown in FIG. 2, the system 100 includes various components to extend the useful life of remaining medicine in a vial after the same vial is punctured and a portion of medicine is extracted from the same vial. For instance, FIG. 2 illustrates the vial coupling member 102 of the system 100 from the prospective across the X-X marks illustrated in FIG. 1. The vial coupling member 102 may include an opening 202 positioned at a distal end of a wall 206 providing access to a cavity 204. In some embodiments, the wall 206 may be the vial coupling member housing 103. In some embodiments, the wall 206 may be within the vial coupling member housing 103. The cavity 204 may be formed by the wall 206 and a flexible membrane 208. The flexible membrane 208 may be positioned at a proximal location along the wall 206 opposite from the opening 202 at the distal end. The flexible membrane 208 may be coupled to the interior surface of the wall 206 so the fluid communication and contaminant communication are prevented from passing between the interior surface of the wall 206 and the flexible membrane 208. Thus, the flexible membrane 208 may form a seal with and around the interior surface of the wall 206. The vial coupling member 102 may also include the vial coupling member lip 112, as discussed herein. As shown in FIG. 2, the vial coupling member lip 112 is positioned around or over the distal end of the wall 206 at the opening 202.

The flexible membrane 208 may be able to stretch when in engaging contact with a vial 5 (such as a top 35 of a vial 5) and form a flexible membrane layer around and/or over at least a portion of the vial 5 (such as a top 35 of the vial 5). In some embodiments, the flexible membrane 208 may include at least one of an impermeable material, an elastomeric material, or a rubber-like material. The flexible membrane 208 may include at least one of natural rubber, natural rubber latex, nitrile rubber, butyl rubber, acrylonitrile-butadiene rubber, styrene butadiene rubber, chloroprene rubber, silicone, polyvinyl chloride, neoprene, biomedical grade elastomers (such as Silastic® MDX4-4210 from Dow®), polyisoprene, polybutadiene, ethylene propylene rubber, ethylene propylene diene monomer, chlorosulfonated polyethylene, polysulfide rubber, polyurethane, EVA film, copolyester, or the like. One of ordinary skill in the art would be able to select an appropriate material to be used as a flexible membrane as described herein. The flexible membrane 208 may include an antimicrobial material or coating. Antimicrobial materials and coatings may include parylene coatings (such as SCS Microresist™ from Specialty Coating Systems™), silver ions, copper ions, or the like. One of ordinary skill in the art would be able to select an appropriate material to be used as an antimicrobial material or coating with a flexible membrane as described herein.

The flexible membrane 208 may include a flowable material. For example, when the flexible membrane 208 is exposed to a fluid (such as air from the ambient environment 50, fluid 45 within the vial 5, or fluid used for drug reconstitution) or comes into contact with a fluid, a flexible membrane 208 that includes a flowable material may at least partially become flowable to fill one or more gaps between the vial 5 and a vial sealing member (discussed herein) and/or to fill one or more gaps between the flexible membrane 208, and walls 206 in conjunction with an end wall forming a cavity (as discussed herein). Flowable materials may include water-sensitive polymers. Water-sensitive polymers may include at least one of polyvinylpyrrolidone, polyvinyle alcohol, polyacrylates, alginates, carboxymethyl cellulose, or the like. The flowable material may be a coating on a surface of the flexible membrane 208 and/or may integrated with the flexible membrane 208. A flexible membrane 208 that includes a flowable material may better ensure sealing around the vial 5 during fluid extraction from the vial 5.

The flexible membrane 208 may also include an adhesive layer. For example, the flexible membrane 208 may comprise an adhesive layer positioned on a surface of the flexible membrane 208 facing or exposed to the cavity 204. Thus, when the vial 5 engages the flexible membrane 208, the adhesive layer may secure a surface of the vial 5 to the flexible membrane 208. It should also be understood that while a single flexible membrane 208 is illustrated in FIGS. 1 and 2, the system 100 may include a plurality of flexible membranes 208 positioned adjacent and/or in a stacked configuration with each other. A plurality of flexible membranes 208 may ensure sealing around the vial 5 during fluid extraction of fluid 45 from the vial 5.

The opening 202 may be configured (such as sized and shaped) to permit at least a portion of the vial 5 to pass through the opening 202 so that the cavity 204 may receive at least the portion of the vial 5 including the vial septum 10. The cavity 204 may include a depth so that at least the portion of the vial 5 may pass through the opening 202 and into the cavity 204 until the vial coupling member lip 112 engages with an exterior surface of the vial 5 forming a sealed space between the wall 206 and an exterior surface of the vial 5 around at least the portion of the vial 5 including the vial septum 10. The sealed space may seal the vial septum 10 from the ambient environment 50. The cavity 204 may also include a depth so that as at least the portion of the vial 10 moves through the opening 202 and the cavity 204 toward the flexible membrane 208, the vial septum 10 engages the flexible membrane 10 no later than when the vial coupling member lip 112 engages the exterior surface of the vial 5. In some embodiments, after the vial septum 10 engages the flexible membrane 208, the vial 5 may continue to advance into the cavity 204 causing the flexible membrane 208 to flex in a direction away from the opening 202 until the vial coupling member lip 112 engages with an exterior surface of the vial 5 forming a sealed space between the wall 206 (and the vial coupling member lip 112) and an exterior surface of the vial 5 around at least the portion of the vial 5 including the vial septum 10. It should be understood that PHARMACOPIA 797 recommends routine disinfection of critical sites of the vial (e.g. vial septa) with sterile 70% isopropyl alcohol. Thus, the top of the vial 5 including the vial septum 10 will be sterile when the vial septum 10 engages the flexible membrane 208.

Figure 3:
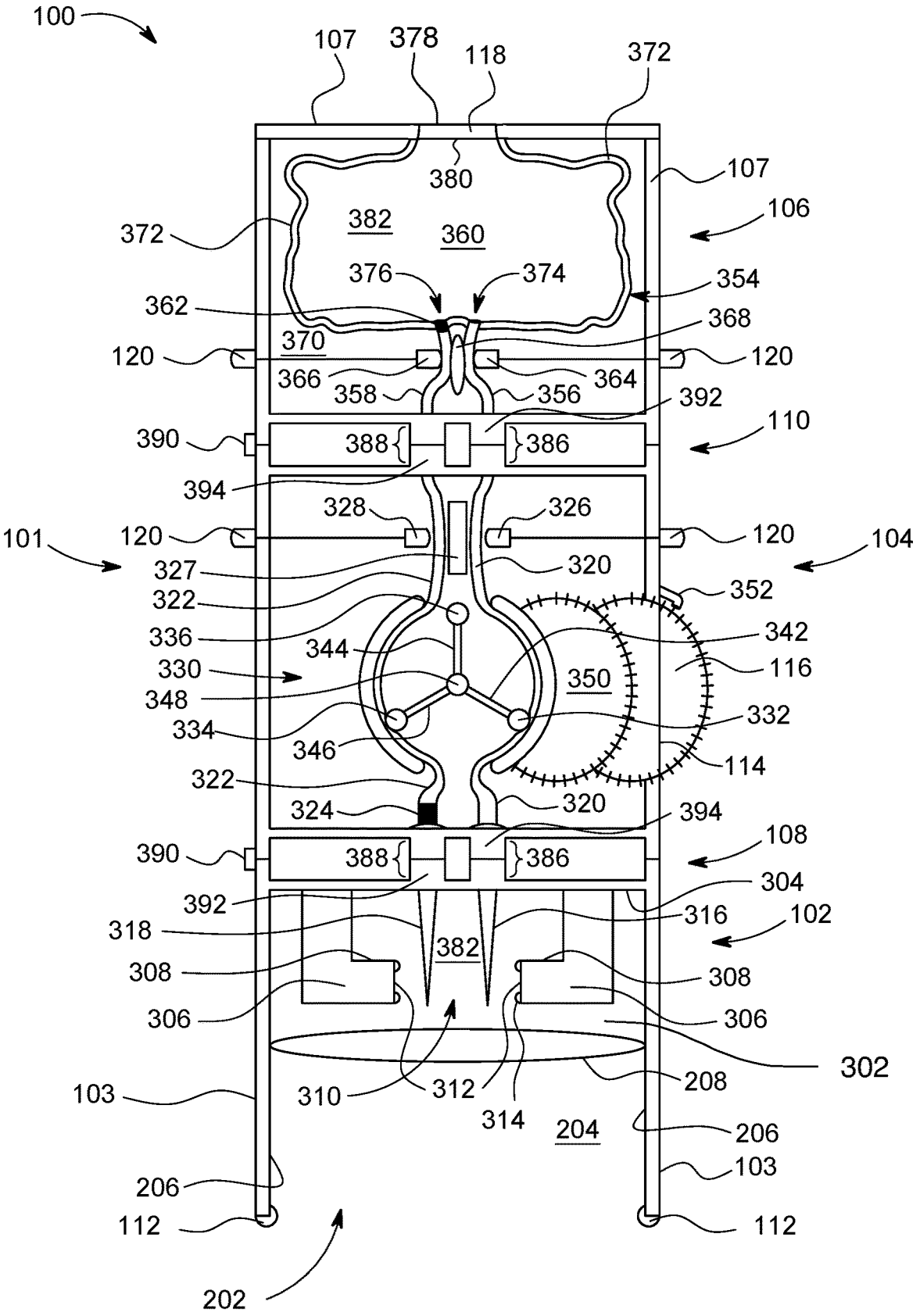
FIG. 3 illustrates an example cross-section of the system illustrated in FIGS. 1 and 2 according to this disclosure.

FIG. 3 illustrates an example cross-section of the system 100 illustrated in FIGS. 1 and 2 according to this disclosure. One or more of the components described herein with respect to FIG. 3 may be used with any other embodiments described herein including the embodiments described with respect to FIGS. 1, 2, and 4-21 provided herein. As shown in FIG. 3, the system 100 may include a vial coupling member 102, a fluid transfer member 104, and a fluid retaining member 106. As discussed herein, the vial coupling member 102 may include a wall 206, a flexible membrane 208, and a cavity 204 formed by the wall 206 and the flexible membrane 208. An opening 202 positioned at a distal end of a wall 206 may provide access from the ambient environment 50 to the cavity 204. The flexible membrane 208 may be positioned at a proximal location along the wall 206 opposite from the opening 202 at the distal end. The flexible membrane 208 may be coupled to the interior surface of the wall 206 so the fluid communication and contaminant communication are prevented from passing between the interior surface of the wall 206 and the flexible membrane 208. Thus, the flexible membrane 208 may form a seal with and around the interior surface of the wall 206. The vial coupling member 102 may also include the vial coupling member lip 112, as discussed herein. As shown in FIG. 2, the vial coupling member lip 112 is positioned around or over the distal end of the wall 206 at the opening 202.

Figure 4:
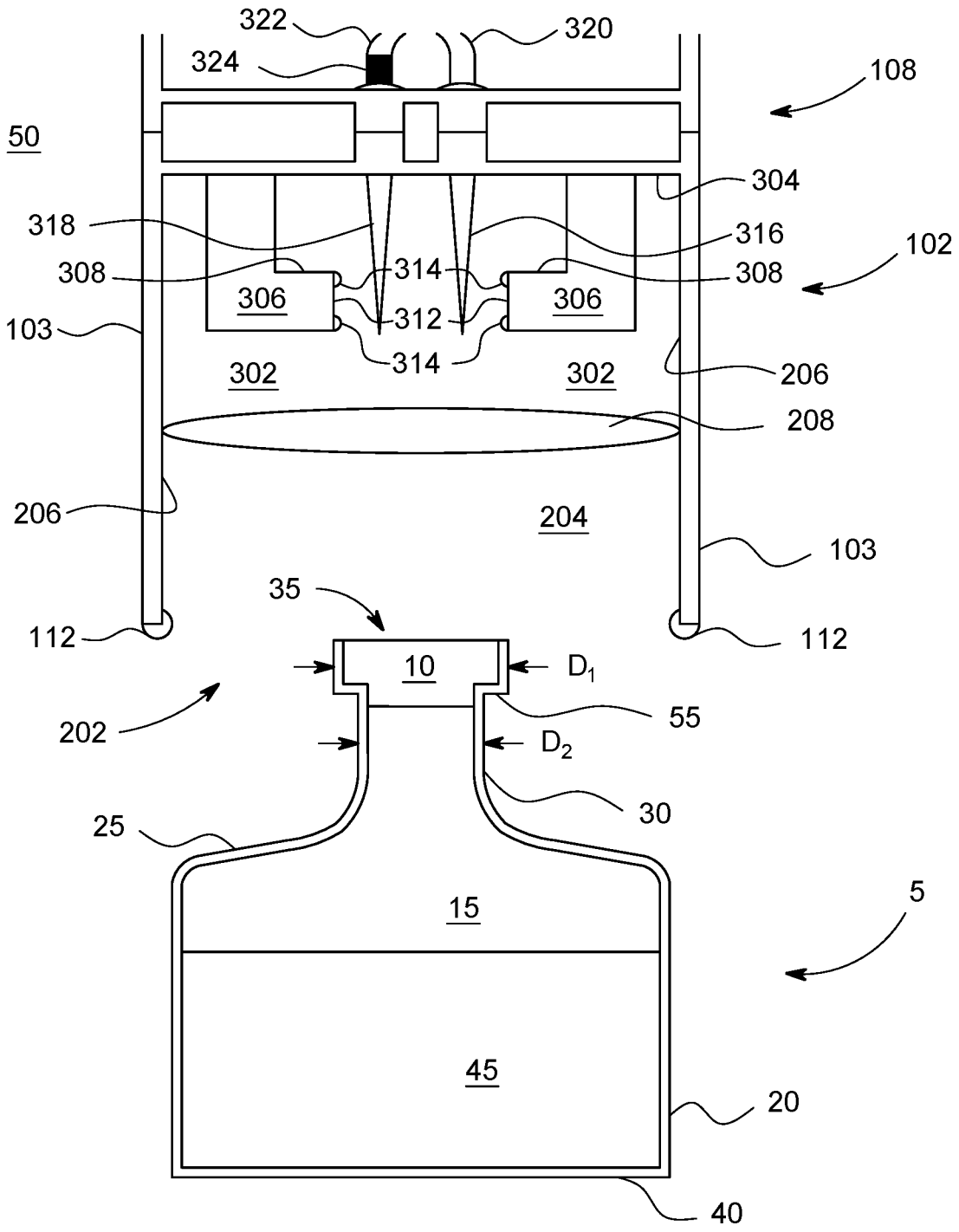
FIG. 4 illustrates an example cross-section of the vial coupling member of the system 100 according to this disclose.
Figure 5:
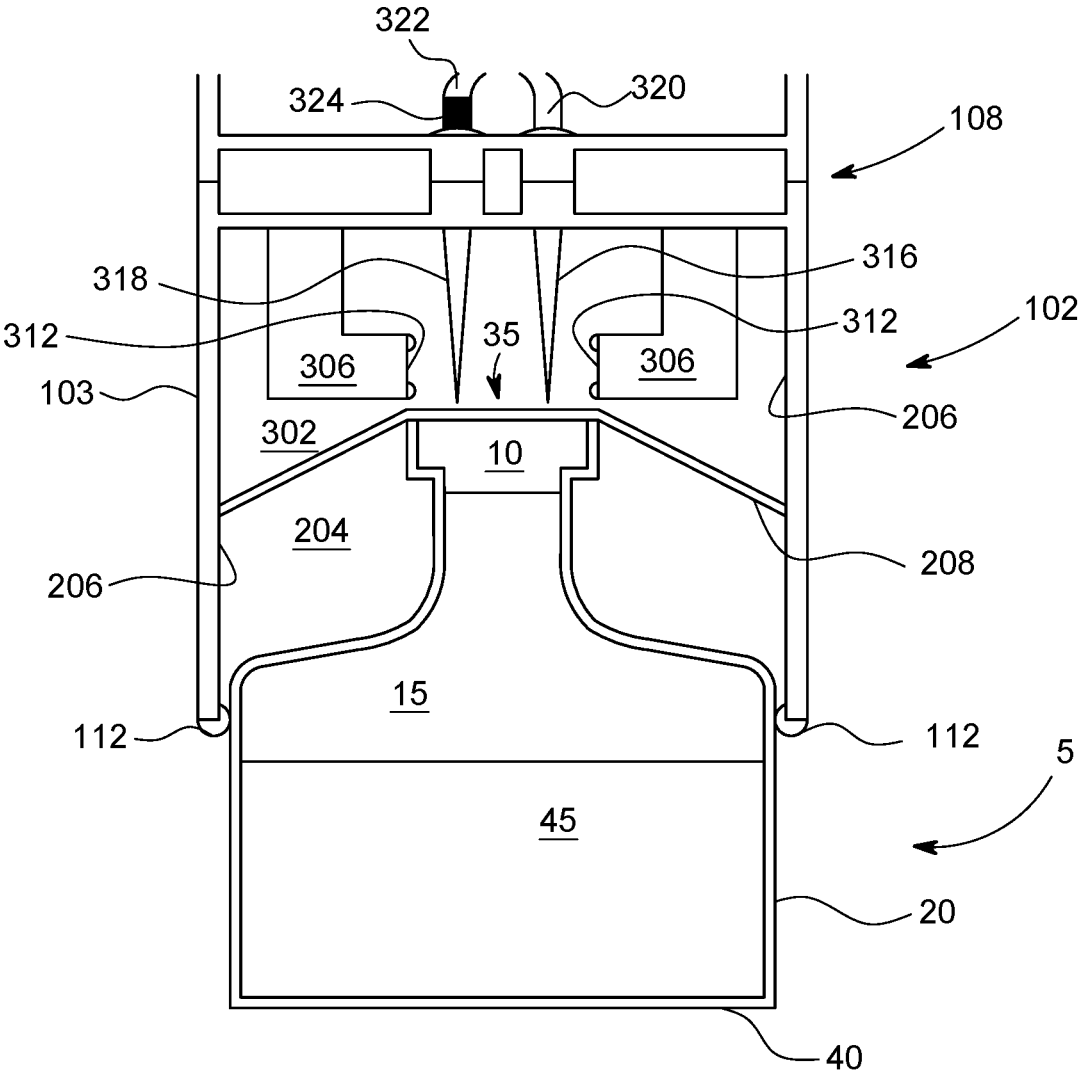
FIG. 5 illustrates another example cross-section of the vial coupling member of the system according to this disclosure.

FIG. 4 illustrates an example cross-section of the vial coupling member 102 of the system 100 according to this disclose. One or more of the components described herein with respect to FIG. 4 may be used with any other embodiments described herein including the embodiments described with respect to FIGS. 1-3 and 5-21 provided herein. As shown in FIG. 4, the vial 5 may be positioned at the distal end of the vial coupling member 102 so that at least a portion of the vial 5 extends from the ambient environment 50, through the opening 202, and into the cavity 204. FIG. 5 illustrates another example cross-section of the vial coupling member 102 of the system 100 according to this disclosure. One or more of the components described herein with respect to FIG. 5 may be used with any other embodiments described herein including the embodiments described with respect to FIGS. 1-4 and 6-21 provided herein. As shown in FIG. 5, at least a portion of the vial 5 may be positioned in the cavity 204 so that the top 35 of the vial 5 may engage the flexible membrane 208 and force the flexible membrane 208 away from the opening 202. The flexible membrane 208 may fittingly form over at least a portion of the vial 5 (such as the top 35 of the vial 5). The flexible membrane 208 may maintain a sealed coupling with the walls 206 as the vial 5 forces the flexible membrane 208 away from the opening 202. In addition, as shown in FIG. 5, the vial coupling member lip 112 may engage the vial 5 sealing the cavity 204 from the ambient environment 50. The vial coupling member lip 112 may engage the vial 5 sealing the cavity 204 from the ambient environment 50 before at least one of the flexible membrane 208 formed over at least a portion of the vial 5 engages with one or more needles or spikes (discussed herein), the flexible membrane 208 formed over at least a portion of the vial 5 engages a vial sealing member (as discussed herein), the flexible membrane 208 formed over at least a portion of the vial 5 begins to enter an aperture formed by the vial sealing member (as discussed herein), or at least a portion of the vial 5 engages the flexible membrane 208. The relative sizes and shapes of the vial 5 and components of the vial coupling member 102 may determine or influence when the vial coupling member lip 112 engages the vial 5 sealing the cavity 204 from the ambient environment 50 relative to when the flexible membrane 208 formed over at least a portion of the vial 5 engages with one or more needles or spikes (as discussed herein), the flexible membrane 208 formed over at least a portion of the vial 5 engages a vial sealing member (as discussed herein), the flexible membrane 208 formed over at least a portion of the vial 5 begins to enter an aperture formed by the vial sealing member (as discussed herein), or at least a portion of the vial 5 engages the flexible membrane 208.

Turning back to FIG. 3, the flexible membrane 208 and the walls 206 in conjunction with an end wall 304 may also form a cavity 302. The flexible member 208 and the walls 206 in conjunction with the end wall 304 forming the cavity 302 may prevent contaminants in the ambient environment 50 from making contact with the cavity 302. For example, the flexible membrane 208 and the walls 206 in conjunction with the end wall 304 forming the cavity 302 may prevent contaminants in the ambient environment 50 from making contact with at least one of a vial sealing member (discussed herein), one or more vial penetrators (discussed herein), or one or more fluid pathways (discussed herein). The cavity 302 may be exposed to an opposite surface of the flexible membrane 208 from the cavity 204. In some embodiments, the cavity 302 may be a sterile cavity. For example, the cavity 302 may be free or substantially free from contaminants and/or microbes and/or sealed from the ambient environment 50.

The cavity 302 may contain a vial sealing member 306. The vial sealing member 306 may be sized and shaped to receive a vial 5, securely retain the vial 5 in a static position within the vial coupling member 102, and form a sealed space over and/or around at least a portion of the vial 5 (such as around the top 35 or a neck of the vial 5). For example, the vial sealing member 306 may form an aperture 310 sized and shaped to tightly receive and/or sealingly receive a vial 5. The vial sealing member 306 may include a material that allows the vial sealing member 306 to elastically deform. When the aperture 310 begins to receive the vial 5, the vial 5 and the flexible membrane 208 formed over the vial 5 may engage the vial sealing member 306 and elastically deform the vial sealing member 306 in at least one of a radial direction or an axial direction. For example, the wall 312 of the vial sealing member 306 may sealingly engage the flexible membrane 208 formed over the vial 5 and the vial sealing member 306 may flex in a direction along an axis (such as a center axis) of the vial coupling member 102, around an axis (such as a center axis) of the vial coupling member 102, and/or in a radial direction away from an axis (such as a center axis) of the vial coupling member 102. The vial sealing member 306 may retain the vial 5 in a static position in the vial coupling member 102. The flexible membrane 208 pressed between the wall 312 and a surface of the vial 5 may form a sealed space (discussed herein) over the top 35 of the vial 5. In at least some embodiments, the wall 312 may comprise one or more protrusions 314. The protrusions 314 may extend from the wall 312 into the aperture 310. The protrusions 314 may include a rigid material that maintains form when receiving a force exerted by the vial 5 as the vial 5 moves through the aperture 310. When the wall 312 of the vial sealing member 306 sealingly engages the flexible membrane 208 formed over the vial 5 and retains the vial 5 in a static position in the vial coupling member 102, the one or more protrusions 314 may further press or extend into the flexible membrane 208 providing sealing (such as additional sealing) between the vial sealing member 306 and the flexible membrane 208 and/or the vial 5. In some embodiments, for example, when the vial coupling member 102 does not include the flexible membrane 208, the protrusions 314 may include a flexible rubber-like material that sealingly engages with an outer surface of the vial 5 to form a sealed space over the vial 5. In at least this case, the protrusions 314 may comprise a lubricant on a surface of the protrusions 314 so that the vial 5 may easily move through the aperture 310 and snap or securely engage into a static position resting on a seat 308 of the vial sealing member 306. In addition, lubricant on the protrusions 314 may facilitate removal of the vial 5 from the static position maintained by the vial sealing member 306.

It should also be understood that as the vial 5 engages the flexible membrane 208, travels into the aperture 310, and is sealingly retained by the vial sealing member 306, the flexible membrane 208 may be stretched and/or expanded while maintaining the seal between the walls 206 and the flexible membrane 208. Maintaining the seal between the walls 206 and the flexible membrane 208 may allow the cavity 302 to remain sterile and prevent the fluid 45 that enters the cavity 302 from the vial 5 from seeping into the cavity 204 and/or into the ambient environment 50. In some embodiment, the flexible membrane 208 may include a lubricant on the surface of the flexible membrane 208 exposed to the cavity 302. Similar to the lubricant described with respect to the protrusions 314, the lubricant on the surface of the flexible membrane 208 may allow the vial 5 to move through the aperture 210 and snap or securely engage into a static position resting on the seat 308 of the vial sealing member 306. In addition, lubricant on the flexible membrane 208 may facilitate removal of the vial 5 from the static position maintained by the vial sealing member 306.

In some embodiments, the vial sealing member 306 may form the seat 308 in addition to or as an alternative to the wall 312. The seat 308 may configured to receive a surface of the vial 5 (such as a flange 55) so that the vial 5 rests on the seat 308 retaining the vial 5 in a static position within the vial coupling member 102. For example, when the aperture 310 receives the vial 5, a flange 55 of the vial 5 and the flexible membrane 208 formed over the flange of the vial 5 may engage and rest on the seat 308. Similar to the wall 312, the engagement between the seat 308 and the flange 55 of the vial 5 with the flexible membrane 208 formed over the flange of the vial 5 may also provide a seal forming a sealed space over and/or around at least a portion of the vial 5 (such as around the top 35 or a neck of the vial 5). As shown in FIG. 3, the vial sealing member 306 may include both the wall 312 and the seat 308. In at least some embodiments, the vial sealing member 306 may include only the wall 312 excluding the seat 308. In at least some embodiments, the vial sealing member 306 may include only the seat 308 excluding the wall 312. In at least some embodiments, at least one of the seat 308 or the wall 312 may include a slope.

As shown in FIG. 3, the vial coupling member 102 may also include one or more vial penetrators, such as a first vial penetrator 316 and a second vial penetrator 318. Each of the vial penetrators may include at least one sharp edge or point configured to pierce a vial septum 10. Each of the vial penetrators may also include at least one lumen and an opening positioned at least near the sharp edge or point to provide fluid communication into the lumen. Each of the lumens may be fluidly coupled to one or more fluid pathways (discussed herein). In at least some embodiments, the vial penetrators may include a needle. In at least some embodiments, the vial coupling member 102 may include a single spike with at least two lumens each having an opening providing fluid communication into respective lumens. In at least some embodiments, each of the vial penetrators may include a length spanning from the end wall 304 to a plane within the cavity 302 just short of the flexible membrane 208 before the flexible membrane 208 is forced away from the opening 202 by the vial 5. In at least some embodiments, each of the vial penetrators may include a length spanning from the end wall 304 to the aperture 310. In at least some embodiments, each of the vial penetrators may include a length spanning from the end wall 304 to any plane within the cavity 302 between the aperture 310 and the plane just short of the flexible membrane 208 before the flexible membrane 208 is forced away from the opening 202 by the vial 5. A length of each of the vial penetrators may allow each of the vial penetrators to penetrate through a vial septum 10 and to provide fluid communication between the interior space 15 of the vial 5 and each of the lumens through the openings of each of the vial penetrating member when the wall 312 of the vial sealing member 306 and/or the seat 308 of the vial sealing member 306 sealingly engages the flexible membrane 208 formed over the vial 5 and retains the vial 5 in a static position in the vial coupling member 102.

Figure 6:
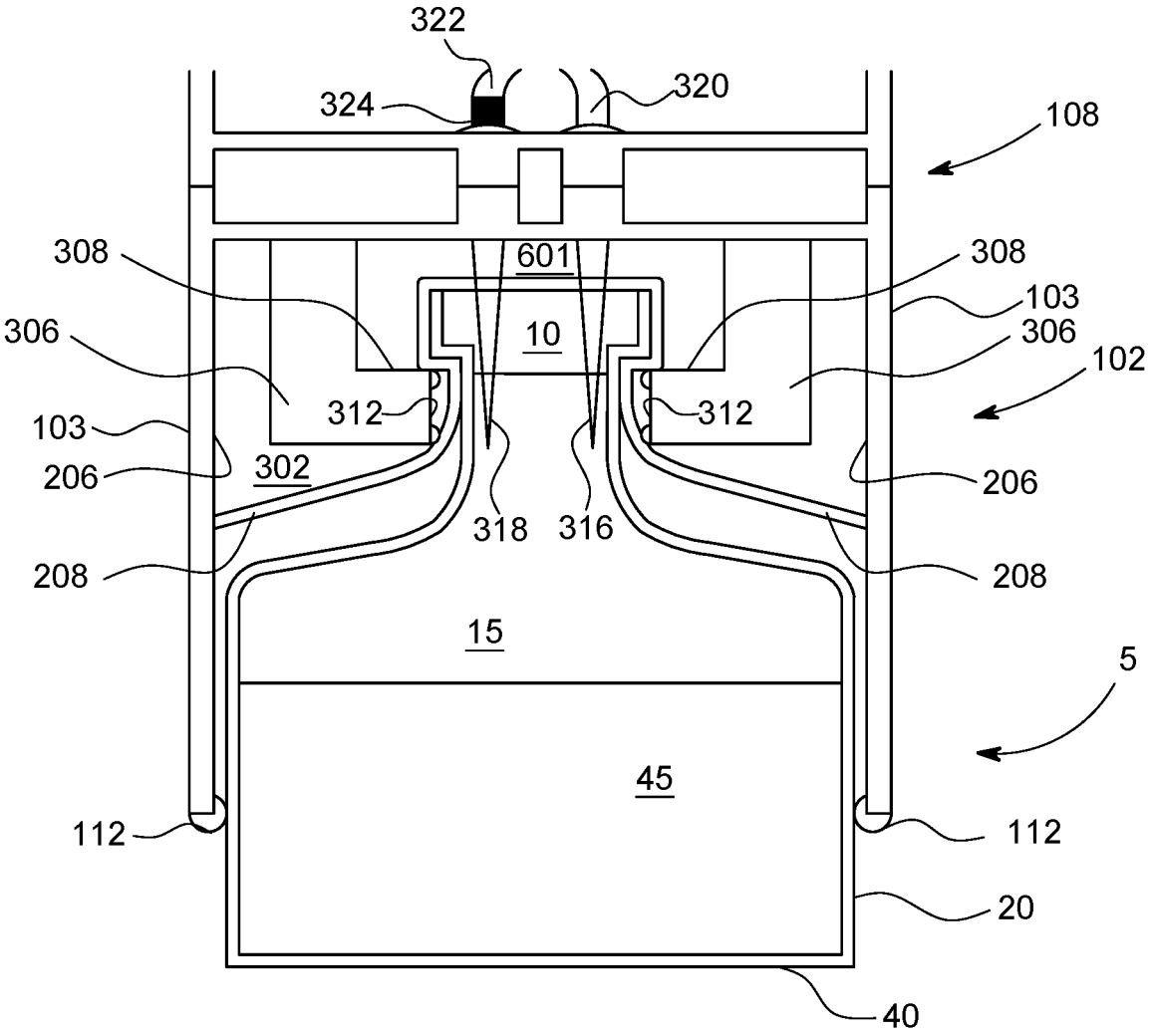
FIG. 6 illustrates an example cross-section of the vial coupling member including a vial sealingly coupled and securely retained therein.

FIG. 6 illustrates an example cross-section of the vial coupling member 102 including a vial sealingly coupled and securely retained therein. One or more of the components described herein with respect to FIG. 6 may be used with any other embodiments described herein including the embodiments described with respect to FIGS. 1-5 and 7-21 provided herein. As shown in FIG. 6, the vial sealing member 306 may sealingly engage the flexible membrane 208 formed over the vial 5 and may retain the vial 5 in a static position in the vial coupling member 102 as discussed herein. The top 35 of the vial 5 having a first and larger diameter $D_1$ may pass through the aperture 310 and may elastically deform at least one of the vial sealing member 306, the protrusions 314, or the flexible sealing member 208 formed over the top 35 of the vial 5. The top 35 of the vial 5 may pass through the aperture 310 until the flange 55 of the vial 5 passes completely through the aperture 310. The flange 55 of the vial 5 produces a second and smaller diameter $D_2$ relative the first diameter $D_1$ on the vial 5 below the flange 55. When the top 35 of the vial passes through the aperture 310 and the flange 55 of the vial 55 passes completely through the aperture 310, at least one of the vial sealing member 306, the protrusions 314, or the flexible membrane 208 may move to at least a partial resting state (such as a less deformed state) from a deformed state. In at least some embodiments, when the top 35 of the vial passes through the aperture 310 and the flange 55 of the vial 55 passes completely through the aperture 310, at least one of the vial sealing member 306, the one or more protrusions 314, or the flexible membrane 208 does not move to a complete resting state from the deformed state so that a sealing force is maintained between vial sealing member 306 and the flexible member 208 and/or the vial 5. An object, such as at least one of the vial sealing member 306, the one or more protrusions 314, or the flexible membrane 208, moving from a deformed state to a partial resting state may mean that the object, in a first state having a first amount of elastic deformation transitions to a second state with less elastic deformation than the first state, but the second state is not a resting state with no elastic deformation.

Continuing with FIG. 6, the vial sealing member 306 may retain the vial 5 in a static position in the vial coupling member 102. The flexible membrane 208 pressed between the wall 312 and a surface of the vial 5 may form a sealed space 601 over at least one of the top 35 of the vial 5, the vial septum 10, or the flexible membrane 208 covering the top 35 of the vial 5. The sealed space 601 may be sealed from at least one of the ambient environment 50 or the cavity 302. Forming the sealed space 601 over at least one of the top 35 of the vial 5, the vial septum 10, or the flexible membrane 208 covering the top 35 of the vial 5 may prevent fluid 45 from the vial 5 making contact with the ambient environment 50 while also preventing contaminants from the ambient environment 50 from making contact with at least one of the top 35 of the vial 5, the vial septum 10, or the flexible membrane 208 covering the top 35 of the vial 5, the interior space 15 of the vial 5, the fluid 45, one or more vial penetrators, or one or more fluid pathways (discussed herein). In some embodiments, due to relative geometric shapes and sizes of one or more components of the vial coupling member 102 and the geometric shapes and sizes of the vial 5, the top 35 of the vial 5 may be statically positioned with the vial sealing member 306 so that the top 35 of the vial 5 occupies an entire volume of the sealed space 601. In other embodiments, due to relative geometric shapes and sizes of one or more components of the vial coupling member 102 and the geometric shapes and sizes of the vial 5, the top 35 of the vial 5 may be statically positioned with the vial sealing member 306 so that the top 35 of the vial 5 occupies less than an entire volume of the sealed space 601.

Turning back to FIG. 3, as discussed herein, the system 100 may also include a fluid transfer member 104. The fluid transfer member 104 may include one or more fluid pathways, such as a first fluid pathway 320 and a second fluid pathway 322. In at least some embodiments, the one or more fluid pathways may be flexible tubing, such as flexible, sterile, medical-grade tubing. Each of the one or more fluid pathways may include a lumen that is in fluid communication with the lumen of at least one of the one or more vial penetrators. For example, as shown in FIG. 3, the lumen of the first fluid pathway 320 may be in fluid communication with the lumen of the first vial penetrator 316 and the lumen of the second fluid pathway 322 may be in fluid communication with the lumen of the second vial penetrator 318. It should be understood, that because the flexible membrane 208 in combination with the walls 206 forms the cavity 302, protects the cavity 302 from the ambient environment 50, and maintains sterility in the cavity 302, the lumens of the one or more vial penetrators and the lumens of the one or more fluid pathways exposed to the cavity 302 through openings may also be protected from the ambient environment 50 and may also remain sterile.

In some embodiments, at least one fluid pathway of the one or more fluid pathways may include at least one liquid-gas separator. For example, as shown in FIG. 3, a liquid-gas separator 324 may be positioned within the lumen of the second fluid pathway 322 preventing liquid from communicating from the lumen of the second fluid pathway 322 and into the lumen of the second vial penetrator 318 while permitting gas to communicate from the lumen of the second fluid pathway 322 and into the lumen of the second vial penetrator 318. Similarly, the liquid-gas separator 324 may also prevent liquid from communicating from the lumen of the second vial penetrator 318 and into the lumen of the second fluid pathway 322 while permitting gas to communicate from the lumen of the second vial penetrator 318 and into the lumen of the second fluid pathway 322. Conversely, in at least some embodiments, the first fluid pathway 320 may not include a liquid-gas separator and thus permits liquid and gas communication between the lumen of the first vial penetrator 316 and the lumen of the first fluid pathway 320. It should also be understood that in some embodiments a liquid-gas separator may alternatively or additionally be positioned within the lumen of the second vial penetrator 318.

In at least some embodiments, the fluid transfer member 104 may include one or more fluid pathway blockers. In some embodiments, the one or more fluid pathway blockers may include one or more valves, for example, manually actuated valves. Each of the one or more fluid pathway blockers may move between a first position which closes or stops fluid communication through the lumen of a fluid pathway and a second position which opens or permits fluid communication through the lumen of a fluid pathway. For example, as shown in FIG. 3, the fluid transfer member 104 may include at least a first fluid pathway blocker 326 and a second fluid pathway blocker 328. The first fluid pathway blocker 326 may block and permit fluid communication through the first fluid pathway 320 and the second fluid pathway blocker 328 may block and permit fluid communication through the second fluid pathway 322.

In some embodiments, the one or more fluid pathway blockers, in the first position, may close or stop fluid communication through a lumen of a fluid pathway by forcing walls, such as flexible walls, of the fluid pathway together into physical contact. For example, as shown in FIG. 3, the first fluid pathway 320 may be positioned between the first fluid pathway blocker 326 and wall 327 within the fluid transfer member 104. Similarly, as shown in FIG. 3, the second fluid pathway 322 may be positioned between the second fluid pathway blocker 328 and wall 327 within the fluid transfer member 104. Each of the one or more fluid pathway blockers may be coupled to one or more collets 120. A collet 120 coupled to the first fluid pathway blocker 326 may be pressed by a force that is external to the system 100 forcing first fluid pathway blocker 326 towards the first fluid pathway 320 and the wall 327 until walls of the first fluid pathway 320 are in direct physical contact with each other, the first fluid pathway blocker 326, and the wall 327. Similarly, a collet 120 may be pressed by a force that is external to the system 100 forcing second fluid pathway blocker 328 towards the second fluid pathway 322 and the wall 327 until walls of the second fluid pathway 322 are in direct physical contact with each other, the second fluid pathway blocker 328, and the wall 327. When the one or more fluid pathway blockers are in the first position, no fluid communication can take place through the lumens of the respective fluid pathways.

In some embodiments, the one or more fluid pathway blockers, in the second position, may open or permit fluid communication through a lumen of a fluid pathway by disengaging from walls, such as flexible walls, of the fluid pathway releasing the walls of the fluid pathways from physical contact. For example, as shown in FIG. 3, the first fluid pathway 320 may be positioned between the first fluid pathway blocker 326 and wall 327 within the fluid transfer member 104. Similarly, as shown in FIG. 3, the second fluid pathway 322 may be positioned between the second fluid pathway blocker 328 and wall 327 within the fluid transfer member 104. Each of the one or more fluid pathway blockers may be coupled to one or more collets 120. A collet 120 coupled to the first fluid pathway blocker 326 may be pressed by a force that is external to the system 100 to release the first fluid pathway 320 from engagement with the first fluid pathway blocker 326 and the wall 327 so that the walls of the first fluid pathway 320 are no longer in direct physical contact with each other. Similarly, a collet 120 coupled to the second fluid pathway blocker 328 may be pressed by a force that is external to the system 100 to release the second fluid pathway 322 from engagement with the second fluid pathway blocker 328 and the wall 327 so that the walls of the second fluid pathway 322 are no longer in direct physical contact with each other. When the one or more fluid pathway blockers are in the second position, fluid communication can take place through the lumens of the respective fluid pathways. It should be understood that with at least some embodiments, the one or more fluid pathway blockers may move between the first position and the second position without exposing the lumens of the respective one or more fluid pathways to an environment external to the one or more fluid pathways. Thus, sterility may be maintained within the lumens of the one or more fluid pathways.

In at least some embodiments, the fluid transfer member 104 may also include one or more pumps 330. The one or more pumps 330 may include a positive displacement pump such as a peristaltic pump, an infusion pump, a syringe pump, an elastomeric pump, or the like or a centrifugal pump. In some embodiments, the one or more pumps 330 may prevent or block fluid communication through lumens of the one or more fluid pathways, for example, when at least one pump 330 of the one or more pumps 330 is in a static state. A static state of a pump may be when a pump is not generating or facilitating fluid communication through lumens of the one or more fluid pathways.

As shown in FIG. 3, when, for example, the one or more pumps 330 includes a peristaltic pump, the one or more pumps 330 may include one or more fluid pathway contact members, such as a first fluid pathway contact member 332, a second fluid pathway contact member 334, and a third fluid pathway contact member 336, and one or more walls, such as a first wall 338 and a second wall 340. The one or more fluid pathways may be coupled to a surface of the one or more walls. For example, the first fluid pathway 320 may be coupled to a surface of the first wall 334 and the second fluid pathway 330 may be coupled to a surface of the second wall 336. Each of the one or more fluid pathway contact members may contact an outer surface of the one more fluid pathways and compress the one or more fluid pathways against the one or more walls to close or block (such as at least partially close or block) the lumens along a portion of each of the one or more fluid pathways. For example, the first fluid pathway contact member 332 may contact an outer surface of the first fluid pathway 320 and compress the first fluid pathway 320 against the first wall 338. The first fluid pathway contact member 332 may at least partially close or block the lumen through the first fluid pathway 320 at the location along the first fluid pathway 320 where the first fluid pathway contact member 332 is in contact with the outer surface of the first fluid pathway 320. Thus, when at least one pump 330 of the one or more pumps 330 is in a static state and the first fluid pathway contact member 332 closes or blocks (such as completely closes, partially closes, completely blocks, or partially blocks) fluid communication through the lumen of the first fluid pathway 320, the first fluid pathway contact member 332 may block or prevent fluid communication through the lumen of the first fluid pathway 320. The second fluid pathway contact member 334 may contact an outer surface of the second fluid pathway 322 and compress the second fluid pathway 322 against the second wall 340. The second fluid pathway contact member 334 may at least partially close or block the lumen through the second fluid pathway 322 at the location along the second fluid pathway 322 where the second fluid pathway contact member 334 is in contact with the outer surface of the second fluid pathway 322. Thus, when at least one pump 330 of the one or more pumps 330 is in a static state and the second fluid pathway contact member 334 closes or blocks (such as completely closes, partially closes, completely blocks, or partially blocks) fluid communication through the lumen of the second fluid pathway 322, the second fluid pathway contact member 334 may block or prevent fluid communication through the lumen of the second fluid pathway 322. The third fluid pathway contact member 336 may not be in contact with an outer surface of a fluid pathway when at least one pump 330 of the one or more pumps 330 is in the static state. It should be understood that in at least some embodiments, when the one or more pumps 330 are in a static state, the pumps 330 may be used to prevent fluid communication through the first lumen of the first fluid pathway 320 and the lumen of the second fluid pathway 322. Thus, when the pumps 330 are in the static state, fluid communication may be prevented from communicating into the cavity 360 or out of the cavity 360.

The one or more pumps 330 may facilitate or generate fluid communication through the one or more fluid pathways of the fluid transfer member 104, for example, when the one or more pumps 330 is in a dynamic state. The one or more pumps 330 may be in a dynamic state when the one or more pumps 330 move to communicate fluid through the lumens of the one or more fluid pathways. For example, when a vial 5 is sealingly coupled to the system 100 in the vial coupling member 102 and the system 100 is to extract fluid 45 from the vial 5, the one or more pumps 330 may generate or facilitate fluid communication from the vial coupling member 102, through the first fluid pathway 320, and into the fluid retaining member 106 so that a container (discussed herein) of the fluid retaining member 106 may receive at least some fluid 45 of a total amount of fluid 45 from the vial 5. In another example, when a vial 5 is sealingly coupled to the system 100 in the vial coupling member 102 and the system 100 is to extract fluid 45 from the vial 5, the one or more pumps 330 may generate or facilitate fluid communication from the fluid retaining member 106, through the second fluid pathway 322, and into the vial coupling member 102 so that the vial 5 may receive fluid from a container (discussed herein) of the fluid retaining member 106. In at least some embodiments, the one or more pumps 330 may facilitate or generate fluid communication from the vial coupling member 102, through the first fluid pathway 320 and into the fluid retaining member 106 while simultaneously facilitating or generating fluid communication from the fluid retaining member 106 through the second fluid pathway 322 and into the vial coupling member 102. In at least some embodiments, the one or more pumps 330 may generate or facilitate fluid communication through the one or more fluid pathways without exposing the lumens of the one or more fluid pathways to contaminants, an environment exposed to an outside surface of the one or more fluid pathways, or the ambient environment 50. It should be understood that the one or more pumps 330 may facilitate fluid communication through a fluid pathway of the fluid transfer member 104 without causing fluid to communicate through a fluid pathway, for example, when a fluid pathway blocker prevents or blocks fluid communication through a fluid pathway.

In some embodiments, the one or more pumps 330 may also include one or more arms, such as a first arm 342, a second arm 344, and a third arm 346 each coupled to an axis point 348 and configured to rotate around the axis point 348 when the one or more pumps 330 is in the dynamic state. In the example embodiment of FIG. 3, the first arm 342 may couple the first fluid pathway contact member 332 to the axis point 348, the second arm 344 may couple the second fluid pathway contact member 334 to the axis point 348, and the third arm 346 may couple the third fluid pathway contact member 336 to the axis point 348. The one or more pumps 330 may transition from the static state to the dynamic state when a force is exerted on the axis point 348 causing the one or more arms to rotate about the axis point 348 and causing the one or more fluid pathway contact members to move along a length of walls. As a fluid pathway contact member moves along a length of a wall, the fluid pathway contact member may block or close different sections of the lumen of a fluid pathway while pushing fluid in front of the blocked section and while pulling fluid behind the blocked section.

For example, as shown in FIG. 3, when the one or more pumps 330 is in the dynamic state and a clockwise force is applied on the axis point 348, the first fluid pathway contact member 332 may move along the length of the first wall 338, squeeze the first fluid pathway 320, and close or block the lumen of the first fluid pathway 320 against the first wall 338 while pushing fluid through the first fluid pathway 320 towards the fluid retaining member 106 and while pulling fluid through the first fluid pathway 320 from the vial coupling member 102. In addition, as shown in FIG. 3, when the one or more pumps 330 is in the dynamic state and a clockwise force is applied on the axis point 348, the third fluid pathway contact member 336 may move to engage the second fluid pathway 322. The third fluid pathway contact member 336 may continue to may move along the length of the second wall 340, squeeze the second fluid pathway 322 against the second wall 340, and close or block the lumen of the second fluid pathway 322 while pushing fluid through the second fluid pathway 322 towards the vial coupling member 102 and while pulling fluid through the second fluid pathway 322 from the fluid retaining member 106. When the at least one pump 330 is in the dynamic state and a clockwise force is applied on the axis point 348, the second fluid pathway contact member 334 may interact with the second fluid pathway 322 and the second wall 340 in a same or similar manner as described herein with respect to at least the third fluid pathway contact member 336. In addition, when the one or more pumps 330 is in the dynamic state, the second fluid pathway contact member 334 may move out of engagement with the second fluid pathway 322 and into engagement with the first fluid pathway 320 and interact with the first fluid pathway 320 and the first wall 338 in a same or a similar manner as described herein at least with respect to the first fluid pathway contact member 332.

In another example, as shown in FIG. 3, when the one or more pumps 330 is in the dynamic state and a counter-clockwise force is applied on the axis point 348, the second fluid pathway contact member 334 may move along the length of the second wall 340, squeeze the second fluid pathway 322, and close or block the lumen of the second fluid pathway 322 against the second wall 340 while pushing fluid through the second fluid pathway 322 towards the fluid retaining member 106 and while pulling fluid through the second fluid pathway 322 from the vial coupling member 102. In addition, as shown in FIG. 3, when the one or more pumps 330 is in the dynamic state and a counter-clockwise force is applied on the axis point 348, the third fluid pathway contact member 336 may move to engage the first fluid pathway 320. The third fluid pathway contact member 336 may continue to may move along the length of the first wall 338, squeeze the first fluid pathway 320 against the first wall 338, and close or block the lumen of the first fluid pathway 320 while pushing fluid through the first fluid pathway 320 towards the vial coupling member 102 and while pulling fluid through the first fluid pathway 320 from the fluid retaining member 106. When the one or more pumps 330 is in the dynamic state and a counter-clockwise force is applied on the axis point 348, the first fluid pathway contact member 332 may interact with the first fluid pathway 320 and the first wall 338 in a same or similar manner as described herein at least with respect to the third fluid pathway contact member 336. In addition, when the one or more pumps 330 is in the dynamic state, the first fluid pathway contact member 332 may move out of engagement with the first fluid pathway 320 and into engagement with the second fluid pathway 322 and interact with the second fluid pathway 320 and the second wall 340 in a same or a similar manner as described herein at least with respect to the second fluid pathway contact member 334.

In at least some embodiments, a clockwise force or a counter-clockwise force on the axis point 348 may be applied through one or more gears 350 that engage the axis point 348 and the pump activation member 116 extending through the pump access aperture 114. This feature may allow a user to manually activate or operate the one or more pumps 330, for example, by applying a clockwise force and/or a counter-clockwise force to the axis point 348 as well as to transition the one or more pumps 330 from a static state to a dynamic state or from a dynamic state to a static state. It should be understood that while the pump activation member 116 may allow a user to manually activate or operate the one or more pumps 330, the pump activation member 116 may additionally or alternatively activate an electric motor or any other mechanism to apply a clockwise force or a counter-clockwise force on the axis point 348 and transition the one or more pumps 330 from a static state to a dynamic state or from a dynamic state to a static state. One of ordinary skill in the art would be able to identity the various types of mechanisms that may be used to activate or operate the one or more pumps 330.

In some embodiments, the one or more pumps 330 may include an indicator 352 that provides a visual or auditory indication that a predetermined amount of a fluid has communicated through a fluid pathway after actuating the one or more pumps 320. For example, the indicator 352 may provide a "clicking noise" that after a predetermined number of clicks indicative of a number of pump rotations to communicate fluid 45 from the vial 5, through the first fluid pathway 320, and into a container of the fluid retaining member 106, may indicate an amount of fluid 45 deposited into a container of the fluid retaining member 106. This feature may also allow a user to estimate or specifically determine an amount of fluid 45 that is transferred from the vial 5 to a container of the fluid retaining member 106.

As discussed herein, the system 100 may further include a fluid retaining member 106. The fluid retaining member 106 may include one or more containers 354, and one or more fluid pathways, such as first fluid pathway 356 and second fluid pathway 358. Each of the one or more fluid pathways may include lumens that are in fluid communication with a lumen of a fluid pathway of the fluid transfer member 104 as well as a cavity 360 formed by a container 354 of the one or more containers. For example, as shown in FIG. 3, the first fluid pathway 356 may have a lumen that is in fluid communication with the lumen of the first fluid pathway 320 of the fluid transfer member 104 as well as the cavity 360 formed by the container 354. The second fluid pathway 358 may have a lumen that is in fluid communication with the lumen of the second fluid pathway 322 of the fluid transfer member 104 as well as the cavity 360 formed by the container 354 of the one or more containers.

In some embodiments, at least one fluid pathway of the one or more fluid pathways of the fluid retaining member 106 may include at least one liquid-gas separator. For example, as shown in FIG. 3, a liquid-gas separator 362 may be positioned within the lumen of the second fluid pathway 358 preventing liquid from communicating from the lumen of the second fluid pathway 358 and into the cavity 360 of the container 354 while permitting gas to communicate from the lumen of the second fluid pathway 358 and into the cavity 360 of the container 354. Similarly, the liquid-gas separator 362 may also prevent liquid from communicating from the cavity 360 of the container 354 and into the lumen of the second fluid pathway 358 while permitting gas to communicate from the cavity 360 of the container 354 and into the lumen of the second fluid pathway 358. Conversely, in at least some embodiments, the first fluid pathway 356 may not include a liquid-gas separator and thus permits liquid and gas communication between the cavity 360 of the container 354 and the lumen of the first fluid pathway 356. It should also be understood that in some embodiments a liquid-gas separator may be positioned anywhere along the lumen of the second fluid pathway 358.

In at least some embodiments, the vial retaining member 106 may include one or more fluid pathway blockers. In some embodiments, the one or more fluid pathway blockers may include one or more valves, for example, manually actuated valves. Each of the one or more fluid pathway blockers may move between a first position which closes or stops fluid communication through the lumen of a fluid pathway and a second position which opens or permits fluid communication through the lumen of a fluid pathway. For example, as shown in FIG. 3, the fluid retaining member 106 may include at least a first fluid pathway blocker 364 and a second fluid pathway blocker 366. The first fluid pathway blocker 364 may block and permit fluid communication through the first fluid pathway 356 and the second fluid pathway blocker 366 may block and permit fluid communication through the second fluid pathway 358.

In some embodiments, the one or more fluid pathway blockers, in the first position, may close or stop fluid communication through a lumen of a fluid pathway by forcing walls, such as flexible walls, of the fluid pathway together into physical contact. For example, as shown in FIG. 3, the first fluid pathway 356 may be positioned between the first fluid pathway blocker 364 and a wall 368 within the fluid retaining member 106. Similarly, as shown in FIG. 3, the second fluid pathway 358 may be positioned between the second fluid pathway blocker 366 and the wall 368 within the fluid retaining member 106. Each of the one or more fluid pathway blockers may be coupled to one or more collets 120. A collet 120 coupled to the first fluid pathway blocker 364 may be pressed by a force that is external to the system 100 forcing first fluid pathway blocker 364 towards the first fluid pathway 356 and the wall 368 until walls of the first fluid pathway 356 are in direct physical contact with each other, the first fluid pathway blocker 364, and the wall 368. Similarly, a collet 120 may be pressed by a force that is external to the system 100 forcing second fluid pathway blocker 366 towards the second fluid pathway 358 and the wall 368 until walls of the second fluid pathway 358 are in direct physical contact with each other, the second fluid pathway blocker 366, and the wall 368. When the one or more fluid pathway blockers are in the first position, no fluid communication can take place through the lumens of the respective fluid pathways.

In some embodiments, the one or more fluid pathway blockers, in the second position, may open or permit fluid communication through a lumen of a fluid pathway by disengaging from walls, such as flexible walls, of the fluid pathway releasing the walls of the fluid pathways from physical contact with each other. For example, as shown in FIG. 3, the first fluid pathway 356 may be positioned between the first fluid pathway blocker 364 and the wall 368 within the fluid retaining member 106. Similarly, as shown in FIG. 3, the second fluid pathway 358 may be positioned between the second fluid pathway blocker 366 and the wall 3368 within the fluid retaining member 106. Each of the one or more fluid pathway blockers may be coupled to one or more collets 120. A collet 120 coupled to the first fluid pathway blocker 356 may be pressed by a force that is external to the system 100 to release the first fluid pathway 356 from engagement with the first fluid pathway blocker 364 and the wall 368 so that the walls of the first fluid pathway 356 are no longer in direct physical contact with each other. Similarly, a collet 120 coupled to the second fluid pathway blocker 366 may be pressed by a force that is external to the system 100 to release the second fluid pathway 358 from engagement with the second fluid pathway blocker 366 and the wall 368 so that the walls of the second fluid pathway 358 are no longer in direct physical contact with each other. When the one or more fluid pathway blockers are in the second position, fluid communication may take place through the lumens of the respective fluid pathways. It should be understood that with at least some embodiments, the one or more fluid pathway blockers may move between the first position and the second position without exposing the lumens of the respective one or more fluid pathways to an environment external to the one or more fluid pathways. Thus, sterility may be maintained within the lumens of the one or more fluid pathways.

As discussed herein, the fluid retaining member 106 may include one or more containers 354. Each of the one or more containers 354 may be positioned in a space 370 formed by exterior walls 107. In some embodiments, the exterior walls 107 may seal the space 370 from the ambient environment 50 preventing fluid communication between the space 370 and the ambient environment 50. At least one container 354 of the one or more containers 354 may be include one or more walls 372 forming the cavity 360. The one or more walls 372 may seal the cavity 360 from at least one of the space 370 or the ambient environment 50. For example, the one or more walls 372 may prevent fluid communication between the cavity 360 and at least one of the space 370 or the ambient environment 50. At least one container 354 of the one or more containers 354 may be one of a constant volume container or a variable volume chamber. When the at least one container 354 of the one or more containers 354 is a constant volume container, the one or more walls 372 may be rigid walls forming the cavity 360. When the at least one container 354 of the one or more containers 354 is a variable volume container, at least one wall 372 of the one or more walls 372 may be a flexible wall. For example, when the at least one container 354 is a variable volume container, at least one wall 372 may include a bellows. In some embodiments, when the at least one container 354 of the one or more containers 354 is a variable volume container, the at least one container 354 may be a flexible bag. The flexible bag may include medical grade flexible plastic, such as flexible plastic that can be punctured by a needle or spike. The flexible plastic may be the same or similar plastic used to form IV bags. One of ordinary skill in the art would understand the variable types of materials that may be used to form the one or more walls 372 of the one or more containers 354.

The cavity 360 may be configured to receive the fluid 45 from the vial 5 through a first opening 374 in fluid communication with a lumen of the first fluid pathway 356 of the fluid retaining member 106. The cavity 360 may also be configured to retain the fluid 45 within the container 354. For example, after the fluid 45 is communicated from the first fluid pathway 356 through the first opening 374 and into the cavity 360, the one or more walls 372 forming the cavity 360 may retain the fluid 45 in the cavity. In addition, while the second opening 376 may provide fluid communication between the cavity 360 and the second fluid pathway 358, the liquid-gas separator 362 positioned within the lumen of the second fluid pathway 358 may prevent the fluid 45 from communicating out of the cavity 360 and thus allow the cavity 360 to retain the fluid 45. Further, while the first opening 374 may provide fluid communication between the cavity 360 and the first fluid pathway 356, the first fluid pathway blocker 364 blocking fluid communication through the lumen of the first fluid pathway 356 may prevent the fluid 45 from communicating out of the cavity 360 and thus allow the cavity 360 to retain the fluid 45.

In at least some embodiments, at least one container 354 of the one or more containers 354 may contain a sterile gas. The sterile gas may be used to pressurize the interior space 15 of the vial 5. One of ordinary skill in the art would be able identify the various types of sterile gases that may be used to pressurize a vial 5. The sterile gas may be communicated through the second opening 376 and into the lumen of the second fluid pathway 358. For example, the liquid-gas separator 362 positioned within the lumen of the second fluid pathway 358 may allow sterile gas to communicate out of the cavity 360 and into the lumen of the second fluid pathway 322 of the fluid transfer member 104 through the lumen of the second fluid pathway of the fluid retaining member 106 while preventing the fluid 45 retained within the cavity 360 from communicating out of the cavity 360 and into the lumen of the second fluid pathway 322 of the fluid transfer member 104. Further, while the first opening 374 may provide fluid communication between the cavity 360 and the first fluid pathway 356 of the fluid retaining member 106 and the first fluid pathway 320 of the fluid transfer member 104, the first fluid pathway blocker 364 blocking fluid communication through the lumen of the first fluid pathway 356 may prevent the sterile gas from communicating out of the cavity 360.

As discussed herein, the fluid retaining member 106 may include one or more fluid access members 118. Each fluid access member 118 of the one or more fluid access members 118 may be associated with a container 354 of the one or more containers 354. In some embodiments, a single fluid access member 118 may provide access to fluid 45 retained in a single cavity 360 of a container 354 of the one or more containers 354. The one or more fluid access members 118 may include a needle permeable material or needle penetrable material. The one or more container access members 118 may include one or more materials that are the same as or similar to materials of the vial septum 10. In at least this embodiment, the one or more fluid access members 118 may be configured to permit a needle to penetrate therethrough and into the cavity 360 of a container 354 to extract fluid 45 retained by the cavity 360 of the container 354.

The one or more fluid access members 118 may be configured to prevent fluid communication therethrough. For example, the fluid access member 118 may prevent fluid communication from the ambient environment 50 into the space 370. The fluid access member 118 may prevent fluid communication from the space 370 into the ambient environment 50. The one or more fluid access members 118 may each include a first side 378 exposed to the ambient environment 50. A fluid extraction device may penetrate the fluid access member 118 through the first side 378. The one or more fluid access members 118 may also include a second side 380. As shown in FIG. 3, the second side 378 may be exposed directly to the cavity 360 formed by the container 354 so that the fluid 45 may come into direct contact with the second side 380 of the fluid access member 118. Alternatively, a wall 372 forming the cavity 360 may be in direct contact with the second side 380 of the fluid access member 118 or in close proximity to the second side 380 of the fluid access member 118.

Figure 7:
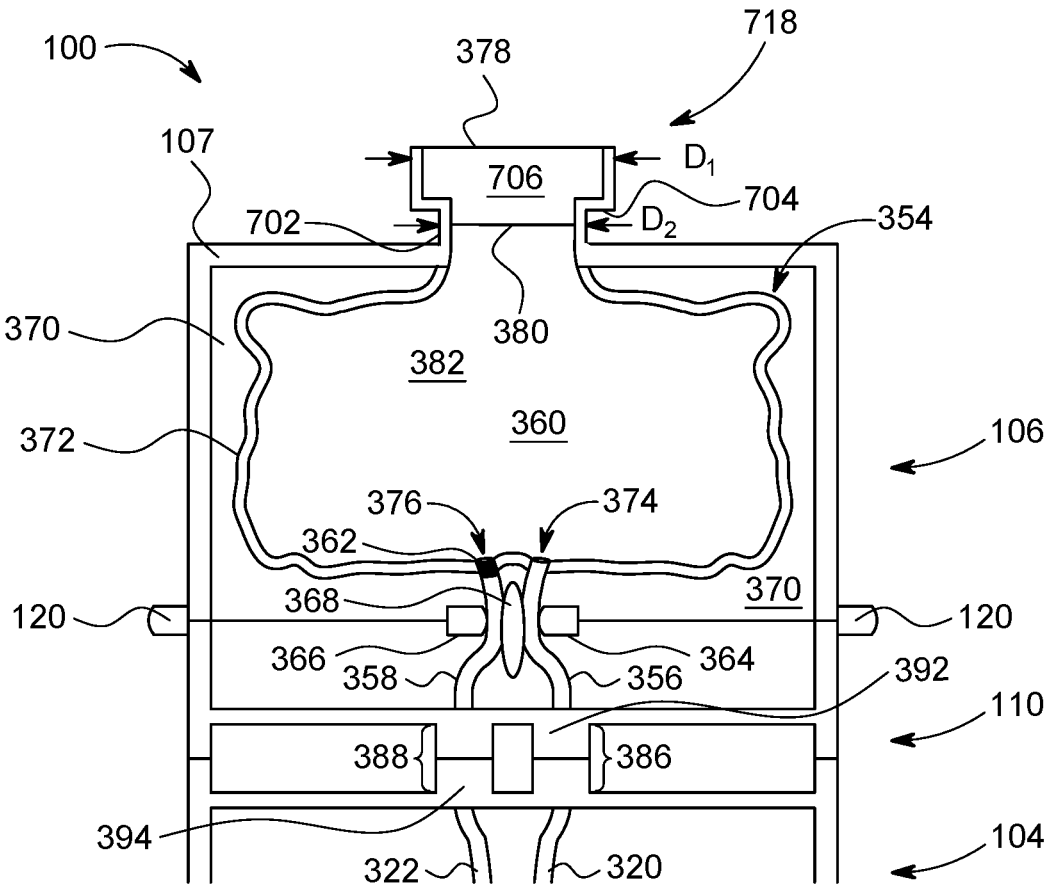
FIG. 7 illustrates an example embodiment of a fluid retaining member including an alternative example fluid access member.

FIG. 7 illustrates an example embodiment of a fluid retaining member 106 including an alternative example fluid access member 718. One or more of the components described herein with respect to FIG. 7 may be used with any other embodiments described herein including the embodiments described with respect to FIGS. 1-6 and 8-21 provided herein. The fluid access member 718 may be configured to allow a CSTD, as discussed herein, to couple to the fluid retaining member 106 and extract the fluid 45 from the cavity 360 of the container 354. As shown in FIG. 7, the fluid access member 718 may include a configuration at least similar to a neck, top, and septum of a vial. The fluid access member 718 may include a neck 702, a flange 704, and a top 706. The neck 702 may include a first diameter $D_3$ and the top 706 may include a second diameter $D_4$. The flange 704 may cause a magnitude of first diameter $D_3$ to be less than a magnitude of the second diameter $D_4$. Using the fluid access member 718, a CSTD may be able to couple to the fluid retaining member 106 and safely extract fluid 45 from the cavity 360 of the container 354.

The system 100 may also include one or more disengaging sections, such as a first disengaging section 108 and a second disengaging section 110. As shown in FIG. 3, the first disengaging section 108 may initially couple the vial coupling member 102 to the fluid transfer member 104. The second disengaging section 110 may initially couple the fluid transfer member 104 to the fluid retaining member 106. The one or more disengaging sections may each be configured to allow sections of the system 100 to disengage from each other. Each of the one or more disengaging sections may include one or more coupling members 390 configured to releasably fasten an upper section 392 of a disengaging section and a lower section 394 of the same disengaging section together. For example, a lower section 394 may be fixedly attached to the fluid transfer member 104 while an upper section 392 may be fixedly attached to the vial coupling member 102. One or more coupling members 390 may releasably fasten the upper section 392 that is fixedly attached to the vial coupling member 102 to a lower section 394 that is fixedly attached to the fluid transfer member 104. One or more coupling members 390 may releasably fasten a lower section 394 that is fixedly attached to the fluid transfer member 104 to an upper section 392 that is fixedly attached to the fluid retaining member 106. The one or more coupling members 390 may prevent decoupling of the upper section 392 from the lower section 394 without a user manually activating the one or more coupling members 390 to decouple the upper section 392 from the lower section 394. The one or more coupling members 390 may include at least one of a latch, a tab that is configured to be torn away from the system 100, a locking mechanism, or the like.

Each of the one or more disengaging sections in a coupled state may maintain fluid communication between lumens of fluid pathways of the system 100. For example, as shown in FIG. 3, the first disengaging section 108 may include a first disengaging fluid pathway member pair 386 and a second disengaging fluid pathway member pair 388 each in a coupled state. A lumen formed by a first disengaging fluid pathway member pair 386 when in the coupled state may provide fluid communication, such as sterile fluid communication, between the lumen of the first vial penetrator 316 and the lumen of the first fluid pathway 320 of the fluid transfer member 104. A lumen formed by the second disengaging fluid pathway member pair 388 when in the coupled state may provide fluid communication, such as sterile fluid communication, between the lumen of the second vial penetrator 318 and the lumen of the second fluid pathway 322 of the fluid transfer member 104. Similarly, the second disengaging section 110 may include a first disengaging fluid pathway member pair 386 and a second disengaging fluid pathway member pair 388 each in a coupled state. A lumen formed by the first disengaging fluid pathway member pair 386 when in the coupled state may provide fluid communication, such as sterile fluid communication, between the lumen of the first fluid pathway 320 of the fluid transfer member 104 and the lumen of the first fluid pathway 356 of the fluid retaining member 106. A lumen formed by the second disengaging fluid pathway member pair 388 when in the coupled state may provide fluid communication, such as sterile fluid communication, between the lumen of the second fluid pathway 322 of the fluid transfer member 104 and the lumen of the second fluid pathway 358 of the fluid retaining member 106. Thus, as shown in at least the example embodiment of FIG. 3, when each of the one or more disengaging sections are in the coupled state, a sterile, sealed environment 382 that permits fluid communication therethrough may be maintained. The sterile sealed environment 382 may include, for example at least one of the cavity 302, the lumens of the vial penetrators (such as the lumen of the first vial penetrator 316 and the second vial penetrator 318), the lumens of the first disengaging section 108, the lumens the one or more fluid pathways of the fluid transfer member 104 (such as the first fluid pathway 320 and the second fluid pathway 322), the lumens of the second disengaging section 110, the lumens of the one or more fluid pathways of the fluid retaining member 106 (such as the first fluid pathway 356 and the second fluid pathway 358), or the one or more cavities 360 of the fluid retaining member 106.

Each of the one or more disengaging sections may be configured to physically separate sections (such as the vial coupling member 102, the fluid transfer member 104, and the fluid retaining member 106) of the system 100 from each other. For example, an upper section 392 of the first disengaging section 108 that is fixedly coupled to the vial coupling member 102 may be configured to separate from a lower section 394 of the first disengaging section 108 that is fixedly coupled to the fluid transfer member 104. Similarly, a lower section 394 of the second disengaging section 110 that is fixedly coupled to the vial transfer member 104 may be configured to separate from an upper section 392 of the second disengaging section 110 that is fixedly coupled to the fluid retaining member 106. It should be understood that while the upper section 392 of the first disengaging section 108 is fixedly attached to the vial coupling member 102 while the lower section 394 of the first disengaging section 108 is fixedly attached to the fluid transfer member 104, the upper section 392 of the first engaging section 108 may alternatively be fixedly attached to the fluid transfer member 104 while the lower section 394 is fixedly coupled to the vial coupling member 102. Similarly, it should be understood that while the upper section 392 of the second disengaging section 110 is fixedly attached to the fluid retaining member 106 while the lower section 394 of the second disengaging section 110 is fixedly attached to the fluid transfer member 104, the upper section 392 of the second engaging section 110 may alternatively be fixedly attached to the fluid transfer member 104 while the lower section 394 is fixedly attached to the fluid retaining member 106.

As discussed herein, each of the one or more disengaging sections may include one or more disengaging fluid pathway member pairs, such a first disengaging fluid pathway member pair 386 and a first disengaging fluid pathway member pair 386. Each of the fluid pathway member pairs are divided so that a portion of the fluid pathway member pair is a component of the upper section 392 and the other portion of the fluid pathway member pair is a component of the lower section 394. When an upper section 392 of the first disengaging section 108 that is coupled to the vial coupling member 102 separates from the lower section 394 of the first disengaging section 108 that is coupled to the fluid transfer member 104, the portion of the disengaging fluid pathway member pair that is a component of the upper section 392 may separate from the portion of the disengaging fluid pathway member pair that is a component of the lower section 394. Similarly, when a lower section 394 of the second disengaging section 110 that is coupled to the fluid transfer member 104 separates from an upper section 392 of the second disengaging section 110 that is coupled to the fluid retaining member 106, the portion of the disengaging fluid pathway member pair that is a component of the upper section 392 may also separate from the portion of the disengaging fluid pathway member pair that is a component of the lower section 394.

Each of the one or more disengaging fluid pathway member pairs may be configured to block and seal the lumens of fluid pathways of the system 100 when or after the upper sections 392 of the disengaging sections begin to separate from the lower sections 394 of the disengaging sections. For example, when the upper section 392 of the first disengaging section 108 begins to separate from the lower section 392 of the first disengaging section 108, the lumens of each of the vial penetrators 316 and 318 may be blocked and sealed from the ambient environment 50 and the lumens of each of the fluid pathways 320 and 322 of the fluid transfer member 104 may also be blocked and sealed from the ambient environment 50. Similarly, when the upper section 392 of the second disengaging section 110 begins to separate from the lower section 392 of the second disengaging section 110, the lumens of each of the flow paths 356 and 358 may be blocked and sealed from the ambient environment 50 and the lumens of each of the fluid pathways 320 and 322 of the fluid transfer member 104 may also be blocked and sealed from the ambient environment 50.

In some embodiments, a portion of a disengaging fluid pathway member pair that is a component of the upper section 392 may be configured to disengage from a portion of the disengaging fluid pathway member pair that is component of the lower section 394 while blocking and sealing lumens of the flow pathways of sections (such as the vial coupling member 102, the fluid transfer member 104, and the fluid retaining member 106) of the system 100 and subsequently reengage with each other after disengaging. In this case, when the portion of a disengaging fluid pathway member pair that is a component of the upper section 392 reengages with the portion of the disengaging fluid pathway member pair that is component of the lower section 394, the lumens of the flow pathways of the recoupled sections of the system 100 may become unblocked and fluid communication may be reestablished between the lumens of the flow pathways of the recoupled sections of the system 100 while preventing fluid communication between the lumens of the flow pathways of the recoupled sections of the system 100 from being exposed to the ambient environment 50. An example of such a disengaging fluid pathway member pair may be CHEMOLOCK® provided by I.C.U. Medical, Inc. In other embodiments, a portion of a disengaging fluid pathway member pair that is a component of the upper section 392 may be configured to disengage from a portion of the disengaging fluid pathway member pair that is component of the lower section 394 while blocking and sealing lumens of the flow pathways of sections (such as the vial coupling member 102, the fluid transfer member 104, and the fluid retaining member 106) of the system 100 and subsequently be prevented from reengaging with each other after disengaging. In this case, when the portion of a disengaging fluid pathway member pair that is a component of the upper section 392 attempts to reengage with the portion of the disengaging fluid pathway member pair that is component of the lower section 394, the lumens of the flow pathways of the separated sections of the system 100 may remain blocked so that fluid communication cannot be reestablished between the lumens of the fluid pathways of the sections and may remain sealed from the ambient environment 50.

Figure 8:
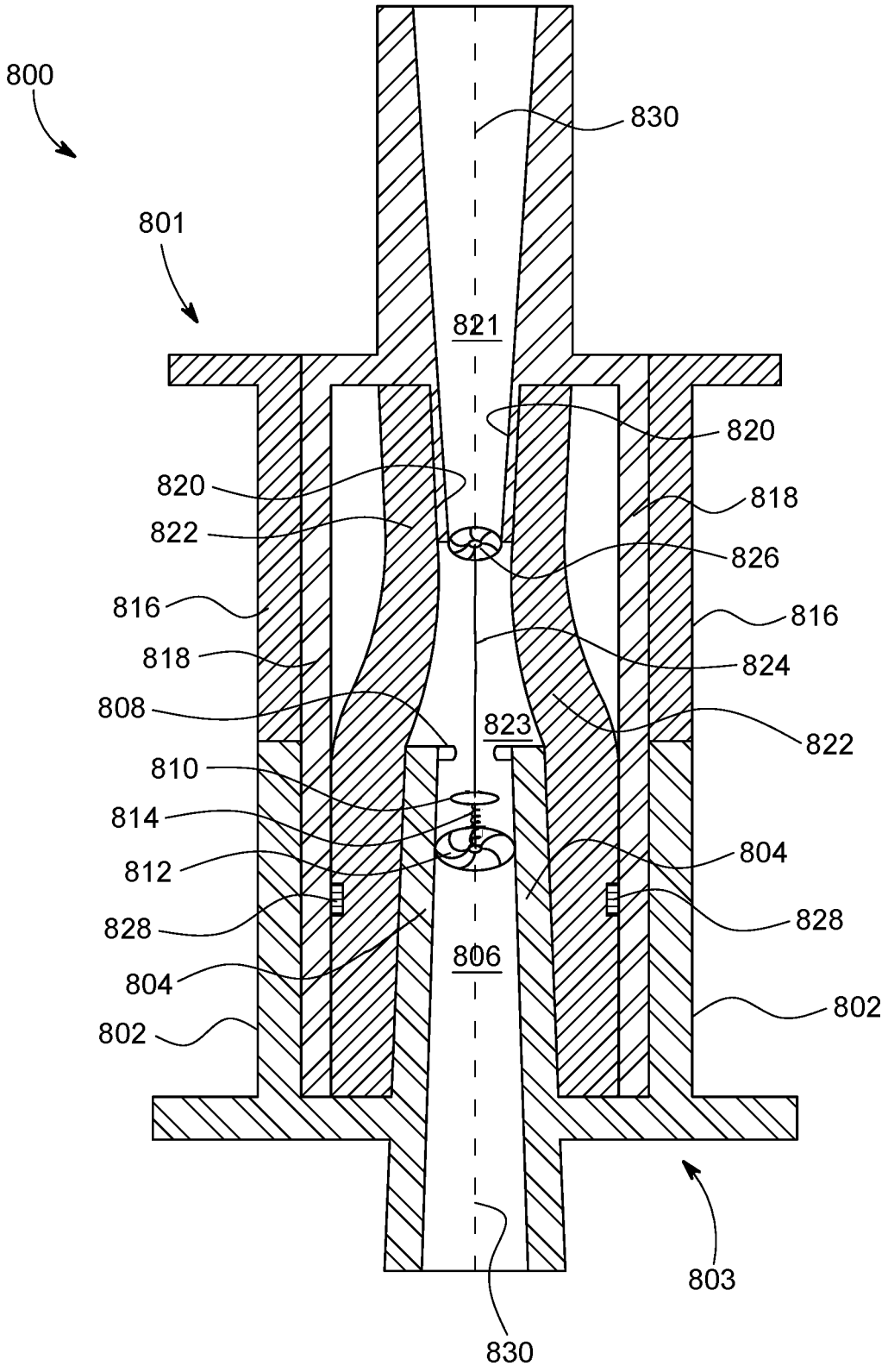
FIG. 8 illustrates an example disengaging fluid pathway member pair when a portion of the disengaging fluid pathway member pair is completely engaged or coupled with another portion of the disengaging fluid pathway member pair.

FIG. 8 illustrates an example disengaging fluid pathway member pair 800 when a portion of the disengaging fluid pathway member pair 800 is completely engaged or coupled with another portion of the disengaging fluid pathway member pair 800. One or more of the components described herein with respect to FIG. 8 may be used with any other embodiments described herein including the embodiments described with respect to FIGS. 1-7 and 9-21 provided herein. The portions of the disengaging fluid pathway member pair 800 may be prevented from reengaging with each other after disengaging as discussed herein. The disengaging fluid pathway member pair 800 may be the same or similar to at least one of the first disengaging fluid pathway member pairs 386 or the second disengaging fluid pathway member pair 388 of at least FIG. 3. The disengaging fluid pathway member pair 800 may be a component of at least one a first disengaging section 108 or the second disengaging section 110 as discussed herein. The disengaging fluid pathway member pair may include an upper section 801 and a lower section 803. The upper section 801 may be a component of the upper section 392 and the lower section 803 may be a component of the lower section 394 as described herein with respect to at least FIG. 3.

The first member, upper member, or upper section 801 of the disengaging fluid pathway member pair 800 may include a housing 802 and a fluid pathway 804 forming a lumen 806. The lumen 806 may be in fluid communication with a lumen of a vial penetrator or a fluid pathway of a section of the system 100 discussed herein. The fluid pathway 804 may also include a valve seat 808 configured to receive a valve 810. The valve seat 808 may include a locking member or an adhesive configured to maintain a seal between the valve 810 and the valve seat 808 or prevent the valve 810 from disengaging from the valve seat 808 when the valve 810 engages the valve seat 808. The valve 810 may be retained within the lumen 806 by a valve frame 812. The valve frame 812 may include one or more apertures to permit fluid communication therethrough. The valve 810 may be biased towards the valve seat 808 by a spring 814.

The second member, lower member, or lower section 803 may include a housing 816, an outer wall 818, an inner wall 820 forming a lumen 821, and a lumen closing member 822. The lumen 821 may be in fluid communication with a lumen of a vial penetrator or a fluid pathway of a section of the system 100 discussed herein. When the upper section 801 of the disengaging fluid pathway member pair 800 is engaged with or coupled to the lower section 803 of the disengaging fluid pathway member pair 800, end surfaces of the housing 816 may sealingly engage with ends of the housing 802 forming a sealed space therein. When the upper section 801 of the disengaging fluid pathway member pair 800 is engaged with or coupled to the lower section 803 of the disengaging fluid pathway member pair 800, the valve biasing member 824 coupled to the valve biasing member frame 826 may bias the valve 810 against the force exerted by the spring 814 and away from the valve seat 808 to permit fluid communication between the lumen 806 and the lumen 821 through a lumen 823. Similar to the valve frame 812, the valve biasing member frame 826 may also include one or more apertures to permit fluid communication therethrough. The valve biasing member 824 may be a slender rod or may include at least one slender dimension (such as a slender surface) that is arranged to be parallel to a surface of a first slab of the lumen closing member 822 and a surface of a second slab of the lumen closing member 822 so that surface of the first slab and the surface of the second slab may close or eliminate a lumen formed between them as discussed herein.

The lumen closing member 822 may be configured to bias toward a center axis 830 of the lumen 823 (as well as the lumens 806 and 821) and close or block the lumen 823 preventing fluid communication through the lumen 823, for example, to prevent fluid communication between the lumen 806 and the lumen 821. The lumen closing member 822 may include a resilient material having a generally flat rectangular shaped body, such as slab. The lumen closing member 822 may be formed of molded, 50 durometer silicone rubber, synthetic polyisoprene, or the like. In some embodiments, the lumen closing member 822 may include two slabs sealingly coupled together along edges so that when biased apart the two slabs form the lumen 823. Thus, when the two slabs are biased apart from each other the two slabs may form a sleeve over and around the outside surface of the flow pathway 804 and over and around the outside surface of the inner wall 820.

Figure 9:
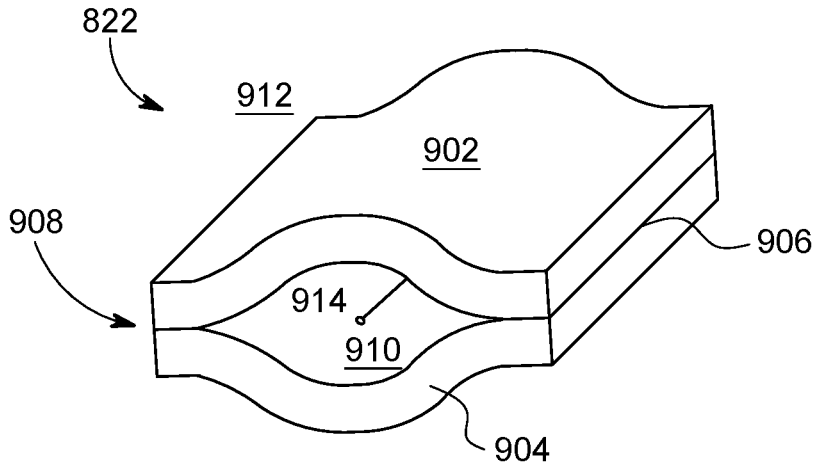
FIG. 9 illustrates a perspective view of an example lumen closing member in a biased state.

FIG. 9 illustrates a perspective view of an example lumen closing member 822 in a biased state. One or more of the components described herein with respect to FIG. 9 may be used with any other embodiments described herein including the embodiments described with respect to FIGS. 1-8 and 10-21 provided herein. The lumen closing member 822 may include a first slab 902 and a second slab 904 sealed together at edges 906 and 908. As shown in FIG. 9, the lumen closing member 822 may be biased away from a center axis 914 forming the lumen 910. The lumen 910 may be the same lumen or a similar lumen as the lumen 823 illustrated in FIG. 8. The center axis 914 may be the same center axis or a similar center axis as the center axis 830 illustrated in FIG. 8. The first slab 902 and the second slab 904 when sealed together at the edges 906 and 908 prevent ingress and egress of contaminants and fluids between the space 912 and the lumen 910. The space 912 may be the volume that is against the outside surface of the lumen closing member 822.

Figure 10:
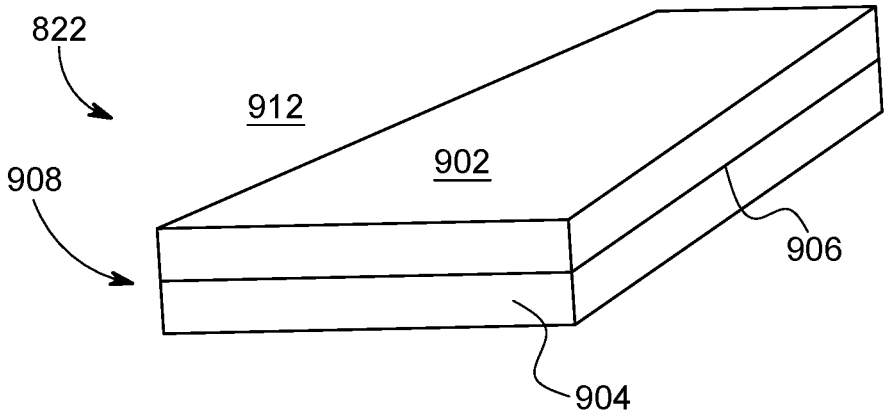
FIG. 10 illustrates a perspective view of an example lumen closing member in a relaxed state.

FIG. 10 illustrates a perspective view of an example lumen closing member 822 in a relaxed state. One or more of the components described herein with respect to FIG. 10 may be used with any other embodiments described herein including the embodiments described with respect to FIGS. 1-9 and 11-21 provided herein. As shown in FIG. 10, the lumen closing member 822 may be relaxed or in a relaxed state or relaxed position so that a surface of the first slab 902 contacts and seals with a surface of the second slab 904 closing or eliminating at least a portion of the lumen 910. Once the lumen closing member 822 relaxes so that the surface of the first slab 902 contacts and seals with the surface of the second slab 904, the first slab 902 and the second slab 904 may not be pulled apart again to form the lumen 910. For example, the surface of the first slab 902 and the surface of the second slab 904 may not be pulled apart again to form the lumen 910 or may be permanently engaged due to at least one of a natural tendency of the first slab 902 and the second slab 904 to bias towards a flattened state to contact and seal against each other, an adhesive on at least one of the surface of the first slab 902 or the surface of the second slab 904 holding each other together once the surfaces are in contact with each other, an external force provided by one or more members 828 that are exposed to the space 912 and hold and seal the surface of the first slab 902 against the surface of the second slab 904 once the surfaces are in contact with each other, or the like.

Turning back to FIG. 8, the inner wall 820 of the lower section 803 may maintain the lumen closing member 822 in the biased state or biased position away from the center axis 803 in the lumen 821 or may bias the lumen closing member 822 away from the center axis 830 in the lumen 821 to maintain fluid communication between the lumen 821 and the lumen 806. The fluid pathway 804 may maintain the lumen closing member 822 in the bias state or bias position away from the center axis 830 in the lumen 806 or may bias the lumen closing member 822 to maintain fluid communication between the lumen 821 and the lumen 806. The combination of the inner wall 820 and the fluid pathway 804 biasing the lumen closing member 822 away from the center axis 830 may also cause the lumen closing member 822 to form the lumen 823 as illustrated in FIG. 8.

Figure 11:
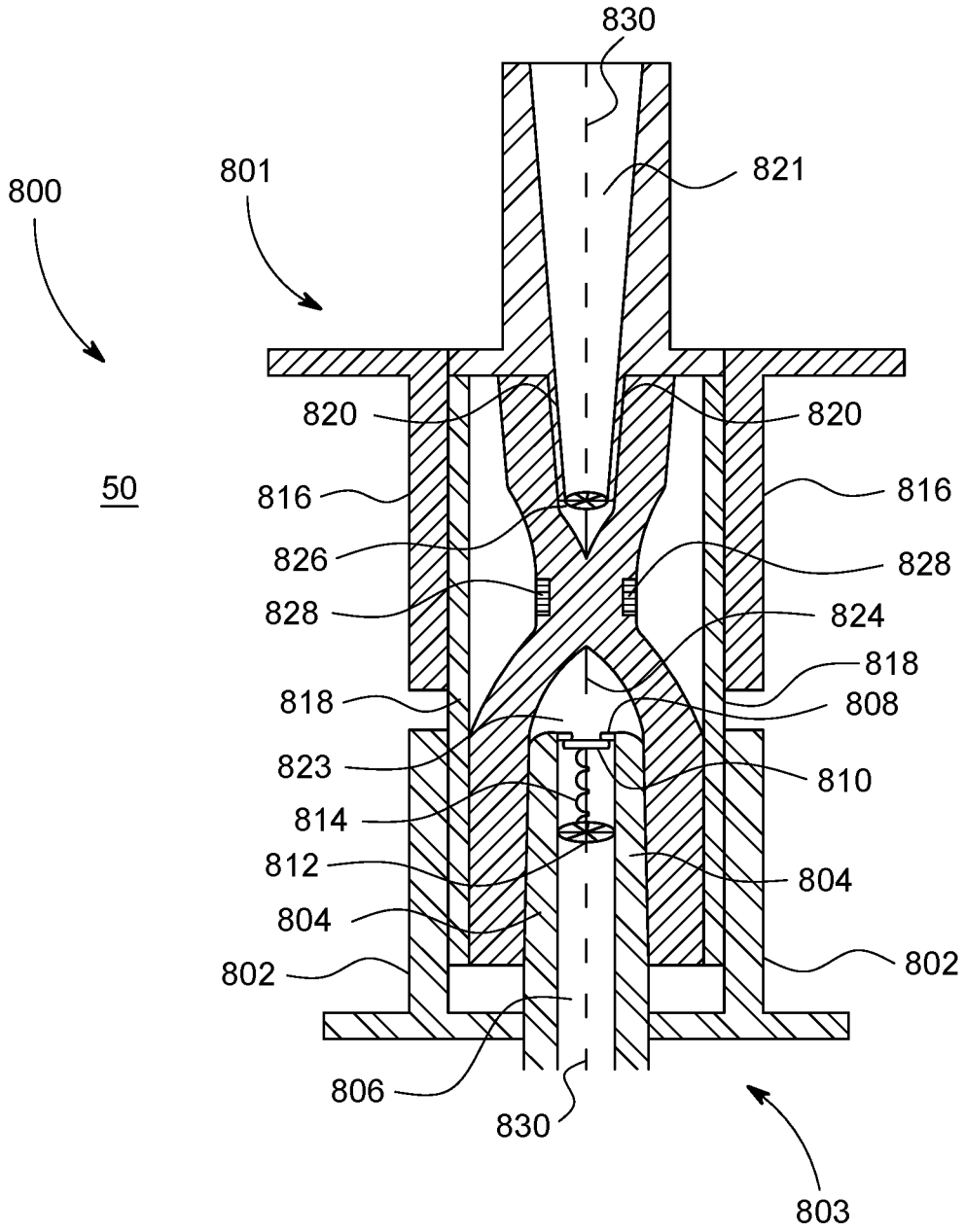
FIG. 11 illustrates an example disengaging fluid pathway member pair after the upper section of the disengaging fluid pathway member pair begins to disengaged or decoupled from the lower portion of the disengaging fluid pathway member pair.

FIG. 11 illustrates an example disengaging fluid pathway member pair 800 after the upper section 801 of the disengaging fluid pathway member pair 800 begins to disengaged or decoupled from the lower portion 803 of the disengaging fluid pathway member pair 800. One or more of the components described herein with respect to FIG. 11 may be used with any other embodiments described herein including the embodiments described with respect to FIGS. 1-10 and 12-21 provided herein. As shown in FIG. 11, end surfaces of the housing 816 may be disengaged from ends of the housing 802 while the housing 802 remains sealingly engaged with and along the outer wall 818 preventing fluid communication between the outer surface of the lumen closing member 822 and the ambient environment 50. The valve biasing member 824 coupled to the valve biasing member frame 826 may be removed from contact with the valve 810 permitting the valve 810 to bias towards the valve seat 808 due to the force exerted by the spring 814 and seal against the valve seat 808. A locking mechanism or adhesive on at least one of the valve 810 or the valve seat 808 may secure the valve 810 to the valve seat 808 preventing disengagement of the valve 810 from the valve seat 808 or providing permanent engagement between the valve 810 and the valve seat 808.

When the valve 810 sealingly engages the valve seat 808, the lumen 806 may be blocked preventing fluid communication between the lumen 823 and the lumen 806. Further, as the upper section 801 of the disengaging fluid pathway member pair 800 moves away from the lower portion 803 of the disengaging fluid pathway member pair 800, the lumen closing member 822 begins to slide along the outer surface of the fluid pathway 804 lessening the ability of the fluid pathway 804 to bias the lumen closing member 822 from the center axis 830. Thus, as the upper section 801 of the disengaging fluid pathway member pair 800 moves away from the lower portion 803 of the disengaging fluid pathway member pair 800, the lumen closing member 822 begins to close or eliminate the lumen 830 and blocks the lumen 821 preventing fluid communication between the lumen 823 and the lumen 806. In addition, because the outer wall 818 remains sealingly engaged with the housing 802 after the lumen 821 is blocked by the lumen closing member 822 and after the lumen 806 is blocked by the valve 810, the lumen 821 and the lumen 806 remain unexposed to the ambient environment 50.

Further, as shown in FIG. 11, the valve biasing member 824 may be a slender rod or may include at least one slender dimension (such as a slender surface) that is arranged to be parallel to engaging surfaces (such as a surface of a first slab and a surface of the second slab) of the lumen closing member 822 so that the surfaces may close or eliminate a lumen formed between them and seal together as discussed herein.

Figure 12:
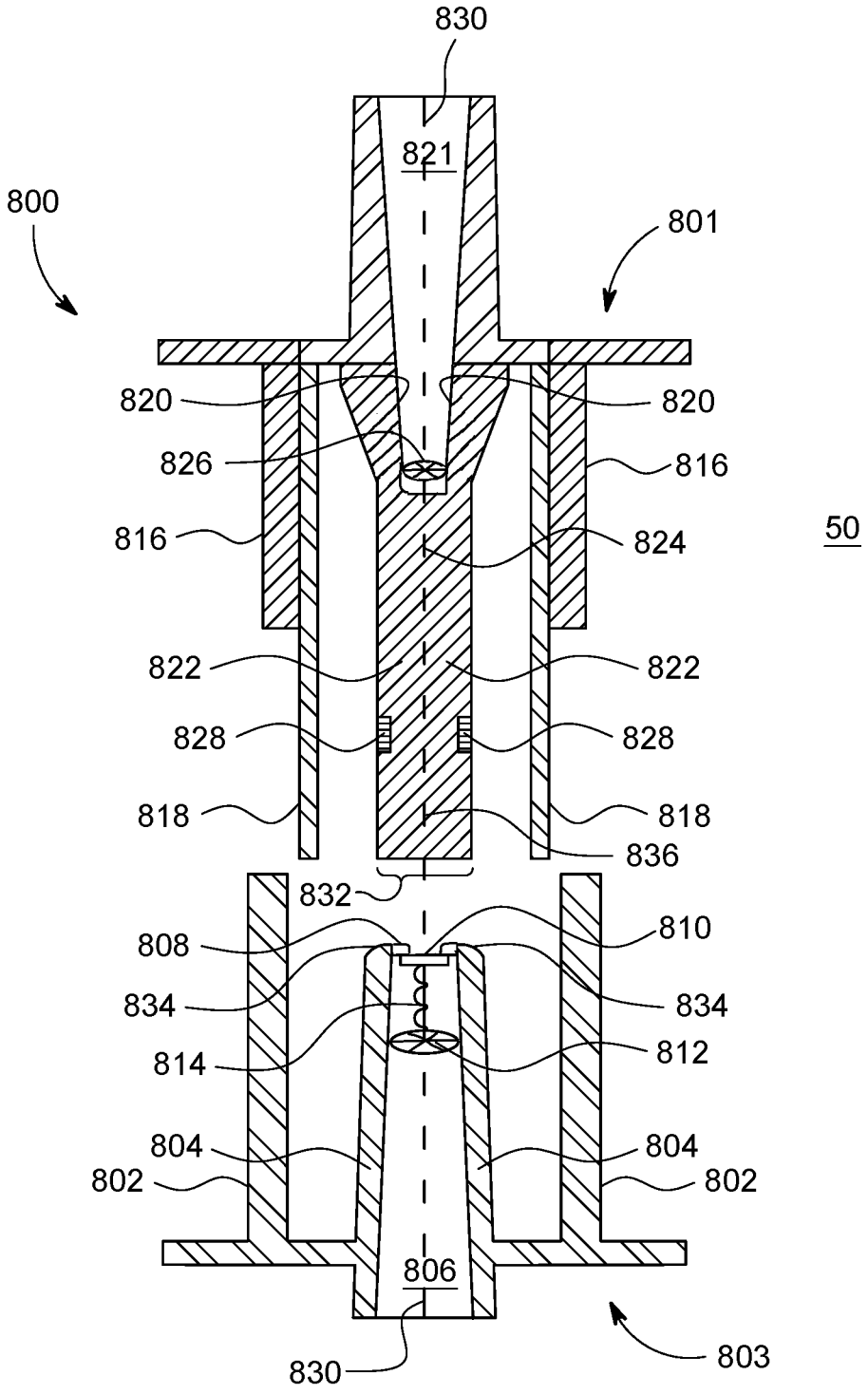
FIG. 12 illustrates an example disengaging fluid pathway member pair after the upper section of the disengaging fluid pathway member pair has disengaged or decoupled from the lower portion of the disengaging fluid pathway member pair.

FIG. 12 illustrates an example disengaging fluid pathway member pair 800 after the upper section 801 of the disengaging fluid pathway member pair 800 has disengaged or decoupled from the lower portion 803 of the disengaging fluid pathway member pair 800. One or more of the components described herein with respect to FIG. 12 may be used with any other embodiments described herein including the embodiments described with respect to FIGS. 1-11 and 13-21 provided herein. As shown in FIG. 12, the housing 802 may no longer be sealingly engaged against the outer wall 818 so that an outer surface of the lumen closing member 822 and an outer surface of the valve 810 (such as surface that is not exposed to the lumen 806) may be exposed to the ambient environment 50. Further, the lumen closing member 822 may be completely closed, eliminating the lumen 823, and sealing the lumen 821 from the ambient environment 50. Thus, after the upper section 801 of the disengaging fluid pathway member pair 800 has disengaged or decoupled from the lower portion 803 of the disengaging fluid pathway member pair 800, the lumen 821 and the lumen 806 may be prevented from being in fluid communication with each other and the ambient environment. Accordingly, no contaminants may enter into either the lumen 821 or the lumen 806 when a fluid pathway member pair 800 transitions from an engaged state to a disengaged state. In addition, because the lumen closing member 822 may permanently seal the lumen 821 and the valve 810 may permanently seal the lumen 806, the upper section 801 of the disengaging fluid pathway member pair 800 may be prevented from reengaging with the lower section 803 of the disengaging fluid pathway member pair 800 so that fluid communication between the lumen 821 and the lumen 806 may be prevented from being reestablished. In some embodiments, the relatively planar surfaces 832 and 834 at the distal ends of the upper section 801 of the disengaging fluid pathway member pair 800 and the lower section 803 of the disengaging fluid pathway member pair 800, respectively, may prevent the upper section 801 of the disengaging fluid pathway member pair 800 from reengaging with the lower section 803 of the disengaging fluid pathway member pair 800 so that fluid communication between the lumen 821 and the lumen 806 may be prevented from being reestablished. Similarly, relative lengths of the housing 802 and the fluid pathway 804 may prevent an edge of the planar surface 834 from wedging between the first slab and the second slab of the lumen closing member 822. For example, a length of the housing 802 may include a length that is longer than the fluid pathway 804 so that an edge of the planar surface 834 is unable to engage a seam 836 formed by the engagement of the first slab and the second slab of the lumen closing member 822 preventing the upper section 801 of the disengaging fluid pathway member pair 800 from reengaging with the lower section 803 of the disengaging fluid pathway member pair 800 so that fluid communication between the lumen 821 and the lumen 806 may be prevented from being reestablished. One or more of these features may prevent accidental or inadvertent recoupling of a contaminated lumen or cavity with an uncontaminated lumen or cavity.

In some embodiments, a cap may be fixedly attached over an end of the upper section 801 that disengaged from the lower section 803. The cap may fittingly engage with an outside surface of the outer wall 381 and may engage with the housing 816. A seal or locking mechanism may be included with the cap to form a closed seal over the end of the upper section 801. Similarly, a cap may be fixedly attached over an end of the lower section 803 that disengaged from the upper section 801. The cap may fittingly engage with an outside surface of the housing 802. A seal or locking mechanism may be included with the cap to form a closed seal over the end of the lower section 803.

Figure 13:
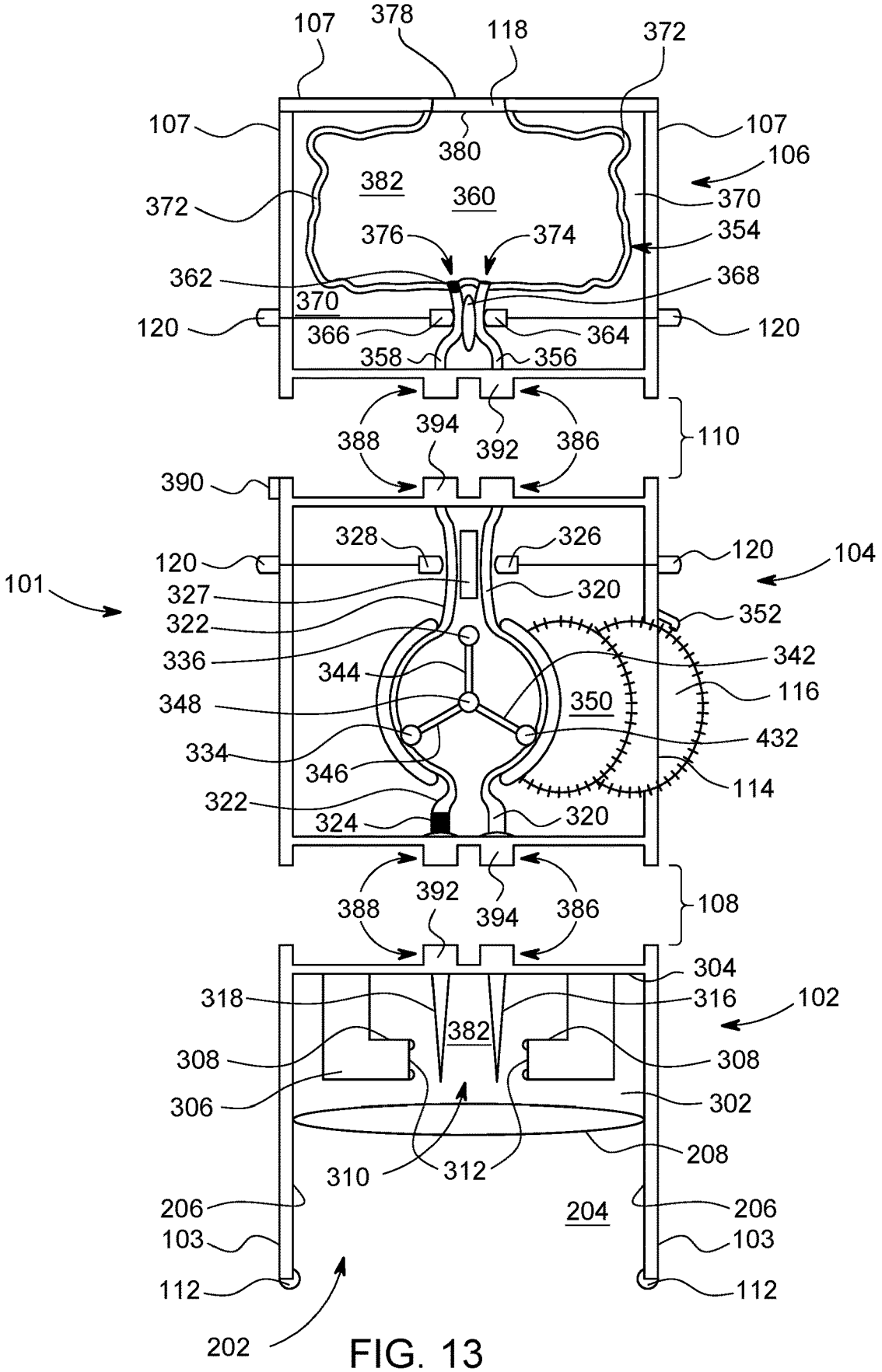
FIG. 13 illustrates an example embodiment of the system separated into individual members.

FIG. 13 illustrates an example embodiment of the system 100 separated into individual members. One or more of the components described herein with respect to FIG. 13 may be used with any other embodiments described herein including the embodiments described with respect to FIGS. 1-12 and 14-21 provided herein. As shown in the FIG. 13, the vial coupling member 102 may be physically separated from the fluid transfer member 104 at the first disengaging section 108. When the vial coupling member 102 is physically separated from the fluid transfer member 104 at the first disengaging section 108, the lumen of the first vial penetrator 316 and the lumen of the first fluid pathway 320 are sealed from exposure to the ambient environment 50 as well as from exposure to each other. Similarly, when the vial coupling member 102 is physically separated from the fluid transfer member 104 at the first disengaging section 108, the lumen of the second vial penetrator 318 and the lumen of the second fluid pathway 322 are sealed from exposure to the ambient environment 50 as well as from exposure to each other. This may allow a vial 5 that is coupled to the vial coupling member 102 (as discussed herein) to be stored together without taking up additional storage space that may result if the fluid transfer member 104 or the fluid transfer member 104 and the fluid retaining member 106 were coupled to the vial coupling member 102. Further, after the vial coupling member 102 is physically separated from the fluid transfer member 104 at the first disengaging section 108, a cavity 360 of the fluid retaining member 106 may be exposed to a needle or spike accessing fluid 45 in the cavity 360 without exposing a vial 5 coupled to the vial coupling member 102 to contaminants that may be present with the needle or spike.

The fluid transfer member 104 may be physically separated from the fluid retaining member 106 at the second disengaging section 110. When the fluid transfer member 104 is physically separated from the fluid retaining member 106 at the second disengaging section 110, the lumen of the first fluid pathway 320 and the lumen of the first fluid pathway 356 are sealed from exposure to the ambient environment 50 as well as from exposure to each other. Similarly, when the fluid transfer member 104 is physically separated from the fluid retaining member 106 at the second disengaging section 110, the lumen of the second fluid pathway 322 and the lumen of the second fluid pathway 358 are sealed from exposure to the ambient environment 50 as well as from exposure to each other. This may allow one or more containers 354 of the fluid retaining member 104 to be stored without taking up additional storage space that may result if the fluid transfer member 104 or the fluid transfer member 104 and the vial coupling member 102 were coupled to the fluid retaining member 106. Further, after the fluid retaining member 106 is physically separated from the fluid transfer member 104 at the second disengaging section 110, a cavity 360 of the fluid retaining member 106 may be exposed to a needle or spike accessing fluid 45 in the cavity 360 without exposing a vial 5 coupled to the vial coupling member 102 to contaminants that may be present with the needle or spike.

Figure 14:
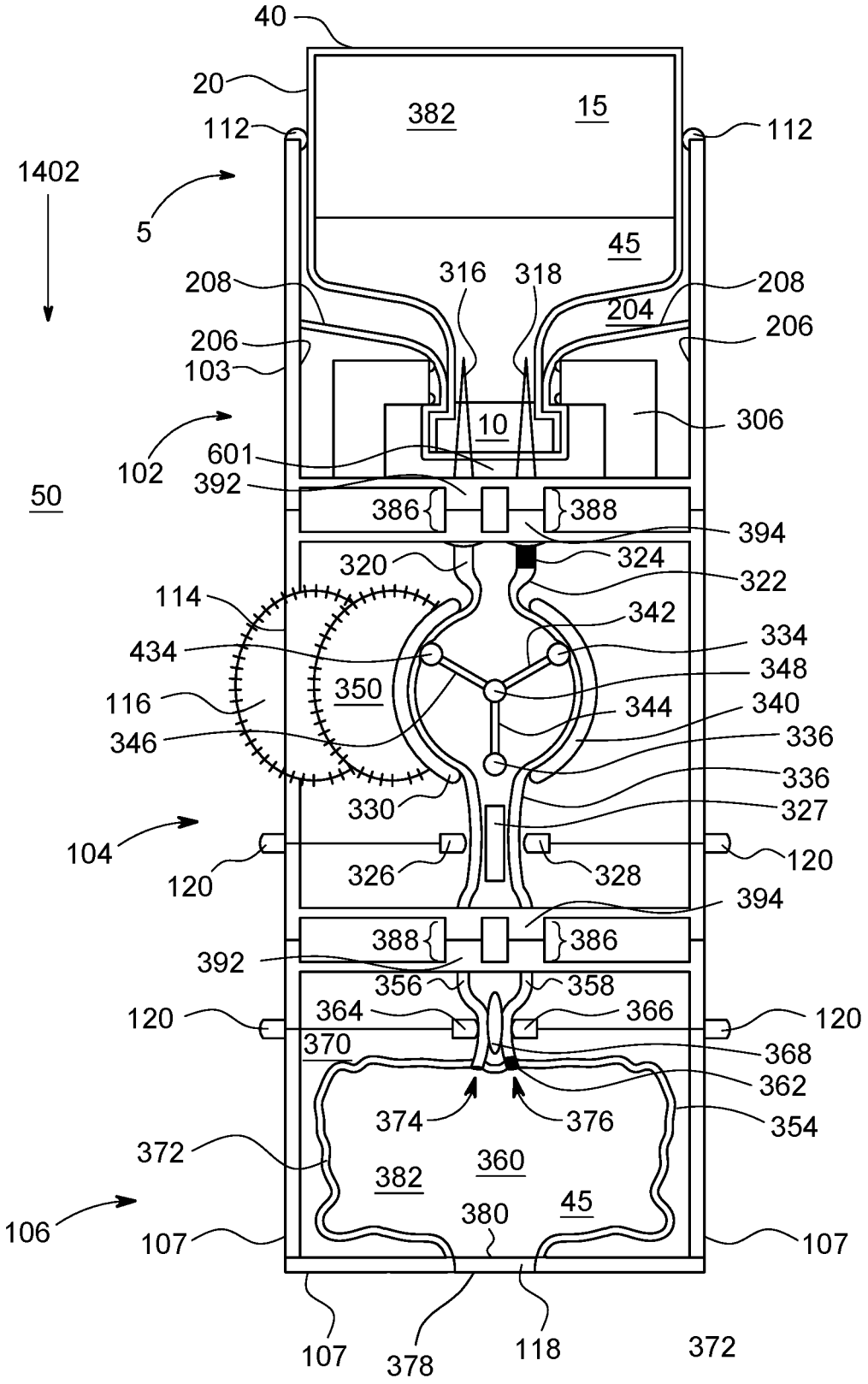
FIG. 14 illustrates an example embodiment of a vial coupled to the system.

FIG. 14 illustrates an example embodiment of a vial 5 coupled to the system 100. One or more of the components described herein with respect to FIG. 14 may be used with any other embodiments described herein including the embodiments described with respect to FIGS. 1-13 and 15-21 provided herein. As shown in FIG. 14, after the vial 5 is coupled to the vial coupling member 102, the system 100 may be orientated with gravity 1402 so that the fluid 45 in the vial 5 comes into contact with the first vial penetrator 316 and the second vial penetrator 318. After the fluid 45 is in contact with the first vial penetrator 316 and the second vial penetrator 318, the first fluid pathway blocker 326 and a second fluid pathway blocker 328 may be activated to permit fluid communication through the first fluid pathway 320 and the second fluid pathway 322, respectively. Similarly, after the fluid 45 is in contact with the first vial penetrator 316 and the second vial penetrator 318, the first fluid pathway blocker 364 and a second fluid pathway blocker 366 may be activated to permit fluid communication through the first fluid pathway 356 and the second fluid pathway 358, respectively. This may allow fluid to communicate from the vial 5 to the cavity 360 and from the cavity 360 to the vial 5.

Further, after the fluid 45 is in contact with the first vial penetrator 316 and the second vial penetrator 318, the pump 330 may activate or operate communicating (such as pulling) the fluid 45 from the vial 5 into the lumen of the first vial penetrator 316 through an opening of the first vial penetrator 316 and from the lumen of the first vial penetrator into the first fluid pathway 320 through lumens of the first disengaging fluid pathway member pair 386 of the first disengaging section 108. As the pump 330 activates or operates and fluid 45 is in the lumen of the first fluid pathway 320, the pump 330 may communicate (such as push) the fluid 45 from the first fluid pathway 320 into the first fluid pathway 356 through the lumens of the first disengaging fluid pathway member pair 386 of the second disengaging section 110. Fluid 45 may subsequently be communicated (such as pushed) by the pump 330 from the lumen of the first fluid pathway 356 into the cavity 360 formed by the container 354 of the fluid retaining member 106 through the opening 374.

Continuing with FIG. 14, after the vial 5 is coupled to the vial coupling member 102 and the system 100 is orientated with gravity 1402 so that the fluid 45 in the vial 5 comes into contact with the first vial penetrator 316 and the second vial penetrator 318, the pump 330 may activate or operate communicating (such as pulling) the sterile gas stored in the cavity 360 formed by the container 354 of the fluid retaining member 106 into the lumen of the second fluid pathway 358 through the opening 376. The pump 330 may also communicate (such as pull) the sterile gas from the second fluid pathway 358 into the second fluid pathway 322 through the lumens of the second disengaging fluid pathway member pair 388 of the second disengaging section 110. The sterile gas may pass through the liquid-gas separator 362 of the first fluid pathway 358 while any liquid (such as fluid 45) in the cavity 360 is retained in the cavity 360 and prevented from passing through the liquid-gas separator 362 and into the lumens of the second disengaging fluid pathway member pair 388. As the pump 330 activates or operates and the sterile gas is in the lumen of the second fluid pathway 322, the pump may communicate (such as push) the sterile gas through the lumen of the second fluid pathway 322 and into the interior space 15 of the vial 5 through the lumens of the second disengaging fluid pathway member pair 388 of the first disengaging section 108 and the lumen and open of the second vial penetrator 318. As shown in FIG. 14, the second fluid pathway 322 may include a liquid-gas separator 324 at least similar to the liquid-gas separator 362 and configured to prevent the fluid 45 in the interior space 15 of the vial 5 from communicating beyond the liquid-gas separator 324 and through the lumen of the second fluid pathway 322 towards to the cavity 360 while permitting sterile air from the cavity 360 to communicate through the liquid-gas separator 324 and into the interior space of the vial 5. While FIG. 14 illustrates that the liquid-gas separator 324 is positioned in the lumen of the second fluid pathway 322, one or more liquid-gas separators may additionally or alternatively be positioned within the lumen of the second vial penetrator 318. Sterile gas may be communicated from the cavity 360 into the interior space 15 of the vial 5 to increase or maintain pressurization in the interior space 15 of the vial 5, for example, due a loss of pressure in the interior space 15 of the vial 5 that may occur as the fluid 45 is communicated out of the vial 5.

It should be understood that the pump 330 may communicate fluid 45 from the vial 5 into the cavity 360 and sterile air from the cavity 360 into the vial 5 at the same time (for example simultaneously). Additionally or alternatively, one or more of the fluid pathway blockers may be activated to block either a lumen of a first fluid pathway or a lumen of a second fluid pathway so that when the pump 330 is activated or operating only one of fluid 45 communicating from the vial 5 to the cavity 360 or sterile gas communicating from the cavity 360 to the interior space 15 of the vial 5 occurs. In some embodiments, the system 100 may include a pump for each fluid pathway so that a first pump when activated or operating communicates fluid 45 from the vial 5 into the cavity 360 and a second pump when activated or operating communicates sterile gas from the cavity 360 into the interior space 15 of the vial 5.

After at least some of the fluid 45 is communicated from the interior space 15 of the vial 5 and into the cavity 360 via the lumens of a fluid pathway describe herein, one or more of the fluid pathway blockers (such as fluid pathway blockers 326, 328, 364, and 366) may be activated to block fluid communication through their respective fluid pathway lumens. It should be understood that while FIG. 14 illustrates particular positions of the fluid pathway blockers along the fluid pathways of the system 100, fluid pathway blockers may be positioned along other portions of the fluid pathways in addition to the illustrated fluid pathway blocks or as an alternative to the illustrated fluid pathway blockers. For example, fluid pathway blockers may be positioned along fluid pathways either up-stream, down-stream, or both of each of the disengaging fluid pathway member pairs as well as along fluid pathways either up-stream, down-stream, or both of the pump 330. One of ordinary skill in the art would understand the various positions where the fluid pathway blocks may be positioned along any of the fluid pathways described herein.

Figure 15:
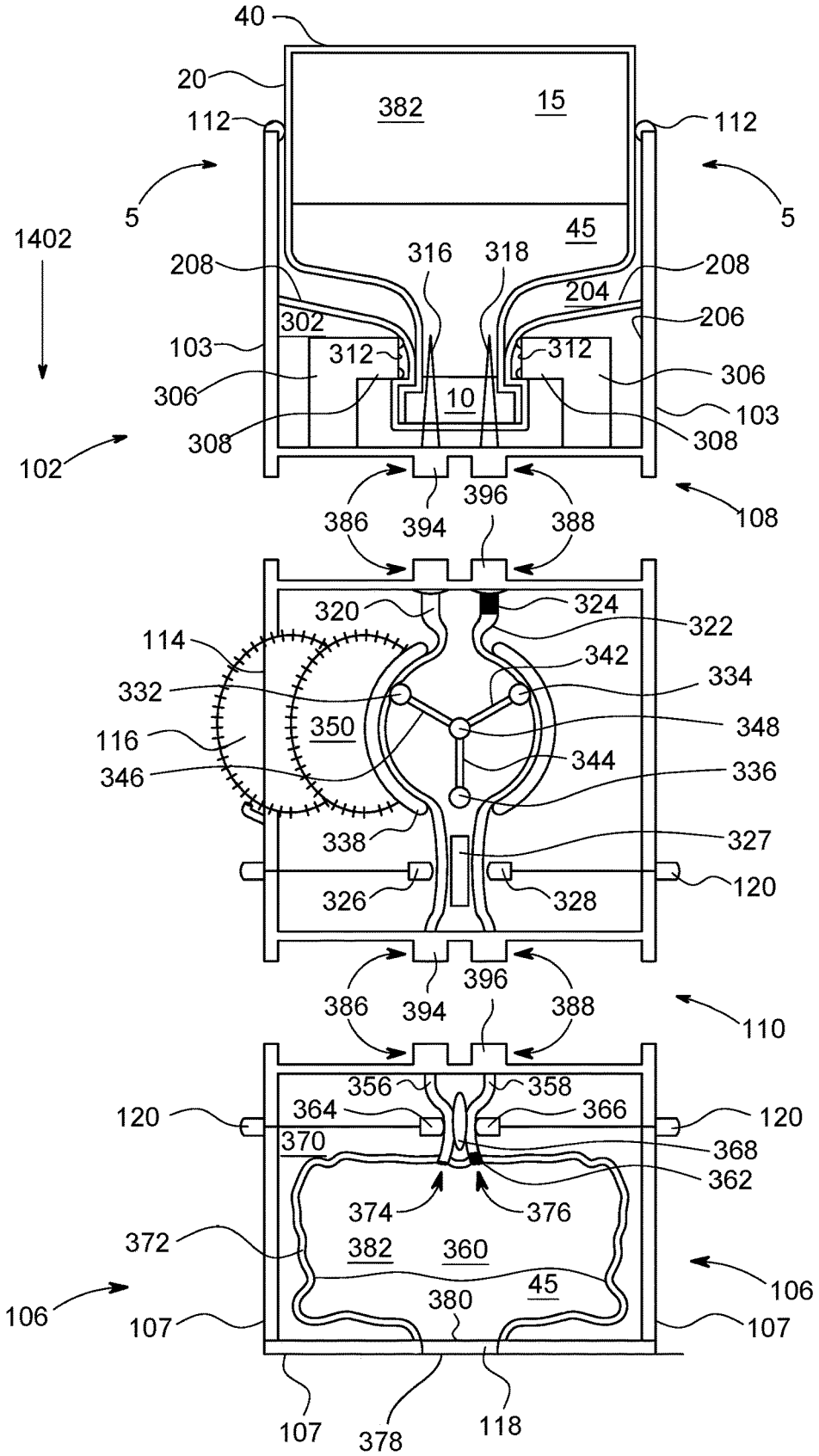
FIG. 15 illustrates an example embodiment of the system decoupled into separate members.

FIG. 15 illustrates an example embodiment of the system 100 decoupled into the separate members. One or more of the components described herein with respect to FIG. 15 may be used with any other embodiments described herein including the embodiments described with respect to FIGS. 1-14 and 16-21 provided herein. As shown in FIG. 15, after at least some of the fluid 45 is communicated from the interior space 15 of the vial 5 and into the cavity 360 via the lumens of the fluid pathways describe herein, the fluid retaining member 106 may be disengaged from or decoupled from at least one of the fluid transfer member 104 or the vial coupling member 102 at the second disengaging section 110. As discussed herein, as the fluid retaining member 106 begins to disengage from the system 100 (such as from the fluid transfer member 104), the disengaging fluid pathway pairs 386 and 388 of the second disengaging section 110 may close or block the lumens of the first fluid pathways 320 and 356 and the lumens of the second fluid pathways 322 and 358 preventing those lumens and the ambient environment 50 from exposure to each other. For example, as the fluid retaining member 106 begins to disengage from the system 100 (such as from the fluid transfer member 104), the disengaging fluid pathway pairs 386 and 388 of the second disengaging section 110 may close or block the lumens of the first fluid pathways 320 and 356 and the lumens of the second fluid pathways 322 and 358 preventing the fluid 45 from the leaving those lumens and entering the ambient environment 50 while also preventing contaminants from entering the aforementioned lumens from the ambient environment 50 contaminating the fluid 45 in the lumens, the fluid 45 in the interior space 15 of the vial 5, or the fluid 45 in the cavity 360. Subsequently, a needle or a spike may penetrate through the fluid access member 118 and extract the fluid 45 retained in the cavity 360. By separating the fluid retaining member 106 from the system 100, the fluid retaining member 106 having a smaller size than the entire system 100 may be more easily stored in a storage space of a hospital or pharmacy. Further, by separating the fluid retaining member 106 from the system 100, a needle or spike penetrating through the fluid access member 118 may completely prevent exposure of other cavities of the system 100 as well as the vial 5 to contaminants.

Also as shown in FIG. 15, after at least some of the fluid 45 is communicated from the interior space 15 of the vial 5 into the cavity 360 via the lumens of the fluid pathways described herein, the vial coupling member 102 may be disengaged from or decoupled from at least one of the fluid transfer member 104 or the fluid retaining member 106 at the first disengaging section 108. As discussed herein, as the vial coupling member 102 begins to disengage from the system 100 (such as from the fluid transfer member 104), the disengaging fluid pathway pairs 386 and 388 of the first disengaging section 108 may close or block the lumen of the first fluid pathway 320, the lumen of the first vial penetrator 316, the lumen of the second fluid pathway 322, and the lumen of the second vial penetrator 318 preventing those lumens and the ambient environment 50 from exposure to each other. For example, as the vial coupling member 102 begins to disengage from the system 100 (such as from the fluid transfer member 104), the disengaging fluid pathway pairs 386 and 388 of the first disengaging section 108 may close or block the lumen of the first fluid pathways 320, the lumen of the first vial penetrator 316, the lumen of the second fluid pathway 322, and the lumen of the second vial penetrator 318 preventing the fluid 45 from the leaving those lumens and entering the ambient environment 50 while also preventing contaminants from entering the aforementioned lumens from the ambient environment 50 contaminating the fluid 45 in the lumens, the fluid 45 in the interior space 15 of the vial 5, or the fluid 45 in the cavity 360. Subsequently, the vial 5 may be decoupled from the vial coupling member 102 so that a needle or a spike may extract the remaining fluid 45 in the interior space 15 of the vial 5 while the cavity 360 of the fluid retaining member 106 stores the portion of the fluid 45 for the period of time without being exposed to contaminants and safe use by a patient. By separating the vial coupling member 106 coupled with the vial 5 from the system 100, the vial 5 may be stored for the period of time without exposure to contaminants from the ambient environment 50. After storage of the vial coupling member 102 coupled with the vial 5 for the period of time, the vial 5 may be decoupled from the vial coupling member 102 so that a needle or spike may penetrate the vial septum 10 of the vial to access the remaining fluid 45 in the vial 5 for safe use of the fluid 45 on a patient.

Figure 16:
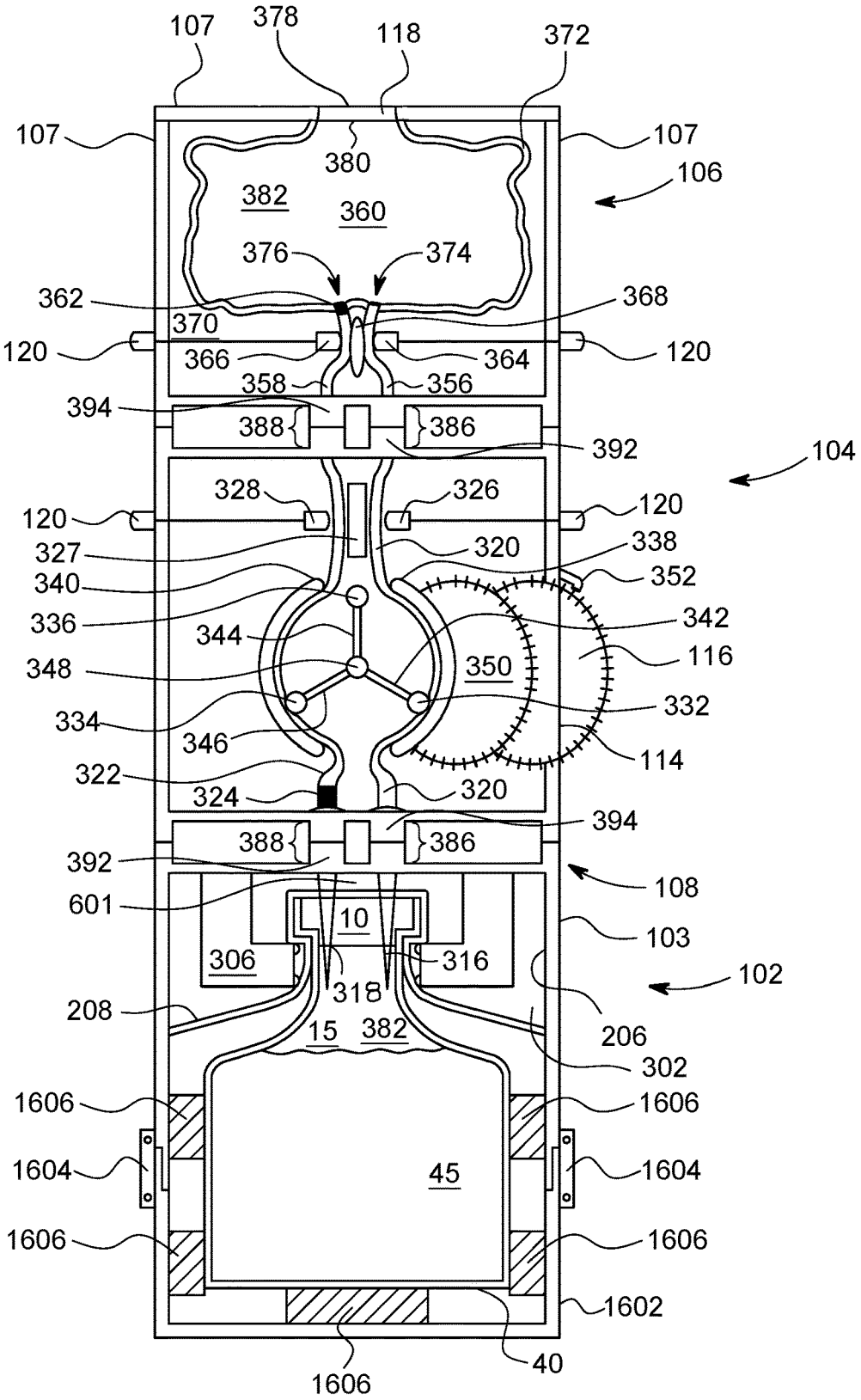
FIG. 16 illustrates an example embodiment of the system including a vial enclosing member.

FIG. 16 illustrates an example embodiment of the system 100 including a vial enclosing member. One or more of the components described herein with respect to FIG. 16 may be used with any other embodiments described herein including the embodiments described with respect to FIGS. 1-15 and 17-21 provided herein. As shown in FIG. 16, the system 100 may include a vial enclosing member 1602. The vial enclosing member 1602 may be configured to form a seal around the vial 5 after the vial 5 is coupled to a vial coupling member 102. The vial enclosing member 1602 may seal the vial from the ambient environment 50 after the vial 5 is coupled to the vial coupling member 102. In the example embodiment of FIG. 16, the vial coupling member 102 may not include the vial coupling member lip 112. Instead, the vial coupling member 102 may include a seal 1606 that seals the top of the vial 5 from the ambient environment 5 upon coupling the vial 5 with the vial coupling member 102. The seal 1606 may also conform to the exterior surface of the vial 5 so that vial 5 is securely retained by the vial coupling member 102. Similarly, the vial enclosing member 1602 may include one or more seals 1606 to conform to the exterior surface of the vial 5 so that the vial 5 is securely and safely retained within the vial enclosing member 1602 and the vial coupling member 102. The vial enclosing member 1602 may be sealingly coupled to the vial coupling member 102 using one or more locking mechanisms 1604. In some embodiments, the vial enclosing member 1602 may additionally or alternatively be sealingly coupled to the vial coupling member 102 using a threaded connection. One of ordinary skill in the art would be able to identify the many various types of mechanisms that could sealingly couple the vial enclosing member 1602 to the vial coupling member 102.

Figure 17:
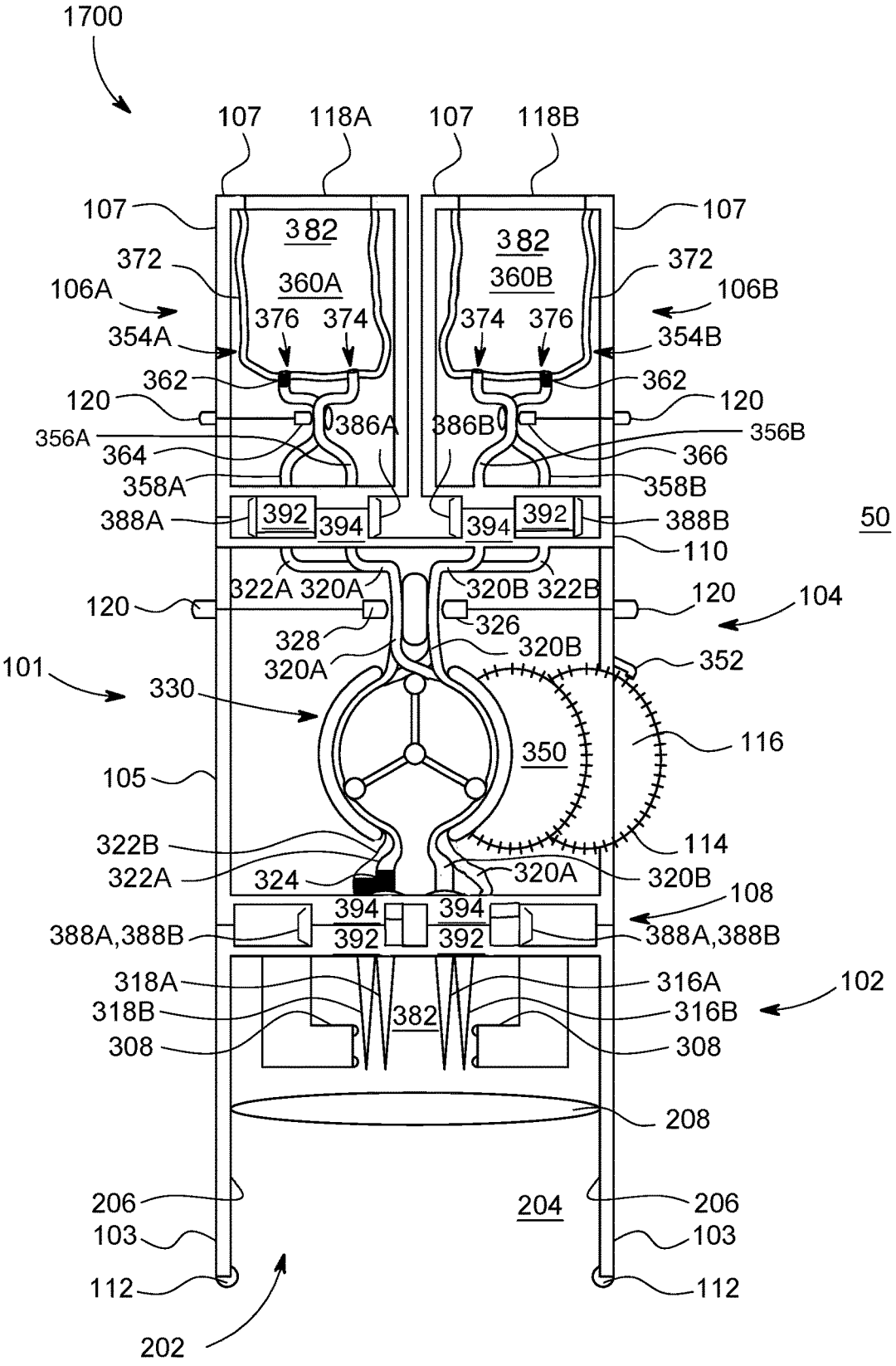
FIG. 17 illustrates an example embodiment of a system including at least two fluid retaining members.

FIG. 17 illustrates an example embodiment of a system 1700 including at least two fluid retaining members. One or more of the components described herein with respect to FIG. 17 may be used with any other embodiments described herein including the embodiments described with respect to FIGS. 1-16 and 18-21 provided herein. As shown in FIG. 17, the system 1700 may include at least two fluid retaining members, such as a first fluid retaining member 106A and a second fluid retaining member 106B. The vial coupling member 102 of the system 1700 may include two first vial penetrators 316A and 316B and two second vial penetrators 318A and 318B. The two first vial penetrators 316A and 316B and the two second vial penetrators 318A and 318B may be configured to penetrate a septum of a vial and extend into an interior space of the vial as discussed herein with respect to at least the first vial penetrator 316 and the second vial penetrator 318.

Similar to the system 100 of FIGS. 1-16, an opening and a lumen of the first vial penetrator 316A may provide fluid communication between the interior space 15 of the vial 5 and the cavity 360A formed by the container 354A of the first fluid retaining member 106A through the lumens of the first disengaging fluid pathway member pair 386A of the first disengaging section 108, the lumen of the first fluid pathway 320A, the lumens of the first disengaging fluid pathway member pair 386A of the second disengaging section 110, the lumen of the first fluid pathway 356A, and the opening 374 of the first fluid retaining member 106A. Further, similar to the system 100 of FIGS. 1-16, an opening and a lumen of the first vial penetrator 316B may provide fluid communication between the interior space 15 of the vial 5 and the cavity 360B formed by the container 354B of the second fluid retaining member 106B through the lumens of the first disengaging fluid pathway member pair 386B of the first disengaging section 108, the lumen of the first fluid pathway 320B, the lumens of the first disengaging fluid pathway member pair 386B of the second disengaging section 110, the lumen of the first fluid pathway 356B, and the opening 374 of the second fluid retaining member 106B.

Similar to the system 100 of FIGS. 1-16, an opening and a lumen of the second vial penetrator 318A may provide fluid communication between the interior space 15 of the vial 5 and the cavity 360A formed by the container 354A of the first fluid retaining member 106A through the lumens of the second disengaging fluid pathway member pair 388A of the first disengaging section 108, the liquid-gas separator 324, the lumen of the second fluid pathway 322A, the lumens of the second disengaging fluid pathway member pair 388A of the second disengaging section 110, the lumen of the second fluid pathway 358A, the liquid-gas separator 362, and the opening 376 of the first fluid retaining member 106A. Further, similar to the system 100 of FIGS. 1-16, an opening and a lumen of the second vial penetrator 318B may provide fluid communication between the interior space 15 of the vial 5 and the cavity 360B formed by the container 354B of the second fluid retaining member 106B through the lumens of the second disengaging fluid pathway member pair 388B of the first disengaging section 108, the liquid-gas separator 324, the lumen of the second fluid pathway 322B, the lumens of the second disengaging fluid pathway member pair 388B of the second disengaging section 110, the lumen of the second fluid pathway 358B, the liquid-gas separator 362, and the opening 376 of the second fluid retaining member 106B. In some embodiments, the interior space of the vial may receive sterile gas from the cavity 360A of the first fluid retaining member 106A and the cavity 360B of the second fluid retaining member 106B to regulate the pressure in the interior space of the vial.

In various embodiments, the system 1700 be configured to extract a portion of the fluid 45 from the vial 5 and retain the portion of the fluid 45 in the cavity 360A formed the container 354A of the first fluid retaining member 106A and extract a remaining portion of the fluid 45 from the vial 5 and retain the remaining portion of the fluid 45 in the cavity 360B formed by the container 354B of the second fluid retaining member 106B. For example, after a vial 5 is coupled to the vial coupling member 102, a portion of the fluid 45 from the vial 5 may be communicated from the interior space 15 of the vial 5 through first fluid pathways 320A and 356A and into the cavity 360A. Sterile gas from the cavity 360A may be communicated through the second fluid pathways 358A and 322A and into the interior space 15 of the vial 5 to regulate the pressure in the interior space 15 of the vial 5 due to the extraction of the portion of the fluid 45 communicated out of the vial 5. Subsequently, the remaining portion of the fluid 45 from the vial 5 may be communicated from the interior space 15 of the vial 5 through first fluid pathways 320B and 356B and into the cavity 360B. Sterile gas from the cavity 360B may be communicated through the second fluid pathways 358B and 322B and into the interior space 15 of the vial 5 to regulate the pressure in the interior space 15 of the vial 5 due to the extraction of the remaining portion of the fluid 45 communicated out of the vial 5. In addition, as discussed herein liquid-gas separators 324 and 362 may permit the sterile gas to pass through them while prevent the fluid 45 from passing through them. The liquid-gas separators 362 may prevent recirculation of the fluid 45 back into the vial 5 after being communicated into the cavities 360A and 360B. The liquid-gas separators 324 may prevent the fluid 45 from communicating into the second fluid pathways 322A, 322B, 358A, and 358B.

As discussed herein, the fluid 45 may be communicated from the interior space 15 of the vial 5 by turning the device up-side-down so that gravity pulls the fluid 45 from the vial 5 and into the cavities 360A and 360B. In this case, fluid pathway blockers, as discussed herein, may be activated to close or block lumens that provide fluid communication between the cavity 360B and the vial 5 while fluid communication is permitted through the lumens that provide fluid communication between the cavity 360A and the vial 5. Thus, a portion of the fluid 45 from the vial 5 may be communicated into the cavity 360A while sterile gas in the cavity 360A may be communicated into the interior space 15 of the vial 5. Subsequently, fluid pathway blockers, as discussed herein, may be activated to close or block lumens that provide fluid communication between the cavity 360A and the vial 5 while fluid communication is permitted through the lumens that provide fluid communication between the cavity 360B and the vial 5. Thus, a remaining portion of the fluid 45 from the vial 5 may be communicated into the cavity 360B while sterile gas in the cavity 360B may be communicated into the interior space 15 of the vial 5.

Additionally or alternatively, a pump 330 may facilitate fluid communication between the cavity 360A and the interior space 15 of the vial 5 as well as fluid communication between the cavity 360B and the interior space 15 of the vial 5 as discussed herein. In various embodiments, the system 1700 may include at least two pumps so that a first pump may facilitate fluid communication between the cavity 360A and the interior space 15 of the vial 5 while the second pump may facilitate fluid communication between the cavity 360B and the interior space 15 of the vial 5. Thus, the first pump may activate or operate to facilitate fluid communication of the portion of the fluid 45 from the vial 5 and into the cavity 360A while communicating sterile gas from the cavity 360A into the interior space 15 of the vial 5. Similarly, the second pump may activate or operate to facilitate fluid communication of the remaining portion of the fluid 45 from the vial 5 and into the cavity 360B while communicating sterile gas from the cavity 360B into the interior space 15 of the vial 5.

After the cavity 360A formed by the container 354A of the first fluid retaining member 106A retains the portion of the fluid 45 from the vial 5 and the cavity 360B formed by the container 354B of the second fluid retaining member 106B retains the remaining portion of the fluid 45 from the vial 5, each of the first fluid retaining member 106A and the second fluid retaining member 106A may be individually disengaged or decoupled from the system 1700 (such as at least one of the fluid transfer member 104 or the vial coupling member 102) at the second disengaging section 110 as similarly described herein with respect to the system 100 of FIGS. 1-16. After the first fluid retaining member 106A is disengaged from the system 1700, a needle or a spike may penetrate the fluid access member 118 of the first fluid retaining member 106A to extract the portion of the fluid 45 from the cavity 360A. After the second fluid retaining member 106B is disengaged from the system 1700, the second fluid retaining member 106B may be stored for the period of time before a needle or a spike penetrates the fluid access member 118 of the second fluid retaining member 106B. Because the cavity 360A and the cavity 360B are completely sealed from each other and the ambient environment 50 after the first fluid retaining member 106A and/or the second fluid retaining member 106 disengage from the system 1700, when the needle or spike penetrate the fluid access member 118 of the first fluid retaining member 106A, the cavity 360B of the second fluid retaining member 106B remains unexposed to contaminants from the ambient environment 50.

In some embodiments, the cavity 360A formed by the container 354A of the first fluid retaining member 106A may contain fluid to reconstitute a drug in the interior space 15 of the vial 5. After the vial 5 is coupled to the vial coupling member 102, the reconstitution fluid within the cavity 360A may be communicated into the vial 5 through the first fluid pathways 356A and 320A as previously discussed herein. Air within the vial 5 may be communicated from the interior space 15 of the vial 5 into the cavity 360A through the second fluid pathways 322A and 358A as discussed herein. After the drug in the vial 5 is reconstituted to form the fluid 45, a portion of the fluid 45 may be extracted from the vial 5 through the first fluid pathways 320B and 356B and into the cavity 360B formed by the container 354B of the second fluid retaining member 106B. Subsequently, the second fluid retaining member 106B may disengage from the system 1700 as discussed herein so that the second fluid retaining member 106B may be stored for the period of time and/or penetrated through the fluid access member 118 of the second fluid retaining member 106B to safely and sterily extract the portion of the fluid 45. In some embodiments, the vial 5 may be decoupled from the vial coupling member 102 so that the remaining fluid 45 may be extracted from the vial 5 for safe use by a patient. Alternatively, for example, when substantially all of the reconstitution fluid is communicated out of the cavity 360A of the first fluid retaining member 106, the remaining fluid 45 from the vial 5 may be communicated into the cavity 360A of the first fluid retaining member 106A as discussed herein. Subsequently, the first fluid retaining member 106A may be disengaged from the system 1700 and stored for the period of time and/or penetrated through the fluid access member 118 of the first fluid retaining member 106A to safely and sterily extract the remaining portion of the fluid 45.

Figure 18:
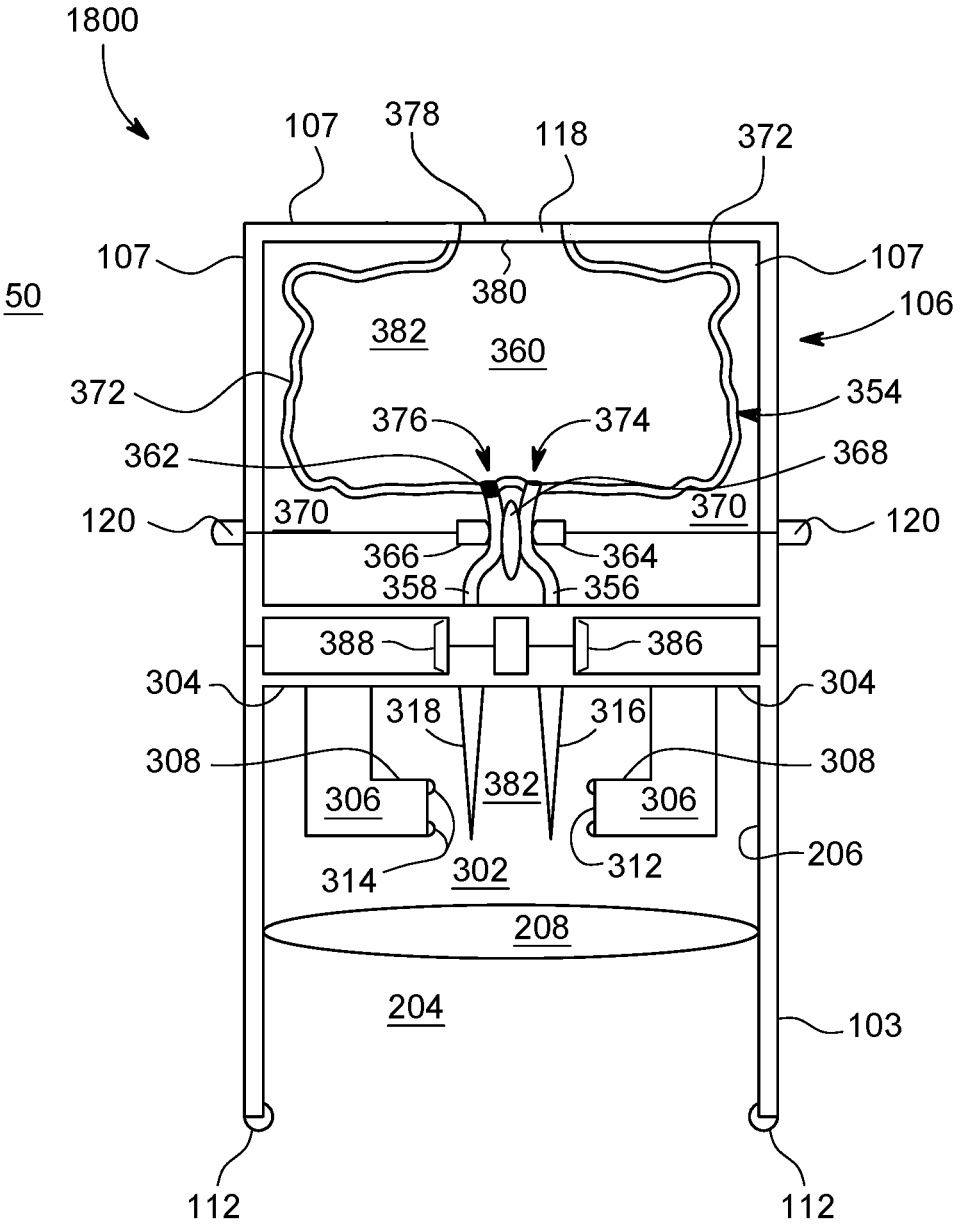
FIG. 18 illustrates an example system according to this disclosure.

FIG. 18 illustrates an example system 1800 according to this disclosure. One or more of the components described herein with respect to FIG. 18 may be used with any other embodiments described herein including the embodiments described with respect to FIGS. 1-17 and 19-21 provided herein. As shown in the FIG. 18, the system 1800 includes the vial coupling member 102 and the fluid retaining member 106, but does not include the fluid transfer member 104. Thus, after a vial 5 couples with the vial coupling member 102 as discussed herein, the system 1800 may be turned up-side-down and may rely on gravity to communicate fluid 45 from the vial 5 into the cavity 360 formed by the container 354 of the fluid retaining member 106.

Figure 19:
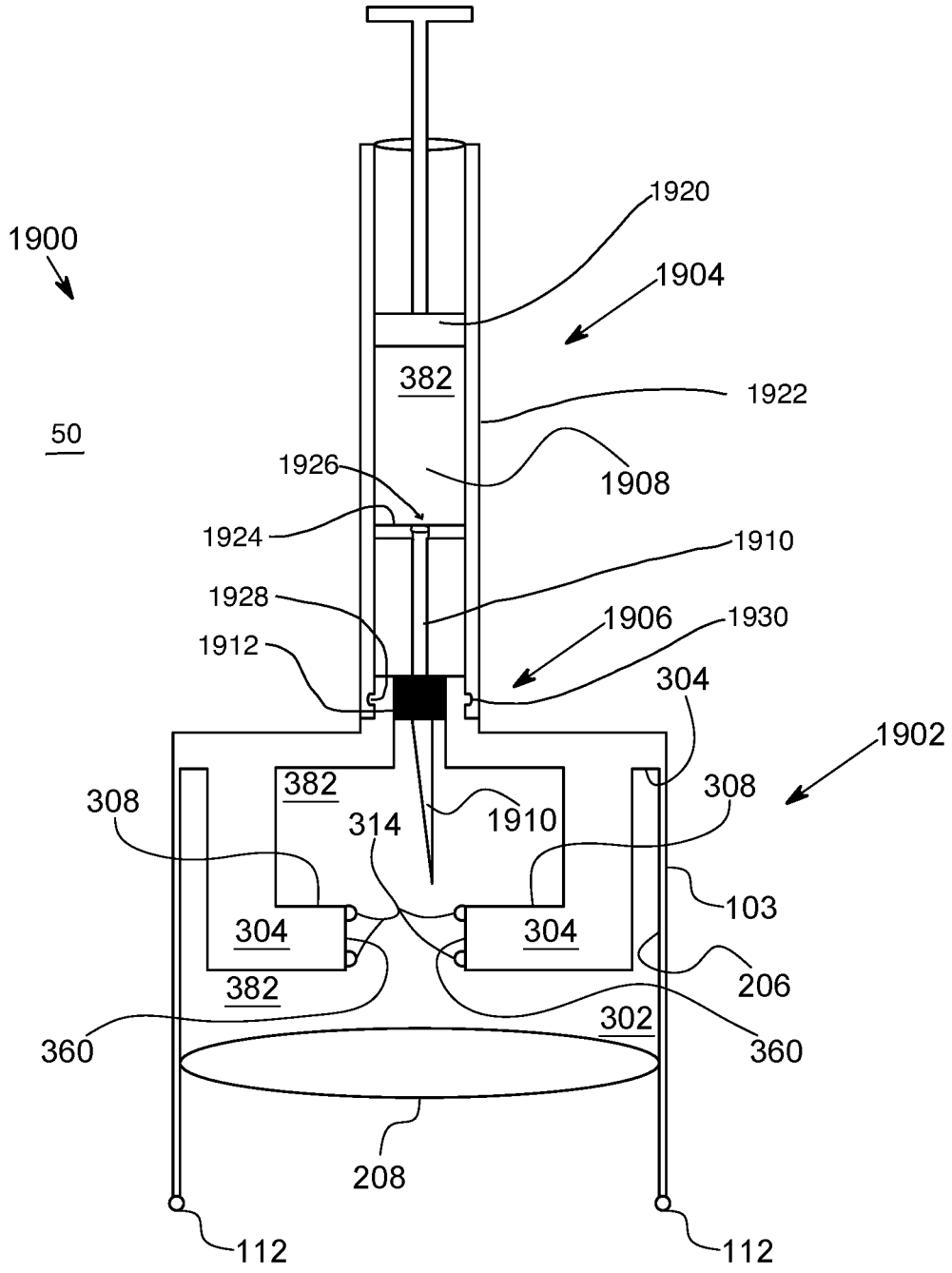
FIG. 19 illustrates an example system according to this disclosure.

FIG. 19 illustrates an example system 1900 according to this disclosure. One or more of the components described herein with respect to FIG. 19 may be used with any other embodiments described herein including the embodiments described with respect to FIGS. 1-18, 20, and 21 provided herein. At least similar to the system 100, 1700 and 1800 described herein, the system 1900 may be used for extending the useable life or beyond use date of fluid 45 in a vial 5 after a least a portion of the fluid 45 is extracted from the vial 5. As shown in the FIG. 19, the system 1900 may include a vial coupling member 1902 and a fluid extracting member 1904 sealingly coupled to the vial coupling member 1902 at the disengaging section 1906.

The fluid extracting member 1904 may be formed by a cylinder or a housing 1922. The vial coupling member 1902 may be the same or similar to the vial coupling member 102 described herein. A cavity 1908 containing a sterile gas may be formed by a piton 1920, the housing 1922, and a static wall 1924 providing an opening 1926 to the lumen of a vial penetrator, needle, or spike 1910. The cavity 1908 may be in fluid communication with a cavity 302 of the vial coupling member 1902 through the opening 1926 and lumen of the vial penetrator penetrating through the septum 1912 of the disengaging section 1906. The cavity 1908 and the cavity 302 through the opening 1926 and lumen of the vial penetrator 1910 may form a sealed and sterile environment 382 as described herein.

The piston 1920 may be initially positioned in a withdrawn state providing the cavity 1908 with a first volume. When a vial 5 is coupled to the vial coupling member 1902 as discussed herein at least with respect to the vial coupling member 102, the piston 1920 may be compressed to reduce the volume of the cavity 1908 to a second volume pushing the sterile gas in the cavity 1908 into the interior space 15 of the vial 5. Subsequently, the piston 1920 may be drawn out increasing the volume of the cavity 1908 towards the first volume. As the piston 1920 is drawn out, fluid 45 from the vial 5 may be received in the cavity 1908. After the fluid 45 is received by the cavity 1908, indentations 1928 in the housing 1922 may disengage from the protrusions 1930 of the vial coupling member 1902 so that the fluid extracting member 1904 may disengaged from the vial coupling member 1902. As the fluid extracting member 1904 disengages from the vial coupling member 1902, the vial penetrator 1910 may withdraw from the fluid communication with the interior space 15 of the vial 5 as well as withdraw from the septum 1912. The septum 1912 closes as the vial penetrator 1920 withdraws from the septum 1912 keeping the cavity 302 unexposed to contaminants from the ambient environment 50. Subsequently, at least one of the fluid extracting member 1904 or the vial coupling member 1902 containing fluid 45 may be stored for use by a patient.

Figure 20:
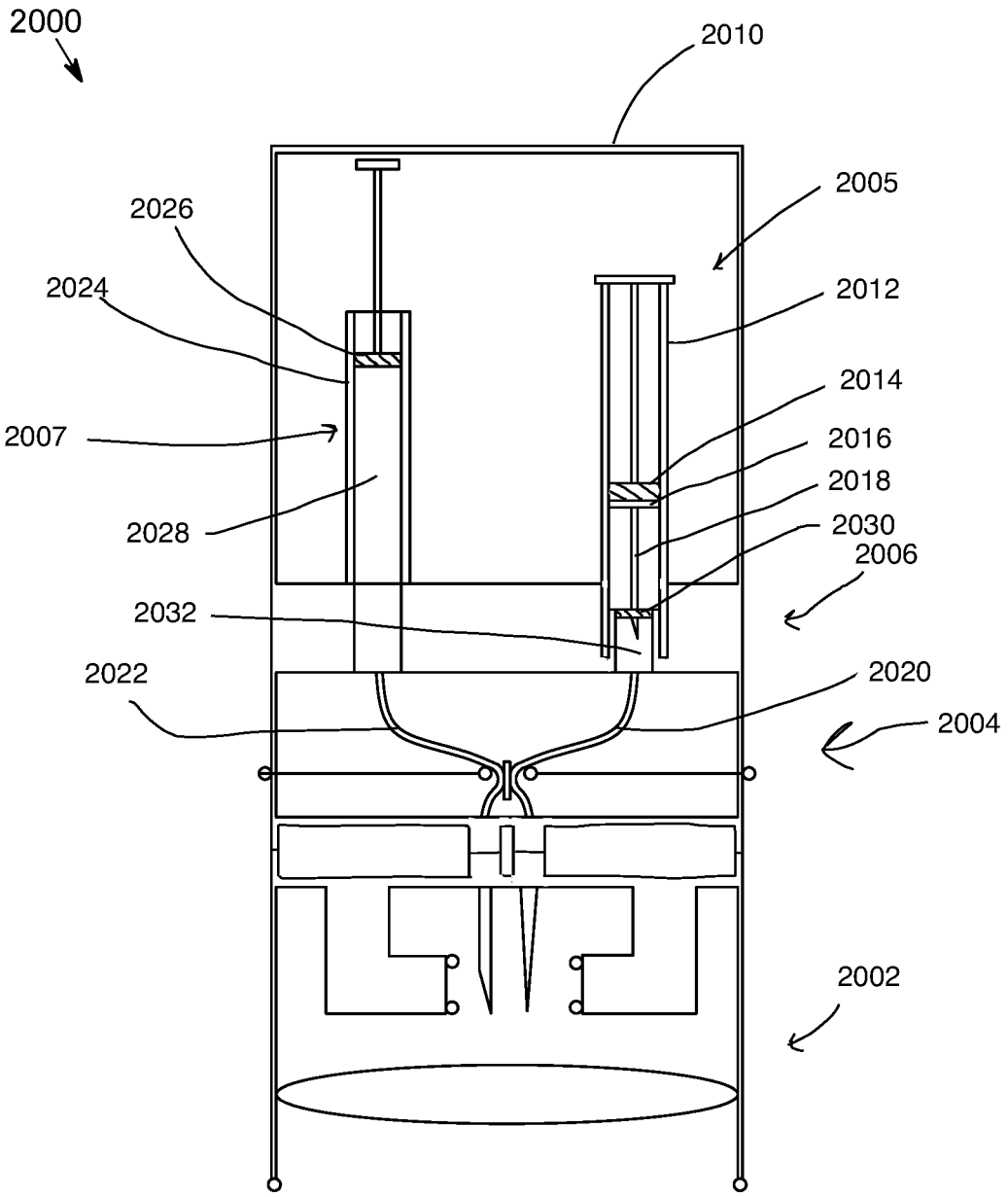
FIG. 20 illustrates an example system according to this disclosure.

FIG. 20 illustrates an example system 2000 according to this disclosure. One or more of the components described herein with respect to FIG. 20 may be used with any other embodiments described herein including the embodiments described with respect to FIGS. 1-19 and 21 provided herein. At least similar to the system 100, 1700, 1800, and 1900 described herein, the system 2000 may be used for extending the useable life or beyond use date of fluid 45 in a vial 5 after a least a portion of the fluid 45 is extracted from the vial 5. As shown in the FIG. 20, the system 2000 may include a vial coupling member 2002, a fluid transfer member 2004, a fluid extracting member 2005 sealingly coupled to the fluid transfer member 2004 at disengaging section 2006, and vial pressurization member 2007 sealingly coupled to the fluid transfer member 2004. It should be understood that the vial coupling member 2002 may be at least similar to the vial coupling member 102 described herein. It should also be understood that the fluid transfer member 2004 may be at least similar to the fluid transfer member 104 described herein. For example, a first fluid pathway 2020 forming a first lumens may provide fluid communication between the vial coupling member 2004 and a fluid extracting member 2006. As another example, a second fluid pathway 2022 forming a second lumen may provide fluid communication between the vial coupling member 2004 and the vial pressurization member 2007. In some embodiments, a lid 2010 may be positioned over the fluid extraction member 205 and the vial pressurization member 2007 and coupled to the fluid transfer member 2006. The lid 2010 may be decoupled from the fluid transfer member 2006 and removed from the system 2000 for operation of the system 2000.

The vial pressurization member 2007 may include a cylinder or housing 2024 and a piston 2026 forming a cavity 2028. The cavity 2028 may include a sterile gas. The cavity 2028 may be in fluid communication with the vial coupling member 2002 through the second lumen formed by the second fluid pathway 2022. The piston 2026 may be configured to sealingly slide along an interior surface of the housing 2024. When a vial 5 is coupled to the vial coupling member 2002 as discussed herein at least with respect to the vial coupling member 102, the piston 2026 may be compressed towards the fluid transfer member 2006 reducing the volume of the cavity 2028. As the volume of the cavity 2028 is reduced, the sterile gas in the cavity 2028 is communicated through the second lumen of the second fluid pathway 2022 and into the vial coupling member 2002. The vial pressurization member 2007 may be used to maintain pressurization of an interior space 15 of the vial 5 when fluid is extracted from the interior space 15 of the vial 5.

The fluid extracting member 2005 may be formed by a cylinder or a housing 2012 and may include a piston 2014, a static wall 2016, and a penetrator 2018. The penetrator 2018 may extend through a septum 2030 and into a cavity 2032 in fluid communication with the first lumen of the first fluid pathway 2020 providing fluid communication between the first lumen of the first fluid pathway 2020 and a lumen of the penetrator 2018 through an opening in the penetrator 2018. The piston 2014 may be in fluid communication with the lumen of the penetrator 2018 through an opening in the static wall 2016. The piston 2014 may be configured to sealingly slide along an interior surface of the housing 2012. The piston 2014 may be initially positioned in a compressed state against the static wall 2016. When a vial 5 is coupled to the vial coupling member 2002 as discussed herein at least with respect to the vial coupling member 102, the piston 2014 may be withdrawn from the static wall 2016 creating a cavity within the housing 2012. The creation of the cavity 2012 within the housing 2012 causes fluid communication from the vial coupling member 2002 through the first lumen of the first fluid pathway 2020 and into cavity created in the housing 2012. Thus, fluid 45 from the interior space 15 of the vial 5 may be communicated into the cavity created in the housing 2012.

After the fluid 45 is received by the cavity created in the housing 2012, the fluid extracting member 2005 may disengage from the fluid transfer member 2006. When the fluid extracting member 2005 disengages from the fluid transfer member 2006, the penetrator 2018 may withdraw from the septum 2030. The septum 2030 may close as the penetrator 2018 withdraws from the septum 1912 keeping the cavity 2032 unexposed to contaminants from the ambient environment 50. Subsequently, at least one of the fluid extracting member 2005 or the vial coupling member 2002 containing fluid 45 may be stored for use by a patient.

Figure 21:
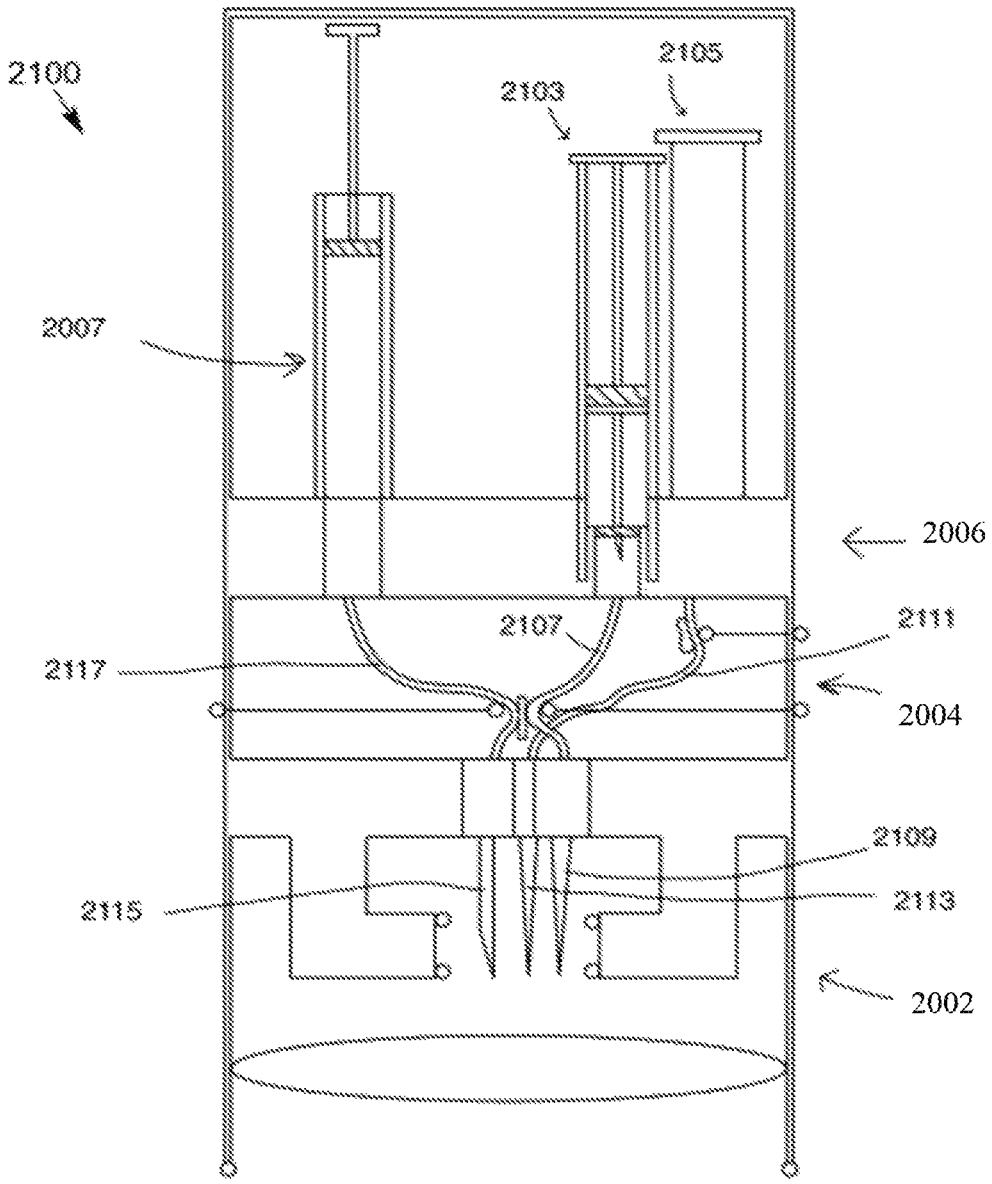
FIG. 21 illustrates an example system according to this disclosure.

FIG. 21 illustrates an example system 2100 according to this disclosure. One or more of the components described herein with respect to FIG. 21 may be used with any other embodiments described herein including the embodiments described with respect to FIGS. 1-20 provided herein. At least similar to the system 100, 1700, 1800, 1900, and 2000 described herein, the system 2100 may be used for extending the useable life or beyond use date of fluid 45 in a vial 5 after a least a portion of the fluid 45 is extracted from the vial 5. As shown in FIG. 21, the system 2100 may include the same or similar features of the system 2000 illustrated in FIG. 20. The system 2100 may include two fluid extracting members, a first fluid extracting member 2103 and a second fluid extracting member 2105. The first fluid extracting member 2103 and the second fluid extracting member 2105 may include the same or similar features and operate in the same or similar way as the fluid extracting member 2005 of FIG. 20. The first fluid extracting member 2103 may be in fluid communication with a first lumen formed by a first fluid pathway 2107 and a lumen of a first vial penetrator 2109. The second fluid extracting member 2105 may be in fluid communication with a second lumen formed by a second fluid pathway 2111 and a lumen of a second vial penetrator 2113. The vial pressurization member 2007 may be in fluid communication with a third lumen formed by a third fluid pathway 2115 and a lumen of a third vial penetrator 2117. In the example embodiment of FIG. 21, the first fluid extracting member 2103 may be configured to extract a portion of the fluid 45 from the vial 5 when the vial 5 is coupled to the vial coupling member 2002. Subsequently, the second fluid extracting member 2105 may be configured to extract a remaining portion of the fluid 45 from the vial 5 while the vial 5 is still coupled to the vial coupling member 2002.

In some embodiments, an apparatus to preserve liquid from a medicine vial is provided. The apparatus may include a container forming a cavity. In some embodiments, the container may be a variable volume container. The apparatus may also include a first fluid pathway forming a lumen that is in fluid communication with the cavity. The apparatus may further include a second fluid pathway forming a second lumen that is also fluid communication with the cavity. The cavity may be configured to receive the liquid from the medicine vial through the first lumen. The cavity may also be configured to distribute a gas that is to be received by the medicine vial through the second lumen. In some embodiments, the cavity may be configured to receive the liquid from the medicine vial through the first lumen at the same time that the cavity distributes the gas into the second lumen.

In some embodiments, a method of manufacturing an apparatus to preserve liquid from a medicine vial is provided. The method may include forming a container that forms a cavity. The method may also include fluidly coupling a lumen of a first fluid pathway to the cavity. The method may further include fluidly coupling a lumen of a second fluid pathway to the same cavity. In some embodiments, the method may include configuring the cavity to receive liquid from a medicine vial through the lumen of the first fluid pathway and to distribute a gas that is to be received by the medicine vial through the lumen of the second fluid pathway.

In some embodiments, a method of manufacturing an apparatus for disengaging a vial coupling member from a container forming a cavity is provided. The method may include fixedly coupling an upper member of the apparatus to a first fluid pathway and establishing fluid communication between an upper member lumen formed by the upper member and a first lumen formed by the first fluid pathway. The method may also include fixedly coupling a lower member of the apparatus to a second fluid pathway and placing the lower member in contact with the upper member. The method may further include establishing fluid communication between a lower member lumen formed by the lower member and a second lumen formed by the second fluid pathway. In addition, the method may include providing a closing member forming a closing member lumen and establishing fluid communication between the closing member lumen, the first lumen, and the second lumen. In some embodiments, the closing member may be configured to transition from an open position to a closed position when the upper member moves out of contact with the lower member. When the closing member is in the open position, the closing member lumen may provide fluid communication between the upper member lumen and the lower member lumen. When the closing member is in the closed position, at least one of the first lumen or the second lumen is sealed. The method may also include providing a securing member that holds the closing member in the closed position when the upper member moves into contact with the lower member after the upper member moves out of contact with the lower member.

In some embodiments, a method of manufacturing an apparatus to preserve liquid from a medicine vial is provided. The method may include providing a vial coupling member forming a vial coupling member cavity. The vial coupling member may be configured to receive a medicine vial to extract fluid from the medicine vial. The method may also include forming a container that forms a cavity. The method may further include establishing fluid communication between the vial coupling member cavity and the cavity using a lumen of a first fluid pathway. In addition, the method may include establishing fluid communication between the vial coupling member cavity and the cavity using a lumen of a second fluid pathway. The method may include providing a disengaging member that may be configured to permit the container to disengage from the first fluid pathway and the second fluid pathway while permanently sealing the first lumen and the second lumen to prevent fluid communication between at least one of the cavity and an ambient environment or the vial coupling member cavity and the ambient environment.

In some embodiments, an apparatus to preserve liquid from a medicine vial includes a container forming a cavity. The cavity may be configured to receive the liquid from the medicine vial through the first lumen at the same time that the cavity distributes a gas into the second lumen. In some embodiments, the container may be a variable volume container such as a flexible bag or a bellows. The apparatus may also include a first fluid pathway forming a first lumen that is in fluid communication with the cavity and a second fluid pathway forming a second lumen that is in fluid communication with the cavity. The apparatus may include a vial coupling member including a housing and a flexible membrane forming a vial coupling member cavity. A first vial penetrator may be disposed in the vial coupling member cavity, wherein the first vial penetrator forms a first vial penetrator lumen providing fluid communication between the vial coupling member cavity and the first lumen. A second vial penetrator may be disposed in the vial coupling member cavity. The second vial penetrator may form a second vial penetrator lumen providing fluid communication between the vial coupling member cavity and the second lumen. In some embodiments, the cavity may be configured to receive the liquid from the medicine vial through the first lumen at the same time that the cavity distributes a gas into the second lumen. In some embodiments, the apparatus may include a pump that may be configured to facilitate fluid communication from the first lumen into the cavity and configured to facilitate fluid communication from the cavity into the second lumen. In various embodiments, the apparatus may include a liquid access member that may be configured to allow a needle or a spike to penetrate through the container and into the cavity to extract the liquid received by the cavity. In various embodiments, the vial coupling member cavity, the cavity, the first lumen, and the second lumen may form a sterile environment that is sealed from contaminants in the ambient environment.

In some embodiments, an apparatus to preserve liquid from a medicine vial is provided. The apparatus may include a fluid retaining member including a container forming a cavity. The apparatus may also include a vial coupling member. The vial coupling member may include a vial coupling member cavity formed by a housing and a flexible membrane. The flexible membrane may be configured to engage the medicine vial. The vial coupling member may also include a vial sealing member. The vial sealing member may be disposed in the vial coupling member cavity. The vial sealing member may be configured to receive the medicine vial engaged with the flexible membrane. The vial coupling member may further include a first vial penetrator disposed in the vial coupling member cavity. The first vial penetrator may form a first vial penetrator lumen in fluid communication with the vial coupling member cavity and the cavity. In addition, the vial coupling member may include a second vial penetrator disposed in the vial coupling member cavity. The second vial penetrator may form a second vial penetrator lumen in fluid communication with the vial coupling member cavity and the cavity. When the medicine vial is engaged to the flexible membrane and is advancing towards the vial sealing member, the first vial penetrator lumen and the second vial penetrator lumen may receive fluid communication with an interior space of the medicine vial without exposing the vial coupling member cavity or the interior space of the medicine vial to an ambient environment. In various embodiments, the cavity may be configured to receive the liquid from the medicine vial through the first lumen at the same time that the cavity distributes a gas into the second lumen. In various embodiments, the apparatus may further include a pump. The pump may be configured to facilitate fluid communication from the first lumen into the cavity and may be configured to facilitate fluid communication from the cavity into the second lumen. In various embodiments, the second lumen of the second fluid pathway may include a liquid-gas separator. The liquid-gas separator may be configured to prevent the liquid received by the cavity from communicating out of the cavity through the second lumen. In various embodiments, the fluid retaining member may include a liquid access member. The liquid access member may be configured to allow a needle or a spike to penetrate through the container and into the cavity to extract the liquid received by the cavity. In various embodiments, the vial coupling member cavity, the cavity, the first lumen, and the second lumen form a sterile environment that is sealed from contaminants in the ambient environment.

In some embodiments, an apparatus to preserve liquid from a medicine vial is provided. The apparatus may include a fluid retaining member including a container forming a cavity. The apparatus may also include a vial coupling member. The vial coupling member may include a vial coupling member cavity formed by a housing and a flexible membrane. The flexible membrane may be configured to engage the medicine vial. The vial coupling member may also include a vial sealing member. The vial sealing member may be disposed in the vial coupling member cavity. The vial sealing member may be configured to receive the medicine vial engaged with the flexible membrane. The vial coupling member may further include a vial penetrator disposed in the vial coupling member cavity. The vial penetrator may form a first vial penetrator lumen in fluid communication with the vial coupling member cavity and the cavity and a second vial penetrator lumen in fluid communication with the vial coupling member cavity and the cavity. When the medicine vial is engaged to the flexible membrane and is advancing towards the vial sealing member, the first vial penetrator lumen and the second vial penetrator lumen may receive fluid communication with an interior space of the medicine vial without exposing the vial coupling member cavity or the interior space of the medicine vial to an ambient environment. In various embodiments, the cavity may be configured to receive the liquid from the medicine vial through the first lumen at the same time that the cavity distributes a gas into the second lumen. In various embodiments, the apparatus may further include a pump. The pump may be configured to facilitate fluid communication from the first lumen into the cavity and may be configured to facilitate fluid communication from the cavity into the second lumen. In various embodiments, the second lumen of the second fluid pathway may include a liquid-gas separator. The liquid-gas separator may be configured to prevent the liquid received by the cavity from communicating out of the cavity through the second lumen. In various embodiments, the fluid retaining member may include a liquid access member. The liquid access member may be configured to allow a needle or a spike to penetrate through the container and into the cavity to extract the liquid received by the cavity. In various embodiments, the vial coupling member cavity, the cavity, the first lumen, and the second lumen form a sterile environment that is sealed from contaminants in the ambient environment.

In some embodiments, an apparatus to preserve liquid from a medicine vial is provided. The apparatus may include a first fluid retaining member including a first container forming a first cavity and a second fluid retaining member including a second container forming a second cavity. The apparatus may also include a vial coupling member. The vial coupling member may include a vial coupling member cavity formed by a housing and a flexible membrane. The flexible membrane may be configured to engage the medicine vial. The apparatus may also include a fluid transfer member. The fluid transfer member may include a first pair of fluid pathways each forming lumens. Each of the lumens of the first pair of fluid pathways may provide fluid communication between the first cavity and the vial coupling member cavity. The fluid transfer member may also include a second pair of fluid pathways each forming lumen. Each of the lumens of the second pair of fluid pathways may provide fluid communication between the second cavity and the vial coupling member cavity. The apparatus may further include a first disengaging member. The first disengaging member may be configured to disengage the first fluid retaining member from the first pair of fluid pathways without exposing at least the first cavity to an ambient environment. In addition, the apparatus may include a second disengaging member. The second disengaging member may be configured to disengage the second fluid retaining member from the second pair of fluid pathways without exposing at least the second cavity to the ambient environment. In various embodiments, the first cavity may be configured to receive a portion of the liquid from the medicine vial through a lumen of a first fluid pathway of the first fluid pathway pair at the same time that the cavity distributes a gas into a second lumen of a second fluid pathway of the first fluid pathway pair. In various embodiments, the second cavity may be configured to receive a remaining portion of the liquid from the medicine vial through a lumen of a first fluid pathway of the second fluid pathway pair at the same time that the cavity distributes a gas into a second lumen of a second fluid pathway of the second fluid pathway pair. In various embodiments, the apparatus may also include a pump. The pump may be configured to facilitate fluid communication from the vial coupling member cavity to the first cavity through a lumen of a first fluid pathway of the first fluid pathway pair, facilitate fluid communication from the vial coupling member cavity to the second cavity through a lumen of a first fluid pathway of the second fluid pathway pair, facilitate fluid communication from the first cavity to the vial coupling member cavity through a lumen of a second fluid pathway of the first fluid pathway pair, and facilitate fluid communication from the second cavity to the vial coupling member cavity through a lumen of a second fluid pathway of the second fluid pathway pair. In various embodiments, the apparatus may include a first pump and a second pump. The first pump may be configured to facilitate fluid communication from the vial coupling member cavity to the first cavity through a lumen of a first fluid pathway of the first fluid pathway pair, and facilitate fluid communication from the vial coupling member cavity to the second cavity through a lumen of a first fluid pathway of the second fluid pathway pair. The second pump may be configured to facilitate fluid communication from the first cavity to the vial coupling member cavity through a lumen of a second fluid pathway of the first fluid pathway pair, and facilitate fluid communication from the second cavity to the vial coupling member cavity through a lumen of a second fluid pathway of the second fluid pathway pair. In various embodiments, a lumen of a fluid pathway of the first fluid pathway pair may include a liquid-gas separator configured to prevent the liquid received by the first cavity from communicating out of the first cavity through the lumen of the fluid pathway of the first fluid pathway pair, and a lumen of a fluid pathway of the second fluid pathway pair may include a liquid-gas separator configured to prevent the liquid received by the second cavity from communicating out of the second cavity through the lumen of the fluid pathway of the second fluid pathway pair. In various embodiments, the apparatus may further include a first liquid access member and a second liquid access member. The first liquid access member may be configured to allow a needle or a spike to penetrate through the first container and into the first cavity to extract the liquid received by the first cavity. The second liquid access member may be configured to allow a needle or a spike to penetrate through the second container and into the second cavity to extract the liquid received by the second cavity. In various embodiments, the vial coupling member cavity, the first cavity, the second cavity, and each of the lumens of the fluid pathways of the first fluid pathway pair and the second fluid pathway pair may form a sterile environment that is sealed from contaminants in the ambient environment.

In some embodiments, an apparatus to preserve liquid from a medicine vial is provided. The apparatus may include a vial coupling member forming a vial coupling member cavity. The apparatus may also include a container forming a cavity. The apparatus may further include a first fluid pathway forming a first lumen that is in fluid communication with the vial coupling member cavity and the cavity. In addition, the apparatus may include a second fluid pathway forming a second lumen that is in fluid communication with the vial coupling member cavity and the cavity. In some embodiments, the vial coupling member cavity, the cavity, the first lumen, and the second lumen may form a sterile environment that is sealed from contaminants in an ambient environment. In various embodiments, the cavity may be configured to receive the liquid from the medicine vial through the first lumen at the same time that the cavity distributes a gas into the second lumen. In various embodiments, the apparatus may further include a pump. The pump may be configured to facilitate fluid communication from the first lumen into the cavity and may be configured to facilitate fluid communication from the cavity into the second lumen. In various embodiments, the second lumen of the second fluid pathway may include a liquid-gas separator. The liquid-gas separator may be configured to prevent the liquid received by the cavity from communicating out of the cavity through the second lumen. In various embodiments, the fluid retaining member may include a liquid access member. The liquid access member may be configured to allow a needle or a spike to penetrate through the container and into the cavity to extract the liquid received by the cavity. In various embodiments, the vial coupling member cavity, the cavity, the first lumen, and the second lumen form a sterile environment that is sealed from contaminants in the ambient environment.

In some embodiments, an apparatus to preserve liquid from a medicine vial is provided. The apparatus may include a housing and a flexible membrane. The apparatus may also include a vial coupling member cavity formed by the housing and the flexible membrane. The flexible membrane may be configured to engage a top portion of the medicine vial. The apparatus may also include a vial sealing member. The vial sealing member may be disposed in the vial coupling member cavity. The vial sealing member may be configured to receive the medicine vial engaged with the flexible membrane and form a sealed environment over the top portion of the medicine vial.

In some embodiments, an apparatus to preserve liquid from a medicine vial is provided. The apparatus may include a cavity formed by a cylinder and a piston. The apparatus may also include a housing, a flexible membrane, and a vial coupling member cavity formed by the housing and the flexible membrane. The flexible membrane may be configured to engage a top portion of the medicine vial. The vial coupling member may also include a vial sealing member disposed in the vial coupling member cavity. The vial sealing member may be configured to receive the medicine vial engaged with the flexible membrane and form a sealed environment over the top portion of the medicine vial. The vial coupling member may further include a vial penetrator. The vial penetrator may be disposed in the vial coupling member cavity and may form a vial penetrator lumen in fluid communication with the vial coupling member cavity and the cavity. As the vial sealing member receives the medicine vial engaged with the flexible membrane, the vial penetrator lumen may establish fluid communication with an interior space of the medicine vial without exposing the sealed environment and the interior space of the medicine vial to an ambient environment.

In some embodiments, an apparatus to preserve liquid from a medicine vial is provided. The apparatus may include a first cavity formed by a first cylinder and a first piston and a second cavity formed by a second cylinder and a second piston. The apparatus may also include a vial coupling member. The vial coupling member may include a housing, a flexible membrane, and a vial coupling member cavity formed by the housing and the flexible membrane. The flexible membrane may be configured to engage a top portion of the medicine vial. The vial coupling member may also include a vial sealing member. The vial sealing member may be disposed in the vial coupling member cavity. The vial sealing member may be configured to receive the medicine vial engaged with the flexible membrane and may form a sealed environment over the top portion of the medicine vial. The vial coupling member may further include a first vial penetrator. The first vial penetrator may be disposed in the vial coupling member cavity and may form a first vial penetrator lumen in fluid communication with the vial coupling member cavity and the first cavity. In addition, the vial coupling member may include a second vial penetrator. The second vial penetrator may be disposed in the vial coupling member cavity and may form a second vial penetrator lumen in fluid communication with the vial coupling member cavity and the second cavity. As the vial sealing member receives the medicine vial engaged with the flexible membrane, the first vial penetrator lumen and the second vial penetrator lumen may each establish fluid communication with an interior space of the medicine vial without exposing the sealed environment and the interior space of the medicine vial to an ambient environment. In various embodiments, the first cavity may be configured to provide a gas into the interior space of the vial through the first vial penetrator lumen and the second cavity may be configured to receive a liquid from the interior space of the vial through the second vial penetrator lumen. In various embodiments, the first cavity may be configured to provide a gas into the interior space of the vial through the first vial penetrator lumen and to receive a first portion of a liquid from the interior space of the vial through the first vial penetrator lumen, and the second cavity may be configured to provide a gas into the interior space of the vial through the second vial penetrator lumen and to receive a remaining portion of the liquid from the interior space of the vial through the second vial penetrator lumen It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus to preserve a first fluid from a medicine vial, the apparatus comprising:

a vial coupling member comprising a vial coupling member cavity;

a cavity formed by a container;

a first fluid pathway forming a first lumen that is in fluid communication with the cavity and the vial coupling member cavity; and a second fluid pathway forming a second lumen that is in fluid communication with the cavity and the vial coupling member cavity;

wherein when the medicine vial is engaged with the vial coupling member, the vial coupling member is configured to permit the first lumen and the second lumen to establish fluid communication with an interior space of the medicine vial;

wherein when the first lumen and the second lumen are in fluid communication with the interior space of the medicine vial, the cavity is configured to receive at least some of the first fluid from the medicine vial through the first lumen and simultaneously permit a communication of at least some of a second fluid from the cavity and into the second lumen for the medicine vial;

wherein when the at least some of the first fluid from the medicine vial is received by the cavity, the cavity permits direct contact between the at least some of the first fluid and at least some of a remainder of the second fluid retained in the cavity.

2. The apparatus of claim 1, wherein the vial coupling member cavity, the cavity, the first lumen, and the second lumen form a sterile environment that is sealed from contaminants in the ambient environment.

3. The apparatus of claim 1, wherein the container comprises a variable volume container.

4. The apparatus of claim 3, wherein the variable volume container comprises a flexible bag.

5. The apparatus of claim 1, further comprising a pump configured to facilitate fluid communication through the first lumen into the cavity and configured to facilitate fluid communication through the second lumen from the cavity.

6. The apparatus of claim 1, wherein the first fluid is a liquid and the second fluid is a gas, and wherein the second lumen includes a liquid-gas separator configured to prevent the first fluid received by the cavity from communicating out of the cavity through the second lumen.

7. The apparatus of claim 1, further comprising a fluid access member configured to allow a needle or a spike to penetrate through the container and into the cavity to extract the first fluid received by the cavity.

8. The apparatus of claim 1, wherein:

the vial coupling member comprises a housing and a flexible membrane; and the housing and the flexible membrane form the vial coupling member cavity.

9. The apparatus of claim 8, wherein:

when the medicine vial is engaged with the vial coupling member, the medicine vial engages with the flexible membrane; and when the medicine vial engages with the flexible membrane, the flexible membrane is configured to permit the first lumen and the second lumen to establish fluid communication with the interior space of the medicine vial.

* * * * *